US006620577B1

(12) United States Patent
Lynch et al.

(10) Patent No.: US 6,620,577 B1
(45) Date of Patent: Sep. 16, 2003

(54) HIGH SPEED PHOTOTHERMOGRAPHIC MATERIALS CONTAINING SELENIUM COMPOUNDS AND METHODS OF USING SAME

(75) Inventors: Doreen C. Lynch, Afton, MN (US); Andrea L. Opatz, Woodbury, MN (US); Henry J. Gysling, Rochester, NY (US); Sharon M. Simpson, Lake Elmo, MN (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/082,516

(22) Filed: Feb. 25, 2002

(51) Int. Cl.[7] ..... G03C 1/498; G03C 1/09

(52) U.S. Cl. ..... 430/350; 430/569; 430/600; 430/603; 430/629; 430/620; 430/964; 430/601; 430/604; 430/605; 430/611; 430/612

(58) Field of Search ..... 430/600, 603, 430/619, 350, 620, 569, 964, 605, 604, 601, 612, 611

(56) References Cited

U.S. PATENT DOCUMENTS

| | | | | |
|---|---|---|---|---|
| 4,036,650 A | | 7/1977 | Hasegawa et al. | |
| 4,639,414 A | | 1/1987 | Sakaguchi | |
| 5,677,120 A | * | 10/1997 | Lushington et al. | 430/603 |
| 5,763,154 A | * | 6/1998 | Gysling et al. | 430/603 |
| 5,843,632 A | | 12/1998 | Eshelman et al. | |
| 5,998,127 A | | 12/1999 | Toya et al. | |
| 6,040,131 A | | 3/2000 | Eshelman et al. | |
| 6,060,231 A | | 5/2000 | Zou | |
| 6,083,680 A | | 7/2000 | Ito et al. | |
| 6,083,681 A | | 7/2000 | Lynch et al. | |
| 6,100,022 A | | 8/2000 | Inoue et al. | |
| 6,110,659 A | | 8/2000 | Hatakeyama et al. | |

FOREIGN PATENT DOCUMENTS

| | | |
|---|---|---|
| GB | 1487874 | 5/1975 |
| JP | 5-165204 | 5/1993 |
| JP | 6-266082 | 6/1994 |
| JP | 9-311407 | 9/1997 |
| JP | 11-15121 | 11/1999 |

* cited by examiner

*Primary Examiner*—Thorl Chea
(74) *Attorney, Agent, or Firm*—J. Lanny Tucker

(57) ABSTRACT

Photothermographic imaging materials having increased photospeed are provided by certain selenium chemical sensitizers that are added during the formulation of a photothermographic emulsion. These selenium chemical sensitizers can be used alone or in combination with other sulfur, tellurium, or gold chemical sensitizers as well as with oxidatively decomposed sulfur-containing compounds.

73 Claims, No Drawings

HIGH SPEED PHOTOTHERMOGRAPHIC MATERIALS CONTAINING SELENIUM COMPOUNDS AND METHODS OF USING SAME

FIELD OF THE INVENTION

This invention relates to thermally-developable imaging materials such as photothermographic materials that exhibit high speed imaging characteristics. In particular, this invention relates to the use of certain selenium compounds as chemical sensitizers in photothermographic materials to provide increased photothermographic speed. This invention also relates to methods of imaging using these photothermographic materials.

BACKGROUND OF THE INVENTION

Silver-containing photothermographic imaging materials that are developed with heat and without liquid development have been known in the art for many years. Such materials are used in a recording process wherein an image is formed by imagewise exposure of the photothermographic material to specific electromagnetic radiation (for example, visible, ultraviolet, or infrared radiation) and developed by the use of thermal energy. These materials, also known as "dry silver" materials, generally comprise a support having coated thereon: (a) a photocatalyst (that is, a photosensitive compound such as a silver halide) that upon such exposure provides a latent image in exposed grains that is capable of acting as a catalyst for the subsequent formation of a silver image in a development step, (b) a non-photosensitive source of reducible silver ions, (c) a reducing composition (usually including a developer) for the reducible silver ions, and (d) a hydrophilic or hydrophobic binder. The latent image is then developed by application of thermal energy.

In such materials, the photosensitive catalyst is generally a photographic type photosensitive silver halide that is considered to be in catalytic proximity to the non-photosensitive source of reducible silver ions. Catalytic proximity requires intimate physical association of these two components, either prior to or during the thermal image development process, so that when silver atoms $(Ag^0)_n$, also known as silver specks, clusters, nuclei or latent image, are generated by irradiation or light exposure of the photosensitive silver halide, those silver atoms are able to catalyze the reduction of the reducible silver ions within a catalytic sphere of influence around the silver atoms [D. H. Klosterboer, *Imaging Processes and Materials*, (*Neblette'Eighth Edition*), J. Sturge, V. Walworth, and A. Shepp, Eds., Van Nostrand-Reinhold, New York, 1989, Chapter 9, pp. 279–291]. It has long been understood that silver atoms act as a catalyst for the reduction of silver ions, and that the photosensitive silver halide can be placed in catalytic proximity with the non-photosensitive source of reducible silver ions in a number of different ways (see, for example, *Research Disclosure*, June 1978, item 17029). Other photosensitive materials, such as titanium dioxide, cadmium sulfide, and zinc oxide have also been reported to be useful in place of silver halide as the photocatalyst in photothermographic materials [see, for example, Shepard, *J. Appl. Photog. Eng.* 1982, 8(5), 210–212, Shigeo et al., *Nippon Kagaku Kaishi*, 1994, 11, 992–997, and FR 2,254, 047 (Robillard)].

The photosensitive silver halide may be made "in-situ," for example by mixing an organic or inorganic halide-containing source with a source of reducible silver ions to achieve partial metathesis and thus causing the in-situ formation of silver halide (AgX) grains throughout the silver source [see, for example, U.S. Pat. No. 3,457,075 (Morgan et al.)]. In addition, photosensitive silver halides and sources of reducible silver ions can be co-precipitated [see Yu. E. Usanov et al., *J. Imag. Sci. Tech.* 1996, 40, 104]. Alternatively, a portion of the reducible silver ions can be completely converted to silver halide, and that portion can be added back to the source of reducible silver ions (see Yu. E. Usanov et al., International Conference on Imaging Science, Sep. 7–11, 1998).

The silver halide may also be "preformed" and prepared by an "ex-situ" process whereby the silver halide (AgX) grains are prepared and grown separately. With this technique, one has the possibility of controlling the grain size, grain size distribution, dopant levels, and composition much more precisely, so that one can impart more specific properties to both the silver halide grains and the photothermographic material. The preformed silver halide grains may be introduced prior to, and be present during, the formation of the source of reducible silver ions. Co-precipitation of the silver halide and the source of reducible silver ions provides a more intimate mixture of the two materials [see, for example, U.S. Pat. No. 3,839,049 (Simons)]. Alternatively, the preformed silver halide grains may be added to and physically mixed with the source of reducible silver ions.

The non-photosensitive source of reducible silver ions is a material that contains reducible silver ions. Typically, the preferred non-photosensitive source of reducible silver ions is a silver salt of a long chain aliphatic carboxylic acid having from 10 to 30 carbon atoms, or mixtures of such salts. Such acids are also known as "fatty acids" or "fatty carboxylic acids". Silver salts of other organic acids or other organic compounds, such as silver imidazoles, silver tetrazoles, silver benzotriazoles, silver benzotetrazoles, silver benzothiazoles and silver acetylides have also been used. U.S. Pat. No. 4,260,677 (Winslow et al.) discloses the use of complexes of various inorganic or organic silver salts.

In photothermographic materials, exposure of the photographic silver halide to light produces small clusters containing silver atoms $(Ag^0)_n$. The imagewise distribution of these clusters, known in the art as a latent image, is generally not visible by ordinary means. Thus, the photosensitive material must be further developed to produce a visible image. This is accomplished by the reduction of silver ions that are in catalytic proximity to silver halide grains bearing the silver-containing clusters of the latent image. This produces a black-and-white image. The non-photosensitive silver source in the exposed areas is catalytically reduced to form the visible black-and-white negative image while the silver halide and the non-photosensitive silver source in the unexposed areas are not reduced.

In photothermographic materials, the reducing agent for the reducible silver ions, often referred to as a "developer," may be any compound that, in the presence of the latent image, can reduce silver ion to metallic silver and is preferably of relatively low activity until it is heated to a temperature sufficient to cause the reaction. A wide variety of classes of compounds have been disclosed in the literature that function as developers for photothermographic materials. At elevated temperatures, the reducible silver ions are reduced by the reducing agent. In photothermographic materials, upon heating, this reaction occurs preferentially in the regions surrounding the latent image. This reaction produces a negative image of metallic silver having a color that ranges from yellow to deep black depending upon the presence of toning agents and other components in the imaging layer(s).

Differences Between Photothermography and Photography

The imaging arts have long recognized that the field of photothermography is clearly distinct from that of photography. Photothermographic materials differ significantly from conventional silver halide photographic materials that require processing with aqueous processing solutions.

As noted above, in photothermographic imaging materials, a visible image is created by heat as a result of the reaction of a developer incorporated within the material. Heating at 50° C. or more is essential for this dry development. In contrast, conventional photographic imaging materials require processing in aqueous processing baths at more moderate temperatures (from 30° C. to 50° C.) to provide a visible image.

In photothermographic materials, only a small amount of silver halide is used to capture light and a non-photosensitive source of reducible silver ions (for example a silver carboxylate) is used to generate the visible image using thermal development. Thus, the imaged photosensitive silver halide serves as a catalyst for the physical development process involving the non-photosensitive source of reducible silver ions and the incorporated reducing agent. In contrast, conventional wet-processed, black-and-white photographic materials use only one form of silver (that is, silver halide) that, upon chemical development, is itself at least partially converted into the silver image, or that upon physical development requires addition of an external silver source (or other reducible metal ions that form black images upon reduction to the corresponding metal). Thus, photothermographic materials require an amount of silver halide per unit area that is only a fraction of that used in conventional wet-processed photographic materials.

In photothermographic materials, all of the "chemistry" for imaging is incorporated within the material itself. For example, such materials include a developer (that is, a reducing agent for the reducible silver ions) while conventional photographic materials usually do not. Even in so-called "instant photography," the developer chemistry is physically separated from the photosensitive silver halide until development is desired. The incorporation of the developer into photothermographic materials can lead to increased formation of various types of "fog" or other undesirable sensitometric side effects. Therefore, much effort has gone into the preparation and manufacture of photothermographic materials to minimize these problems during the preparation of the photothermographic emulsion as well as during coating, use, storage, and post-processing handling.

Moreover, in photothermographic materials, the unexposed silver halide generally remains intact after development and the material must be stabilized against further imaging and development. In contrast, silver halide is removed from conventional photographic materials after solution development to prevent further imaging (that is, in the aqueous fixing step).

In photothermographic materials, the binder is capable of wide variation and a number of binders (both hydrophilic and hydrophobic) are useful. In contrast, conventional photographic materials are limited almost exclusively to hydrophilic colloidal binders such as gelatin.

Because photothermographic materials require dry thermal processing, they present distinctly different problems and require different materials in manufacture and use, compared to conventional, wet-processed silver halide photographic materials. Additives that have one effect in conventional silver halide photographic materials may behave quite differently when incorporated in photothermographic materials where the chemistry is significantly more complex. The incorporation of such additives as, for example, stabilizers, antifoggants, speed enhancers, supersensitizers, and spectral and chemical sensitizers in conventional photographic materials is not predictive of whether such additives will prove beneficial or detrimental in photothermographic materials. For example, it is not uncommon for a photographic antifoggant useful in conventional photographic materials to cause various types of fog when incorporated in photothermographic materials, or for supersensitizers that are. effective in photographic materials to be inactive in photothermographic materials.

These and other distinctions between photothermographic and photographic materials are described in *Imaging Processes and Materials* (*Neblette'Eighth Edition*), noted above, Unconventional Imaging Processes, E. Brinckman et al. (Eds.), The Focal Press, London and New York, 1978, pp. 74–75, in C. Zou et al., *J. Imaging Sci. Technol.* 1996, 40, pp. 94–103, and in M. R. V. Sahyun, *J. Imaging Sci. Technol.* 1998, 42, 23.

Problem to be Solved

One of the challenges in the use of photothermographic materials is attaining sufficient photothermographic speed in such materials to permit the use of conventional imaging sources.

Each of the pure photographic silver halides (silver chloride, silver bromide and silver iodide) has its own natural response to radiation, in both wavelength and speed, within the UV, near UV and blue regions of the electromagnetic spectrum. Mixtures of silver halides (for example, silver bromochloroiodide, silver chloroiodide, silver chlorobromide and silver iodobromide) also have their own natural sensitivities within the UV and blue regions of the electromagnetic spectrum. Thus, silver halide grains, when composed of only silver and halogen atoms have defined levels of sensitivity depending upon the levels of specific halogen, crystal morphology (shape and structure of the crystals or grains) and other characteristics such as, for example, crystal defects, stresses, and dislocations, and dopants incorporated within or on the crystal lattice of the silver halide. These features may or may not have been controlled or purposely introduced to affect emulsion sensitometry.

The efforts to influence silver halide grain speed in conventional wet-processed silver halide emulsions generally fall within the investigation of crystal composition, morphology or structure (all briefly described above), or the use of dopants, spectral sensitizers, supersensitizers, reduction sensitizers, and chemical sensitizers (including sulfur, tellurium, and selenium sensitizers).

Spectral sensitization is the addition of a compound (usually a dye) to silver halide grains that absorbs radiation at wavelengths (UV, visible or IR) other than those to which the silver halide is naturally sensitive, or that absorbs radiation more efficiently than silver halide (even within the regions of silver halide'natural sensitivity). It is generally recognized that spectral sensitizers extend the responses of photosensitive silver halide to longer wavelengths. After absorption of the radiation, these compounds transfer energy or electrons to the silver halide grains to cause the necessary local photoinduced reduction of silver(I) to silver(0).

Supersensitization is a process whereby the speed of spectrally sensitized silver halide is increased by the addition of still another compound that may or may not be a dye. This is not merely an additive effect of the two compounds (spectral sensitizer and supersensitizer).

Reduction sensitization is a type of chemical sensitization (described in more detail in the following paragraphs) in which other chemical species (not sulfur-containing) are deposited onto, or reacted with, the silver halide grains during grain growth and finishing. Compounds used for this purpose act as reducing agents on the silver halide grains and include, but are not limited to, stannous chloride, hydrazine, ethanolamine, and thiourea oxide.

Chemical sensitization (generally sulfur and/or gold sensitization) is a process, during or after silver halide crystal formation, in which sensitization centers [for example, silver sulfide clusters such as $(Ag_2S)_n$] are introduced onto the individual silver halide grains. For example, silver sulfide specks can be introduced by direct reaction of sulfur-contributing compounds with the silver halide during various stages, or after completion, of silver halide grain growth. These specks usually function as shallow electron traps for the preferential formation of latent image centers. Other chalcogens (Se and Te) can function similarly. The presence of these specks increases the speed or sensitivity of the resulting silver halide grains to radiation. Sulfur-contributing compounds useful for this purpose include thiosulfates (such as sodium thiosulfate) and various thioureas (such as allyl thiourea, thiourea, triethyl thiourea and 1,1'-diphenyl-2-thiourea) as described for example, by Sheppard et al., *J. Franklin Inst.*, 1923, 196, 653 and 673, C. E. K. Mees and T. H. James, *The Theory of the Photographic Process*, Fourth Edition, Eastman Kodak Company, Rochester, N.Y., 1977, pp. 152–3, and T. Tani, *Photographic Sensitivity. Theory and Mechanisms*, Oxford University Press, NY, 1995, pp. 167–176.

Another useful class of chemical sensitizers includes tetrasubstituted thioureas as described in copending and commonly assigned U.S. Ser. No. 09/667,748 (filed Sep. 21, 2000 by Lynch, Simpson, Shor, Willett, and Zou). These compounds are thioureas in which the nitrogen atoms are fully substituted with various substituents.

Still another method of chemical sensitization is achieved by oxidative decomposition of a sulfur-containing spectral sensitizing dye in a photothermographic emulsion as described in U.S. Pat. No. 5,891,615 (Winslow et al.).

Chemical sensitization to increase photospeed has also been achieved by treating the silver halide grains with gold-containing ions such as tetrachloroaurate(3+), dithiocyanatoaurate(1+) or covalent gold(1+) compounds such as $[AuS_2P(i\text{-}C_4H_9)_2]_2$. Preferably, the gold compounds are added in the later stages of silver halide grain formation such as during ripening. Platinum and palladium compounds are also known to have similar effects. In comparison, iridium, rhodium, and ruthenium compounds are generally used to control contrast and/or high intensity reciprocity effects rather than to increase speed. It is well known that the various speed enhancing means just described can be used in combination as the situation requires.

As noted above, in photothermographic emulsions, the photosensitive silver halide must be in catalytic proximity to the non-photosensitive source of reducible silver ions. Because of the different emulsion making procedures and chemical environments of photothermographic emulsions, the effects achieved by compounds (such as chemical sensitizers) in conventional photographic emulsions are not necessarily possible in photothermographic emulsions.

For example, in photothermographic emulsions, two types of chemical sensitization have been used to increase speed: (a) chemical sensitization of preformed silver halide grains that are then mixed into the solution or dispersion containing reducible silver ions in some manner, and (b) chemical sensitization of preformed silver halide grains that are already in intimate contact with the reducible silver ions.

In the first approach (a), many of the traditional methods (used for photographic emulsions) can be used, but for the second approach (b), quite specific methods and unique compounds are often needed. Regardless of which approach is used, there is considerable difficulty in attaining additional speed while maintaining low fog ($D_{min}$).

Selenium chemical sensitization of photothermographic materials has been reported. For example, U.S. Pat. No. 4,036,650 (Hasegawa et al.) describes the use of various metallized organosulfur compounds, including certain organosulfur selenides, as chemical sensitizers in heat-developable imaging materials. Other conventional chalcogen chemical sensitizing compounds, including selenium compounds, are described similarly in various patents including U.S. Pat. No. 5,998,127 (Toya et al.), U.S. Pat. No. 6,110,659 (Hatakeyama et al.), U.S. Pat. No. 6,100,022 (Inoue et al.), U.S. Pat. No. 6,083,681 (Lynch et al.), U.S. Pat. No. 6,083,080 (Ito et al.), and U.S. Pat. No. 6,040,131 (Eshelman et al.).

Photothermographic materials are constantly being redesigned to meet ever-increasing performance, storage, and manufacturing demands raised by customers, regulators, and manufacturers. One of these demands is increased photospeed without a significant increase in fog ($D_{min}$) or a loss in maximum image density ($D_{max}$).

SUMMARY OF THE INVENTION

The present invention relates to our discovery that the use of certain selenium compounds as chemical sensitizers provides photothermographic materials having increased photospeed without a significant increase in $D_{min}$ The present invention provides the desired benefits with a photothermographic material comprising a support having thereon one or more layers comprising a binder and in reactive association:

a. a preformed photosensitive silver halide, b. a non-photosensitive source of reducible silver ions, c. a reducing composition for the reducible silver ions, and d. a selenium chemical sensitizer represented by the following Structures I, II, or III:

$$Se(L)_m(X^1)_n \quad (I)$$

$$M(L')_s(X^2)_r \quad (II)$$

$$(Z)_wM'_xSe_y(CO)_z \quad (III)$$

wherein $X^1$ and $X^2$ independently represent halo, CN, SCN, SeCN, TeCN, $N_3$, $BF_4$, $ClO_4$, $BPh_4$, $PF_6$, $NO_3$, $SO_3CF_3$, $R_a$, $R_b$, $O(C{=}O)CF_3$, $S(C{=}S)N(R_a)(R_b)$, $S(C{=}S)OR_a$, $S(C{=}S)SR_a$, $S(P{=}S)(OR_a)(OR_b)$, $S(P{=}S)(R_a)(R_b)$, $SR_a$, $SeR_a$, $TeR_aOR_a$, or $O(C{=}O)R_a$ groups, $R_a$ and $R_b$ independently represent alkyl, alkenyl, cycloalkyl, heterocyclyl, or aryl groups, or $R_a$ and $R_b$ taken together can form a 5-, 6- or 7-membered heterocyclic ring, L is a ligand derived from a neutral Lewis base, m is 0, 1, 2, 3, or 4 and n is 2 or 4 with the proviso that when m is 0, n is 2 or 4, and when m is 0 and n is 2, then $X^1$ is not $R_a$, $R_b$, or $R_aSe$, M represents Cu(1+), Pd(2+), or Pt(2+), L' represents a neutral ligand with a Group 15 atom or a Group 16 atom, provided that at least one of L' or $X^2$ contains a selenium atom, r is 1 or 2 and s is 1, 2, 3, or 4 such that when M represents Cu(1+), r is 1 and when M represents Pd(2+) or Pt(2+), r is 2, Z represents a monovalent cation, M' represents Fe, Ru, Os, Co, Rh, or Ir, x is an integer of from 1 to 6, y is an integer of from 1 through 6, z is an integer of from 6 through 20, w is an integer inclusive of from 0 through 4 and represents the number of Z groups necessary to neutralize the electronic charge on the rest of the compound, and further provided that multiple $X^1$, $X^2$, L, L', $R_a$, $R_b$, groups in the molecule can be the same or different.

In some Structure I embodiments, when m is 0 and n is 2 or 4 the compounds represented by Structure I can be further represented by Structure I-a, (I-a)

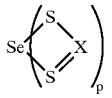

wherein X represents the same or different $COR_a$, $CSR_a$, $CN(R_a)(R_b)$, $CR_a$, $P(R_a)(R_b)$, or $P(OR_a)(OR_b)$ group, $R_a$ and $R_b$ are as defined above, and p is 2 or 4.

In some embodiments, one or more thiourea ligands useful in the selenium compounds (for example, L in Structure I or L' in Structure II) are derived from compounds represented by the following Structures IV, V, or VI:

(IV)

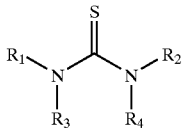

(V)

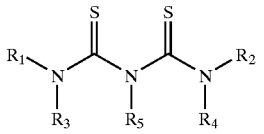

(VI)

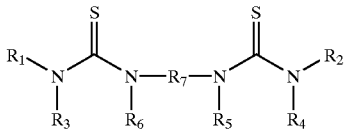

wherein:

in Structure IV, $R_1$, $R_2$, $R_3$ and $R_4$ are independently hydrogen, alkyl, cycloalkyl, alkenyl, alkynyl, aryl or heterocyclic groups, or R, and $R_2$ taken together, $R_3$ and $R_4$ taken together, $R_1$ and $R_3$ taken together or $R_2$ and $R_4$ taken together, can form a 5- to 7-membered heterocyclic ring, and in Structure V, $R_1$, $R_2$, $R_3$, $R_4$ and $R_5$ are independently hydrogen, alkyl, cycloalkyl, allyl, alkenyl, alkynyl, aryl or heterocyclic groups, or $R_3$ and $R_5$ taken together, $R_4$ and $R_5$ taken together, $R_1$ and $R_3$ taken together or $R_2$ and $R_4$ taken together, can form a substituted or unsubstituted 5- to 7-membered heterocyclic ring, and in Structure VI, $R_1$, $R_2$, $R_3$, $R_4$, $R_5$, and $R_6$ are independently hydrogen, alkyl, cycloalkyl, allyl, alkenyl, alkynyl, aryl or heterocyclic groups, or $R_3$ and $R_6$ taken together, $R_4$ and $R_5$ taken together, $R_1$ and $R_3$ taken together, $R_2$ and $R_4$ taken together, or $R_5$ and $R_6$ taken together, can form a substituted or unsubstituted 5- to 7-membered heterocyclic ring, and $R_7$ is a divalent aliphatic or alicyclic linking group.

In further embodiment photothermographic material further comprises a sulfur chemical sensitizer. In one embodiment, the sulfur chemical comprises a thiosulfate, thiazole, rhodanine compound or a thiourea chemical sensitizer represented by Structures IV, V, or VI.

In a still further embodiment, the photothermographic material further comprises tellurium chemical sensitizer.

In yet a still further embodiment, the photothermographic material further comprises gold chemical sensitizer.

Still further chemical sensitization can be achieved by oxidative decomposition of a sulfur-containing compound on or around the silver halide grains in an oxidizing environment.

In a further embodiment photothermographic material further comprises a mixture of two or more of: a sulfur chemical sensitizer, a tellurium chemical sensitizer, a gold chemical sensitizer, or an oxidatively decomposed sulfur-containing compound.

In another embodiment, the present invention provides a photothermographic material comprising a support having thereon one or more layers comprising a binder and in reactive association:

a. a photocatalyst, b. a non-photosensitive source of reducible silver ions, c. a reducing composition for the reducible silver ions, and d. a selenium chemical sensitizer represented by the following Structures I, II, or III:

$$Se(L)_m(X^1)_n \quad (I)$$

$$M(L')_s(X^2)_r \quad (II)$$

$$(Z)_w M'_x Se_y (CO)_z \quad (III)$$

wherein $X^1$ and $X^2$ independently represent halo, CN, SCN, SeCN, TeCN, $N_3$, $BF_4$, $ClO_4$, $BPh_4$, $PF_6$, $NO_3$, $SO_3CF_3$, $R_a$, $R_b$, $O(C{=}O)CF_3$, $S(C{=}S)N(R_a)(R_b)$, $S(C{=}S)OR_a$, $S(C{=}S)SR_a$, $S(P{=}S)(OR_a)(OR_b)$, $S(P{=}S)(R_a)(R_b)$, $SR_a$, $SeR_a$, $TeR_a$ $OR_a$ or $O(C{=}O)R_a$ groups, $R_a$ and $R_b$ independently represent alkyl, alkenyl, cycloalkyl, heterocyclyl, or aryl groups, or $R_a$ and $R_b$ taken together can form a 5-, 6- or 7-membered heterocyclic ring, L is a ligand derived from a neutral Lewis base, m is 0, 1, 2, 3, or 4 and n is 2 or 4 with the proviso that when m is 0, n is 2 or 4, and when m is 0 and n is 2, then $X^1$ is not $R_a$, $R_b$, or $R_aSe$, M represents Cu(1+), Pd(2+), or Pt(2+), L' represents a neutral ligand with a Group 15 atom or a Group 16 atom, provided that at least one of L' or $X^2$ contains a selenium atom, r is 1 or 2 and s is 1, 2, 3, or 4 such that when M represents Cu(1+), r is 1 and when M represents Pd(2+) or Pt(2+), r is 2, Z represents a monovalent cation, M' represents Fe, Ru, Os, Co, Rh, or Ir, x is an integer of from 1 to 6, y is an integer of from 1 through 6, z is an integer of from 6 through 20, w is an integer inclusive of from 0 through 4 and represents the number of Z groups necessary to neutralize the electronic charge on the rest of the compound, and further provided that multiple $X^1$, $X^2$, L, L', $R_a$, $R_b$, groups in the molecule can be the same or different.

In some Structure I embodiments, when m is 0 and n is 2 or 4 the compounds represented by Structure I can be further represented by Structure I-a, (I-a)

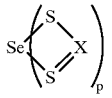

wherein X represents the same or different $COR_a$, $CSR_a$, $CN(R_a)(R_b)$, $CR_a$, $P(R_a)(R_b)$, or $P(OR_a)(OR_b)$ group, $R_a$ and $R_b$ are as defined above, and p is 2 or 4.

In some embodiments, one or more thiourea ligands useful in the selenium compounds (for example, L in Structure I or L' in Structure II) are derived from compounds represented by the following Structures IV, V, or VI:

(IV)

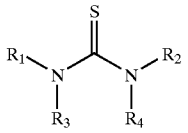

(V)

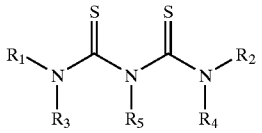

(VI)

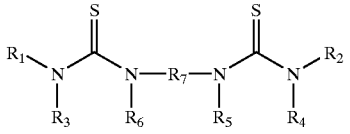

wherein:

in Structure IV, $R_1$, $R_2$, $R_3$ and $R_4$ are independently hydrogen, alkyl, cycloalkyl, alkenyl, alkynyl, aryl or heterocyclic groups, or $R_1$ and $R_2$ taken together, $R_3$ and $R_4$ taken together, $R_1$ and $R_3$ taken together or $R_2$ and $R_4$ taken together, can form a 5- to 7-membered heterocyclic ring, and in Structure V, $R_1$, $R_2$, $R_3$, $R_4$ and $R_5$ are independently hydrogen, alkyl, cycloalkyl, allyl, alkenyl, alkynyl, aryl or heterocyclic groups, or $R_3$ and $R_5$ taken together, $R_4$ and $R_5$ taken together, $R_1$ and $R_3$ taken together or $R_2$ and $R_4$ taken together, can form a substituted or unsubstituted 5- to 7-membered heterocyclic ring, and in Structure VI, $R_1$, $R_2$, $R_3$, $R_4$, $R_5$, and $R_6$ are independently hydrogen, alkyl, cycloalkyl, allyl, alkenyl, alkynyl, aryl or heterocyclic groups, or $R_3$ and $R_6$ taken together, $R_4$ and $R_5$ taken together, $R_1$ and $R_3$ taken together, $R_2$ and $R_4$ taken together, or $R_5$ and $R_6$ taken together, can form a substituted or unsubstituted 5- to 7-membered heterocyclic ring, and $R_7$ is a divalent aliphatic or alicyclic linking group.

In further embodiment photothermographic material further comprises a sulfur chemical sensitizer. In one embodiment, the sulfur chemical comprises a thiosulfate, thiazole, rhodanine compound or a thiourea chemical sensitizer represented by Structures IV, V, or VI.

In a still further embodiment, the photothermographic material further comprises tellurium chemical sensitizer.

In yet a still further embodiment, the photothermographic material further comprises gold chemical sensitizer.

Still further chemical sensitization can be achieved by oxidative decomposition of a sulfur-containing compound on or around the silver halide grains in an oxidizing environment.

In a further embodiment photothermographic material further comprises a mixture of two or more of: a sulfur chemical sensitizer, a tellurium chemical sensitizer, a gold chemical sensitizer, or an oxidatively decomposed sulfur-containing compound.

This invention also provides a photothermographic material comprising a transparent support having thereon one or more layers one on side thereof comprising a binder and in reactive association:

a. a photocatalyst, b. a non-photosensitive source of reducible silver ions, c. a reducing composition for the reducible silver ions, and d. a selenium chemical sensitizer represented by the following Structures I, II, or III:

$$Se(L)_m(X^1)_n \quad (I)$$

$$M(L')_s(X^2)_r \quad (II)$$

$$(Z)_w M'_x Se_y(CO)_z \quad (III)$$

wherein $X^1$ and $X^2$ independently represent halo, CN, SCN, SeCN, TeCN, $N_3$, $BF_4$, $ClO_4$, $BPh_4$, $PF_6$, $NO_3$, $SO_3CF_3$, $R_a$, $R_b$, $O(C{=}O)CF_3$, $S(C{=}S)N(R_a)(R_b)$, $S(C{=}S)OR_a$, $S(C{=}S)SR_a$, $S(P{=}S)(OR_a)(OR_b)$, $S(P{=}S)(R_a)(R_b)$, $SR_a$, $SeR_a$, $TeR_aOR_a$, or $O(C{=}O)R_a$ groups, $R_a$ and $R_b$ independently represent alkyl, alkenyl, cycloalkyl, heterocyclyl, or aryl groups, or $R_a$ and $R_b$ taken together can form a 5-, 6- or 7-membered heterocyclic ring, L is a ligand derived from a neutral Lewis base, m is 0, 1,2,3, or 4 and n is 2 or 4 with the proviso that when m is 0, n is 2 or 4, and when m is 0 and n is 2, then $X^1$ is not $R_a$, $R_b$, or $R_aSe$, M represents Cu(1+), Pd(2+), or Pt(2+), L' represents a neutral ligand with a Group 15 atom or a Group 16 atom, provided that at least one of L' or $X^2$ contains a selenium atom, r is 1 or 2 and s is 1, 2, 3, or 4 such that when M represents Cu(1+), r is 1 and when M represents Pd(2+) or Pt(2+), r is 2, Z represents a monovalent cation, M' represents Fe, Ru, Os, Co, Rh, or Ir, x is an integer of from 1 to 6, y is an integer of from 1 through 6, z is an integer of from 6 through 20, w is an integer inclusive of from 0 through 4 and represents the number of Z groups necessary to neutralize the electronic charge on the rest of the compound, and further provided that multiple $X^1$, $X^2$, L, L', $R_a$, $R_b$, groups in the molecule can be the same or different, and on the opposite side of the transparent support, an antihalation layer comprising one or more antihalation dyes.

Further, a method of this invention for forming a visible image comprises:

A) imagewise exposing any of the photothermographic materials described above to electromagnetic radiation to form a latent image, and B) simultaneously or sequentially, heating the exposed photothermographic material to develop the latent image into a visible image.

In some embodiments of this invention to provide an image, any of the photothermographic materials described above has a transparent support and the imaging method of this invention further includes:

C) positioning the exposed and heat-developed photothermographic material with the visible image therein between a source of imaging radiation and an imageable material that is sensitive to the imaging radiation, and D) thereafter exposing the imageable material to the imaging radiation through the visible image in the exposed and heat-developed photothermographic material to provide a visible image in the imageable material.

In still another embodiment of this invention, a method for preparing a photothermographic emulsion comprises the following steps, in order:

A) providing a photothermographic emulsion comprising silver halide grains and a non-photosensitive source of reducible silver ions, and B) positioning one or more of the selenium chemical sensitizers represented by Structures I, II, or III noted above, on or around the silver halide grains.

Moreover, another method of preparing a photothermographic emulsion comprises:

A) providing silver halide grains,

B) providing a photothermographic emulsion of the silver halide grains and a non-photosensitive source of reducible silver ions, and C) during or at any time after step A, chemically sensitizing the silver halide grains with a selenium chemical sensitizer represented by Structures I, II, or III as noted above.

Moreover, another method of preparing a photothermographic emulsion comprises:

A) providing silver halide grains,

B) providing a photothermographic emulsion of the silver halide grains and a non-photosensitive source of reducible silver ions, and C) during or at any time after step A, chemically sensitizing the silver halide grains with a selenium chemical sensitizer represented by Structures I, II, or III as noted above.

D) during or at any time after step A, chemically sensitizing the silver halide grains by oxidative decomposition of a sulfur-containing compound, or by addition of a sulfur chemical sensitizer, a tellurium chemical sensitizer, a gold chemical sensitizer, or by combinations thereof.

The speed increasing compounds described for use in the phototheimographic materials of this invention have a number of useful properties. For example, they can easily be prepared in good yields as air stable solids and are resistant to hydrolysis. Moreover, they are soluble in a range of useful coating solvents. This allows them to be included easily in the imaging element formulations.

The speed increasing ability of the selenium compounds described herein was not anticipated from the teaching in the prior art. Moreover, prior art chemical sensitizers have generally not produced speed enhancement while maintaining high $D_{max}$ and low $D_{min}$.

DETAILED DESCRIPTION OF THE INVENTION

The photothermographic materials of this invention can be used, for example, in conventional black-and-white or color photothermography, in electronically generated black-and-white or color hardcopy recording. They can be used in microfilm applications, in radiographic imaging (for example, digital medical imaging), and in industrial radiography. Furthermore, the absorbance of these photothermographic materials between 350 and 450 nm is desirably low (less than 0.5) to permit their use in graphic arts (for example, imagesetting and phototypesetting), in the manufacture of printing plates, in contact printing, proofing, and duplicating ("duping"). The photothermographic materials are particularly useful for medical radiography to provide black-and-white images.

In the photothermographic materials of this invention, the components needed for imaging can be in one or more layers. The layer(s) that contain the photosensitive photocatalyst (such as a photosensitive silver halide) or non-photosensitive source of reducible silver ions, or both, are referred to herein as photothermographic emulsion layer(s). The photocatalyst and the non-photosensitive source of reducible silver ions are in catalytic proximity (that is, in reactive association with each other) and preferably are in the same layer. "Catalytic proximity" or "reactive association" means that they are in the same layer or in adjacent layers.

Various layers are usually disposed on the "backside" (non-emulsion side) of the materials, including antihalation layer(s), protective layers, antistatic layers, conducting layers, and transport enabling layers.

Various layers are also usually disposed on the "frontside" or emulsion side of the support, including protective topcoat layers, primer layers, interlayers, opacifying layers, antistatic layers, antihalation layers, acutance layers, auxiliary layers, and others readily apparent to one skilled in the art.

Definitions

As used herein:

In the descriptions of the photothermographic materials of the present invention, "a" or "an" component refers to "at least one" of that component. For example, the selenium compounds described herein for chemical sensitization can be used individually or in mixtures.

Heating in a substantially water-free condition as used herein, means heating at a temperature of from about 50° C. to about 250° C. with little more than ambient water vapor present. The term "substantially water-free condition" means that the reaction system is approximately in equilibrium with water in the air and water for inducing or promoting the reaction is not particularly or positively supplied from the exterior to the material. Such a condition is described in T. H. James, *The Theory of the Photographic Process*, Fourth Edition, Eastman Kodak Company, Rochester, N.Y. 1977, p. 374.

"Photothermographic material(s)" means a construction comprising at least one photothermographic emulsion layer or a photothermographic set of layers (wherein the silver halide and the source of reducible silver ions are in one layer and the other essential components or desirable additives are distributed, as desired, in an adjacent coating layer) and any supports, topcoat layers, imagereceiving layers, blocking layers, antihalation layers, or subbing or priming layers. These materials also include multilayer constructions in which one or more imaging components are in different layers, but are in "reactive association" so that they readily come into contact with each other during imaging and/or development. For example, one layer can include the non-photosensitive source of reducible silver ions and another layer can include the reducing composition, but the two reactive components are in reactive association with each other.

"Emulsion layer," "imaging layer," or "photothermographic emulsion layer," means a layer of a photothermographic material that contains the photosensitive silver halide and/or non-photosensitive source of reducible silver ions. It can also mean a layer of the photothermographic material that contains, in addition to the photosensitive silver halide and/or non-photosensitive source of reducible ions, additional essential components and/or desirable additives. These layers are usually on what is known as the "frontside" of the support.

"Photocatalyst" means a photosensitive compound such as silver halide that, upon exposure to radiation, provides a compound that is capable of acting as a catalyst for the subsequent development of the image-forming material.

"Ultraviolet region of the spectrum" refers to that region of the spectrum less than or equal to 410 nm, and preferably from about 100 nm to about 410 nm, although parts of these ranges may be visible to the naked human eye. More preferably, the ultraviolet region of the spectrum is the region of from about 190 to about 405 nm.

"Visible region of the spectrum" refers to that region of the spectrum of from about 400 nm to about 700 nm.

"Short wavelength visible region of the spectrum" refers to that region of the spectrum from about 400 nm to about 450 nm.

"Red region of the spectrum" refers to that region of the spectrum of from about 600 nm to about 700 nm.

"Infrared region of the spectrum" refers to that region of the spectrum of from about 700 nm to about 1400 nm.

"Won-photosensitive" means not intentionally light sensitive.

"Transparent" means capable of transmitting visible light or imaging radiation without appreciable scattering or absorption.

The sensitometric terms "photospeed" or "photographic speed" (also known as "sensitivity"), "absorbance," "contrast", $D_{mim}$, and $D_{max}$ have conventional definitions known in the imaging arts. Particularly, $D_{min}$ is considered herein as image density achieved when the photothermographic material is thermally developed without prior exposure to radiation.

The sensitometric term absorbance is another term for optical density (OD).

As is well understood in this area, for the selenium compounds defined herein, substitution is not only tolerated, but is often advisable and various substituents are anticipated on the compounds used in the present invention. Thus, when a compound is referred to as "having the structure" of a given formula, any substitution that does not alter the bond structure of the formula or the shown atoms within that structure is included within the formula, unless such substitution is specifically excluded by language (such as "free of carboxy-substituted alkyl"). For example, where a benzene ring structure is shown (including fused ring structures), substituent groups may be placed on the benzene ring structure, but the atoms making up the benzene ring structure may not be replaced.

As a means of simplifying the discussion and recitation of certain substituent groups, the term "group" refers to chemical species that may be substituted as well as those that are not so substituted. Thus, the term "group," such as "alkyl group" is intended to include not only pure hydrocarbon alkyl chains, such as methyl, ethyl, n-propyl, t-butyl, cyclohexyl, iso-octyl, and octadecyl, but also alkyl chains bearing substituents known in the art, such as hydroxyl, alkoxy, phenyl, halogen atoms (F, Cl, Br, and I), cyano, nitro, amino, and carboxy. For example, alkyl group includes ether and thioether groups (for example, $CH_3$—$CH_2$—$CH_2$—O—$CH_2$— and $CH_3$—$CH_2$—$CH_2$—S—$CH_2$—), haloalkyl, nitroalkyl, alkylcarboxy, carboxyalkyl, carboxamido, hydroxyalkyl, sulfoalkyl, and other groups readily apparent to one skilled in the art. Substituents that adversely react with other active ingredients, such as very strongly electrophilic or oxidizing substituents, would, of course, be excluded by the ordinarily skilled artisan as not being inert or harmless.

In the compounds described herein, no particular double bond geometry (for example, cis or trans) is intended by the structures drawn. Similarly, the alternating single and double bonds and localized charges are drawn as a formalism. In reality, both electron and charge delocalization exists throughout the conjugated chain.

*Research Disclosure* is a publication of Kenneth Mason Publications Ltd., Dudley House, 12 North Street, Emsworth, Hampshire PO10 7DQ England (also available from Emsworth Design Inc., 147 West 24th Street, New York, N.Y. 10011).

Other aspects, advantages, and benefits of the present invention are apparent from the detailed description, examples, and claims provided in this application.

The Photocatalyst

As noted above, the photothermographic materials of the present invention include one or more photocatalysts in the photothermographic emulsion layer(s). Useful photocatalysts are typically silver halides such as silver bromide, silver iodide, silver chloride, silver bromoiodide, silver chlorobromoiodide, silver chlorobromide and others readily apparent to one skilled in the art. Mixtures of silver halides can also be used in any suitable proportion. Silver bromide and silver bromoiodide are more preferred, with the latter silver halide having up to 10 mol % silver iodide. Typical techniques for preparing and precipitating silver halide grains are described in *Research Disclosure*, 1978, item 17643.

The shape of the photosensitive silver halide grains used in the present invention is in no way limited. The silver halide grains may have any crystalline habit including, but not limited to, cubic, octahedral, tetrahedral, orthorhombic, rhombic, dodecahedral, other polyhedral, tabular, laminar, twinned, and platelet morphologies, and may have epitaxial growth of crystals thereon. If desired, a mixture of these crystals may be employed. Silver halide grains having cubic and tabular morphology are preferred.

The silver halide grains may have a uniform ratio of halide throughout. They may have a graded halide content, with a continuously varying ratio of, for example, silver bromide and silver iodide or they may be of the core-shell type, having a discrete core of one halide ratio, and a discrete shell of another halide ratio. Core-shell silver halide grains useful in photothermographic materials and methods of preparing these materials are described for example, in U.S. Pat. No. 5,382,504 (Shor et al.), incorporated herein by reference. Iridium and/or copper doped core-shell and non-core-shell grains are described in U.S. Pat. No. 5,434,043 (Zou et al.) and U.S. Pat. No. 5,939,249 (Zou), both incorporated herein by reference.

The photosensitive silver halide can be added to (or formed within) the emulsion layer(s) in any fashion as long as it is placed in catalytic proximity to the non-photosensitive source of reducible silver ions.

It is preferred that the silver halides be preformed and prepared by an ex-situ process. The silver halide grains prepared ex-situ may then be added to and physically mixed with the non-photosensitive source of reducible silver ions. It is more preferable to form the source of reducible silver ions in the presence of ex-situ-prepared silver halide. In this process, the source of reducible silver ions, such as a long chain fatty acid silver carboxylate (commonly referred to as a silver "soap"), is formed in the presence of the preformed silver halide grains. Co-precipitation of the reducible source of silver ions in the presence of silver halide provides a more intimate mixture of the two materials [see, for example, U.S. Pat. No. 3,839,049 (Simons)]. Materials of this type are often referred to as "preformed soaps."

The silver halide grains used in the imaging formulations can vary in average diameter of up to several micrometers ($\mu$m) depending on their desired use. Preferred silver halide grains are those having an average particle size of from about 0.01 to about 1.5 $\mu$m, more preferred are those having an average particle size of from about 0.03 to about 1.0 $\mu$m, and most preferred are those having an average particle size of from about 0.05 to about 0.8 $\mu$m. Those of ordinary skill in the art understand that there is a finite lower practical limit for silver halide grains that is partially dependent upon the wavelengths to which the grains are spectrally sensitized. Such a lower limit, for example, is typically from about 0.01 to 0.005 $\mu$m.

The average size of the photosensitive doped silver halide grains is expressed by the average diameter if the grains are spherical, and by the average of the diameters of equivalent circles for the projected images if the grains are cubic or in other non-spherical shapes.

Grain size may be determined by any of the methods commonly employed in the art for particle size measurement. Representative methods are described by in "Particle Size Analysis," ASTM Symposium on Light Microscopy, R. P. Loveland, 1955, pp. 94–122, and in C. E. K. Mees and T. H. James, *The Theory of the Photographic Process*, Third Edition, Macmillan, New York, 1966 Chapter 2. Particle size measurements may be expressed in terms of the projected areas of grains or approximations of their diameters. These will provide reasonably accurate results if the grains of interest are substantially uniform in shape.

Preformed silver halide emulsions used in the material of this invention can be prepared by aqueous or organic processes and can be unwashed or washed to remove soluble salts. In the latter case, the soluble salts can be removed by ultrafiltration, by chill setting and leaching, or by washing the coagulum [for example, by the procedures described in U.S. Pat. No. 2,618,556 (Hewitson et al.), U.S. Pat. No. 2,614,928 (Yutzy et al.), U.S. Pat. No. 2,565,418 (Yackel), U.S. Pat. No. 3,241,969 (Hart et al.) and U.S. Pat. No. 2,489,341 (Waller et al.)].

It is also effective to use an in-situ process in which a halide-containing compound is added to an organic silver salt to partially convert the silver of the organic silver salt to silver halide. The halogen-containing compound can be inorganic (such as zinc bromide or lithium bromide) or organic (such as N-bromosuccinimide).

It is also effective to use mixtures of both preformed and in-situ generated silver halide.

Additional methods of preparing these silver halide and organic silver salts and manners of blending them are described in *Research Disclosure*, June 1978, item 17029, U.S. Pat. No. 3,700,458 (Lindholm), U.S. Pat. No. 4,076,539 (Ikenoue et al.), and JP Applications 13224/74, 42529/76, and 17216/75.

In some instances, it may be helpful to prepare the photosensitive silver halide grains in the presence of a hydroxytetraazaindene (such as 4-hydroxy-6-methyl-1,3,3,3a,7-tetraazaindene) or an N-heterocyclic compound comprising at least one mercapto group (such as 1-phenyl-5-mercaptotetrazole) to provide increased photospeed. Details of this procedure are provided in copending and commonly assigned U.S. Ser. No. 09/833,533 (filed Apr. 12, 2001 by Shor, Zou, Ulrich, and Simpson), that is incorporated herein by reference.

The one or more light-sensitive silver halides used in the photothermographic materials of the present invention are preferably present in an amount of from about 0.005 to about 0.5 mole, more preferably from about 0.01 to about 0.25 mole, and most preferably from about 0.03 to about 0.15 mole, per mole of non-photosensitive source of reducible silver ions.

Chemical Sensitizers

The advantages of this invention are provided by chemically sensitizing the silver halide(s) with certain speed increasing selenium compounds. Thus, these selenium compounds can be used effectively as chemical sensitizers.

The advantages of this invention are provided by chemically sensitizing the silver halide(s) with certain speed increasing selenium compounds. Thus, these selenium compounds can be used effectively as chemical sensitizers. They can be represented by the following Structures I, II, or III:

$$Se(L)_m(X^1)_n \quad (I)$$

$$M(L')_s(X^2)_r \quad (II)$$

$$(Z)_w M'_x Se_y (CO)_z \quad (III)$$

In Structure I, $X^1$ represents a halo (chloro, bromo, or iodo), CN, SCN, SeCN, TeCN, $N_3$, $BF_4$, $ClO_4$, $BPh_4$, $PF_6$, $NO_3$, $SO_3CF_3$, $O(C{=}O)CF_3$, $S(C{=}S)N(R_a)(R_b)$, $S(C{=}S)OR_a$, $S(C{=}S)SR_a$, $S(P{=}S)(OR_a)(OR_b)$, $S(P{=}S)(R_a)(R_b)$, $SR_a$, $SeR_a$, $TeR_aOR_a$, alkyl (as defined below for $R_a$ and $R_b$), aryl (as defined below for Ar), or $O(C{=}O)R_a$ group wherein $R_a$ and $R_b$ are as defined below. Preferably, $X^1$ represents a halo (such as chloro or bromo), SCN, or $S(C{=}S)N(R_a)(R_b)$ group, and more preferably, it represents a halo group such as chloro or bromo. The multiple $X^1$ groups in a Structure I compound can be the same or different groups. Wherever referred to herein, "Ph" refers to the same or different substituted or unsubstituted phenyl groups.

The "$R_a$ and $R_b$" groups used to define substituent groups in $X^1$ can be any suitable substituted or unsubstituted alkyl group having 1 to 20 carbon atoms (including all possible isomers, such as methyl, ethyl, isopropyl, t-butyl, octyl, decyl, trimethylsilylmethyl, and 3-trimethylsilyl-n-propyl), substituted or unsubstituted alkenyl group having 2 to 20 carbon atoms (including all possible isomers such as ethenyl, 1-propenyl, and 2-propenyl) or substituted or unsubstituted carbocyclyl groups (such as cyclopentyl, cyclohexyl, or cycloheptyl), heterocyclyl groups (such as morpholinyl, piperidyl, and piperazyl), or aryl group (Ar) having 6 to 10 carbon atoms in the single- or fused-ring system (such as phenyl, 4-methylphenyl, anthryl, naphthyl, xylyl, mesityl, indenyl, pentafluorophenyl, 2,4,6-tri(t-butyl) phenyl, p-methoxyphenyl, 3,5-dimethylphenyl, p-tolyl, pyridyl, and 2-phenylethyl). In addition, when $X^1$ groups contain more than an $R_a$ and an $R_b$ group, these groups may be joined together to form a substituted or unsubstituted 5- to 7-membered heterocyclic ring. Preferably, $R_a$ and $R_b$ are a substituted or unsubstituted alkyl group having 1 to 8 carbon atoms, or a substituted or unsubstituted phenyl group. Unless otherwise noted, multiple $R_a$ and $R_b$, groups in a molecule can be the same or different groups.

L represents the same or different neutral Lewis base ligands, such as ligands derived from thiourea, substituted thioureas, cyclic thioureas such as imidazolidine-2-thione, substituted cyclic thioureas such as N,N-dimethyl-imidazolidine-2-thione, pyridine, and substituted pyridines. Preferably, L is a ligand derived from thiourea or a substituted thiourea, and more preferably, it is a ligand derived from a substituted thiourea as defined below in Structures IV, V, or VI. Multiple L groups in the Structure I groups can be the same or different groups.

Also in Structure I, m is 0, 1, 2, 3, or 4 and n is 2 or 4. However, when m is 0, n is 2 or 4, and when m is 0 and n is 2, then $X^1$ is not $R_a$, $R_b$, or $R_aSe$. Preferably, m is 2 and n is 2 or 4. More preferably, m is 0 and n is 2. Even more preferably, m is 0, n is 2 and X is a 1,1-dithio containing anionic ligand such as $S(C{=}S)N(R_a)(R_b)$, $S(C{=}S)OR_a$, $S(C{=}S)SR_a$, $S(P{=}S)(OR_a)(OR_b)$, $S(P{=}S)(R_a)(R_b)$.

In Structure II, M represents Pd, Pt, or Cu. $X^2$ represents a halo (chloro, bromo, or iodo), CN, SCN, SeCN, TeCN, $N_3$, $BF_4$, $ClO_4$, $BPh_4$, $PF_6$, $NO_3$, $SO_3CF_3$, $O(C{=}O)CF_3$, $S(C{=}S)N(R_a)(R_b)$, $S(C{=}S)OR_a$, $S(C{=}S)SR_a$, $S(P{=}S)(OR_a)(OR_b)$, $S(P{=}S)(R_a)(R_b)$, $SR_a$, $SeR_a$, $TeR_aOR_a$, alkyl (as defined above for $R_a$ and $R_b$), aryl (as defined above for Ar), or $O_2CR_a$ group in which $R_a$ and $R_b$ are as defined above. Preferably, $X^2$ represents a halo, SCN, or SeCN group. More preferably, $X^2$ represents a chloro, bromo, or SCN group. The multiple $X^2$ groups in Structure II compounds can be the same or different groups.

L' represents a neutral ligand with a Group 15 atom (that is, N, P, As, Sb, or Bi) or a Group 16 atom (that is, S, Se, Te). Useful neutral ligands incorporating Group 15 atoms include pyridine, bipyridine, thiourea, substituted thioureas, selenourea, substituted selenoureas, and organophosphines such as $P(R_a)(R_b)(R_c)$. L' also includes ligands of the type $E(R_a)(R_b)(R_c)$ where E represents N, As, Sb, Bi, and $R_a$ and $R_b$ are as defined above, and $R_c$ is alkyl or aryl as defined above for $R_a$ and $R_b$. L' also includes chalcogen ligands of the type $E'{=}P(R_a)(R_b)(R_c)$ where E' represents S, Se, and Te and $R_a$, $R_b$, and $R_c$ are as defined above. However, at least one of L' or $X^2$ must contain a selenium atom.

Examples of ligands of the type $E{=}P(R_a)(R_b)(R_c)$ include, for example, $S{=}P(C_6H_5)_3$, $Se{=}P(C_6H_5)_3$, $Te{=}P(i\text{-}C_3H_7)_3$, $Se{=}P(C_6H_{11})_3$, $Se{=}P(p\text{-}CF_3{-}C_6H_4)_3$, $Se{=}P(p\text{-}CH_3O{-}C_6H_4)_3$, and $Se{=}P(C_6F_5)(C_6H_5)_2$. Suitable phosphine tellurides have been described in, R. A. Zingaro et al., *J. Organometal. Chem.*, 1965, 4, 320. Suitable organophosphine sulfides and selenides have been described in J. A. Miller, *Organophosphorus Chem.*, 1976, 4, 66–77 and in T. S. Lobana, *Organophosphorus Compd.*, Vol. 4, pp. 409–566, Wiley, NY, 1996.

Also in Structure II, when M represents Pd(2+) or Pt(2+), r is 2 and s is 1, 2, 3, or 4. When M represents Cu(1+), r is 1 and s is 1, 2, 3, or 4.

In Structure III, Z represents a monovalent cation such as $Li^+$, $Na^+$, $K^+$, $Rb^+$, $Cs^+$, $(R_a)_4N^+$, $(R_a)_4P^+$, $[P(R_a)_3]_2N^+$, M' represents Fe, Ru, Os, Co, Rh, or Ir, x is an integer of from 1 to 6, y is an integer of from 1 through 6, z is an integer of from 6 through 20, w is an integer inclusive of 0 through 4 and represents the number of Z groups necessary to neutralize the electronic charge on the rest of the molecule, and $R_a$ is as defined above.

In a preferred embodiment of Structure I compounds, when m is 0 and n is 2 or 4, the compounds represented by Structure I can be further represented by Structure I-a, (I-a)

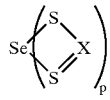

In Structure I-a, X represents the same or different $COR_a$, $CSR_a$, $CN(R_a)(R_b)$, $CR_a$, $P(R_a)(R_b)$ or $P(OR_a)(OR_b)$ group that is attached to the two sulfur atoms through the noted carbon or phosphorus atom in the groups. Preferably, X represents the same or different $COR_a$, $CSR_a$ or $CN(R_a)(R_b)$, $P(R_a)(R_b)$ or $P(OR_a)(OR_b)$ group. Also in Structure I-a, p is 2 or 4, and preferably it is 2. Thus, when p is 2 (as noted below), there can be 2 of the same or 2 different X groups. When p is 4, there can be 4 of the same X groups, or 2, 3, or 4 different X groups in the molecule.

Unless otherwise noted, the multiple $R_a$ and $R_b$ groups in the Structure III compounds can be the same or different groups. However, in some embodiments, when p is 2, X cannot be two identical $CN(R_a)(R_b)$ groups.

In Structures I and II, preferred thiourea ligands are derived from compounds represented below by Structures IV, V, or VI:

(IV)

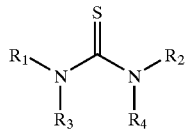

(V)

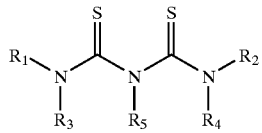

(VI)

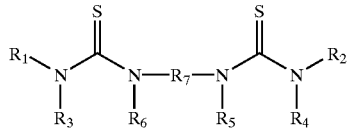

In Structure IV, $R_1$, $R_2$, $R_3$, and $R_4$ independently represent hydrogen, substituted or unsubstituted alkyl groups (including alkylenearyl groups such as benzyl), substituted or unsubstituted alyl groups (including arylenealkyl groups), substituted or unsubstituted cycloalkyl groups, substituted or unsubstituted alkenyl groups, substituted or unsubstituted alkynyl groups and heterocyclic groups.

Useful alkyl groups are branched or linear and can have from 1 to 20 carbon atoms (preferably having 1 to 5 carbon atoms), useful aryl groups can have from 6 to 14 carbon atoms in the carbocyclic ring, useful cycloalkyl groups can have from 5 to 14 carbon atoms in the central ring system, useful alkenyl and alkynyl groups can be branched or linear and have 2 to 20 carbon atoms, and useful heterocyclic groups can have 5 to 10 carbon, oxygen, sulfur and nitrogen atoms in the central ring system (they can also have fused rings).

These various monovalent groups can be further substituted with one or more groups including but not limited to, halo groups, alkoxycarbonyl groups, hydroxy groups, alkoxy groups, cyano groups, acyl groups, acyloxy groups, carbonyloxy ester groups, sulfonic acid ester groups, alkylthio groups, dialkylamino groups, carboxy groups, sulfo groups, phosphono groups, and any other group readily apparent to one skilled in the art. $R_1$, $R_2$, $R_3$, and $R_4$ can independently be alkyl groups.

Alternatively, $R_1$ and $R_3$ taken together, $R_2$ and $R_4$ taken together, $R_1$ and $R_2$ taken together, or $R_3$ and $R_4$ taken together, can form a substituted or unsubstituted 5- to 7-membered heterocyclic ring.

Where $R_1$ and $R_3$ are taken together or $R_2$ and $R_4$ are taken together, the heterocyclic rings can be saturated or unsaturated and can contain oxygen, nitrogen or sulfur atoms in addition to carbon atoms. Useful rings of this type include, but are not limited to, imidazole, pyrroline, pyrrolidine, thiohydantoin, pyridone, morpholine, piperazine and thiomorpholine rings. These rings can be substituted with one or more alkyl groups (having 1 to 5 carbon atoms), aryl groups (having 6 to 10 carbon atoms in the central ring system), cycloalkyl groups (having 5 to 10 carbon atoms in the central ring system), alkoxy groups, carbonyloxyester groups, halo groups, cyano groups, hydroxy groups, acyl groups, alkoxycarbonyl groups, sulfonic ester groups, alkylthio groups, carbonyl groups, carboxy groups, sulfo groups, phosphono groups, and other groups readily apparent to one skilled in the art.

Where $R_1$ and $R_2$ are taken together or $R_3$ and $R_4$ are taken together, the heterocyclic rings can be saturated or unsaturated and can contain oxygen, nitrogen or sulfur atoms in addition to carbon atoms. Useful rings of this type include, but are not limited to, 2-imidazolidinethione, 2-thioxo-1-imidazolidinone (thiohydantoin), 1,3-dihydro-2H-imidazole-2-thione, 1,3-dihydro-2H-benzimidazole-2-thione, tetrahydro-2,2-thioxo-5-pyrimidine, tetrahydro-1,3,5,-triazine-2(1H)-thione, dihydro-2-thioxo-4,6-(1H,3H)-pyrimidinedione, dihydro-1,3,5-triazine-2,4-(1H,3H)-dione and hexahydrodiazepine-2-thione rings. These rings can be substituted with one or more alkyl groups (having 1 to 5 carbon atoms), aryl groups (having 6 to 10 carbon atoms in the central ring system), cycloalkyl groups (having 5 to 10 carbon atoms in the central ring system), carbonyloxyester groups, halo groups, cyano groups, hydroxy groups, acyl groups, alkoxycarbonyl groups, sulfonic ester groups, alkylthio groups, carbonyl groups, alkoxy groups, carboxy groups, sulfo groups, phosphono groups, and other groups readily apparent to one skilled in the art.

Preferably, $R_1$, $R_2$, $R_3$, and $R_4$ independently represent hydrogen, alkyl, alkenyl, alkynyl, aryl, and heterocyclic groups, more preferably hydrogen, alkyl, aryl, and alkenyl groups, and most preferably alkenyl groups. A preferred alkenyl group is an allyl group. A preferred alkyl group is a methyl group.

In Structure V noted above, $R_1$, $R_2$, $R_3$, $R_4$ and $R_5$ have the same definitions as noted above for $R_1$, $R_2$, $R_3$ and $R_4$ in Structure IV with the following differences:

$R_1$ and $R_3$ can be taken together, $R_2$ and $R_4$ can be taken together, $R_3$ and $R_5$ can be taken together and/or $R_4$ and $R_5$ can be taken together, to form substituted or unsubstituted 5- to 7-membered heterocyclic rings (as described above for Structure IV). When those heterocyclic rings are formed from $R_1$ and $R_3$ taken together or $R_2$ and $R_4$ taken together, they are as defined above for $R_1$ and $R_3$ taken together for Structure IV, but the resulting heterocyclic rings can have other substituents such as alkoxy groups, dialkylamino groups, and carboxy, sulfo, phosphono and other acidic groups. When those heterocyclic rings are formed from $R_3$ and $R_5$ taken together or $R_4$ and $R_5$ taken together, they can be substituted as described for $R_1$ and $R_3$ of Structure IV Useful rings of this type include, but are not limited to, 2-imidazolidinethione, 2-thioxo-1-imidazolidinone (thiohydantoin), 1,3-dihydro-2H-imidazole-2-thione, 1,3-dihydro-2H-benzimidazole-2-thione, tetrahydro-2,2-thioxo-5-pyrimidine, tetrahydro-1,3,5,-triazine-2(1H)-thione, dihydro-2-thioxo-4,6-(1H,3H)-pyrimidinedione, dihydro-1,3,5-triazine-2,4-(1H,3H)-dione and hexahydrodiazepine-2-thione rings.

For Structure V, the preferred groups for $R_1$–$R_5$ are hydrogen, alkyl, alkenyl, alkynyl, aryl, and heterocyclic groups, more preferably alkyl, aryl, and alkenyl groups, and more preferably alkenyl groups. A preferred alkenyl group is an allyl group.

Also in Structure V, most preferable alkyl groups are methyl and ethyl groups. Most preferable aryl groups are phenyl or tolyl groups. Most preferable cycloalkyl groups are cyclopentyl and cyclohexyl groups. Most preferably the alkenyl group is an allyl group. Most preferable heterocyclic groups are morpholino and piperazino groups.

In Structure VI noted above, $R_1$, $R_2$, $R_3$, $R_4$, $R_5$, and $R_6$ have the same definitions as noted above for $R_1$, $R_2$, $R_3$, $R_4$, and $R_6$ in Structure V described above. In addition, $R_3$ and $R_5$ taken together, $R_4$ and $R_5$ taken together, $R_1$ and $R_3$ taken together, $R_2$ and $R_4$ taken together, or $R_5$ and $R_6$ taken together, can form a substituted or unsubstituted 5- to 7-membered heterocyclic ring as described above for the heterocyclic rings in Structure V.

$R_7$ is a divalent aliphatic or alicyclic linking group including but not limited to substituted or unsubstituted alkylene groups having 1 to 12 carbon atoms, substituted or unsubstituted cycloalkylene groups having 5 to 8 carbon atoms in the ring structure, substituted or unsubstituted arylene groups having 6 to 10 carbon atoms in the ring structure, substituted or unsubstituted divalent heterocyclyl groups having 5 to 10 carbon, nitrogen, oxygen, and sulfur atoms in the ring structure, or any combination of two or more of these divalent groups, or any two or more of these groups connected by ether, thioether, carbonyl, carbonamido, sulfoamido, amino, imido, thiocarbonyl, thioamido, sulfinyl, sulfonyl, or phosphinyl groups. Preferably, $R_7$ is a substituted or unsubstituted alkylene group having at least 2 carbon atoms.

Further details of these preferred thiourea ligands are provided in copending and commonly assigned U.S. Ser. No. 09/667,748 filed Sep. 21, 2000 by Lynch, Simpson, Shor, Willett, and Zou, incorporated herein by reference. Most preferably, the thiourea compounds are substituted with the same aliphatic substituent.

Representative selenium chemical sensitizers of Structures I, II, or III include, but are not limited to, the following compounds. It is to be understood that in coordination compounds, the exact chemical structures may not be known. The structures shown below are representative of the stoichiometry of the selenium compounds.

I-1
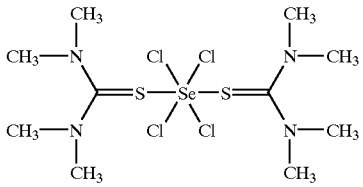
I-2
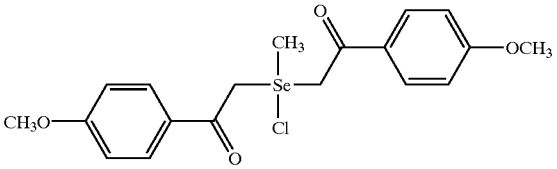
I-3
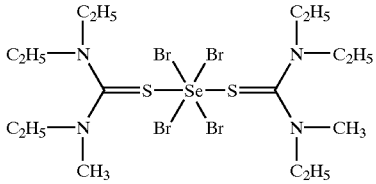
I-4
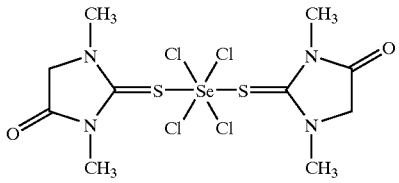
I-5
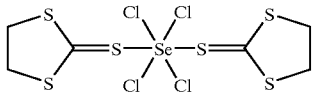
I-6
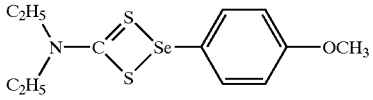
I-7
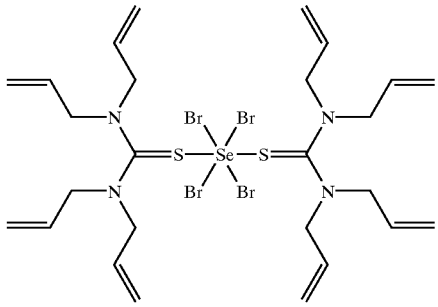
I-8
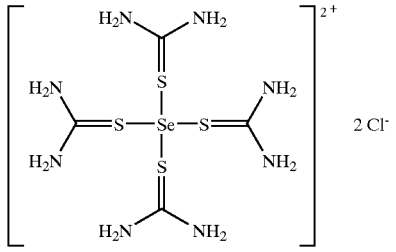
-continued
I-9
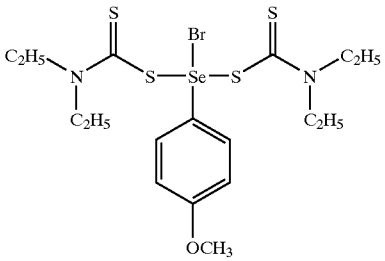
I-10
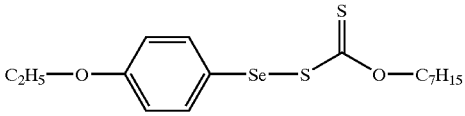
I-11
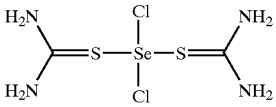
I-12
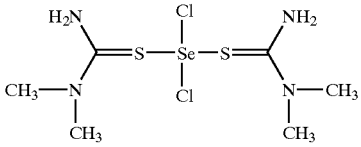
I-13
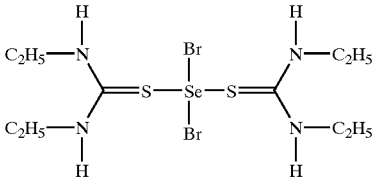
I-14
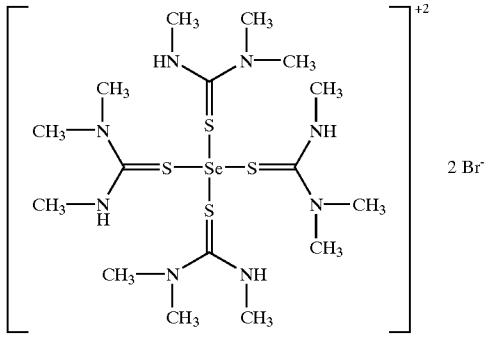
I-15
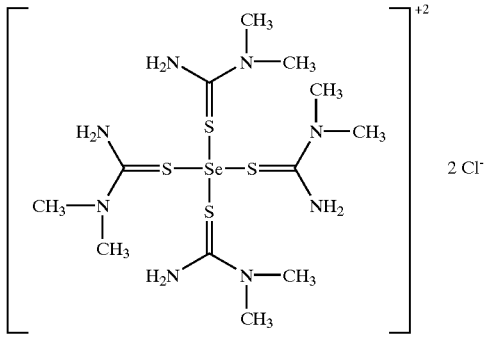

-continued
I-16
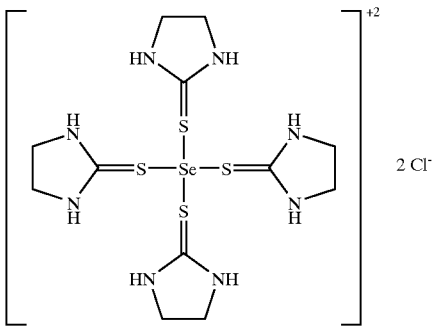
I-17
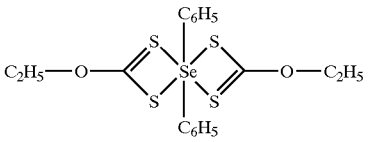
I-18
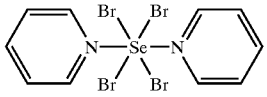
I-19
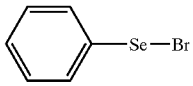
I-20
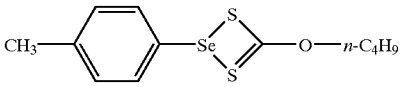
I-21
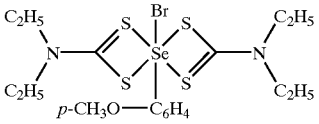
I-22
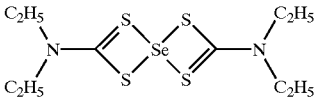
I-23
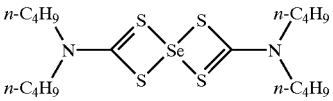
I-24
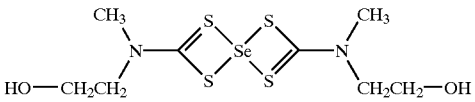
I-25
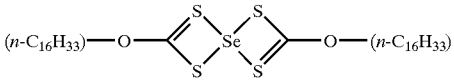
I-26
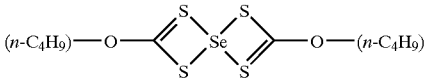
I-27
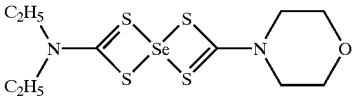
-continued
I-28
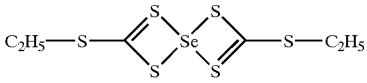
I-29
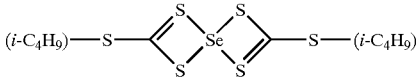
I-30
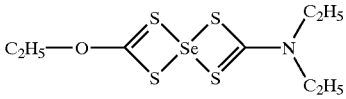
I-31
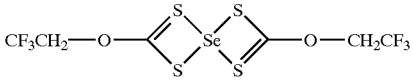
I-32
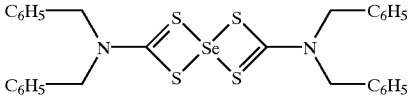
I-33
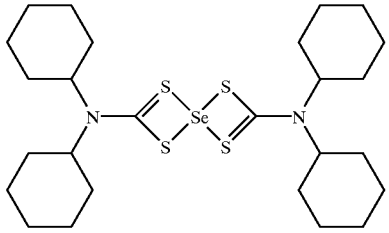
I-34
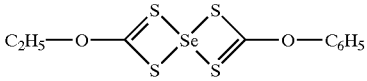
I-35
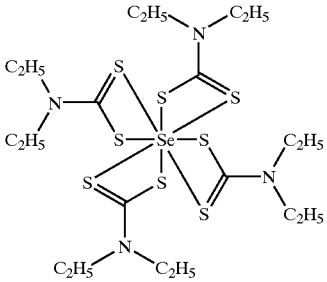
I-36
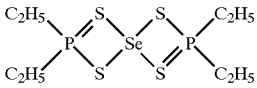
I-37
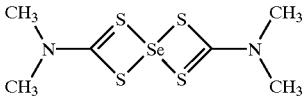
I-38
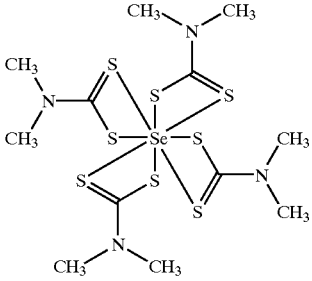

-continued
I-39
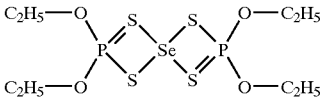
I-40
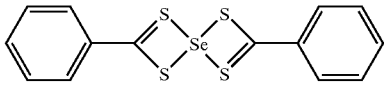
I-41
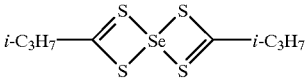
I-42
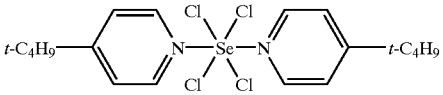
I-43
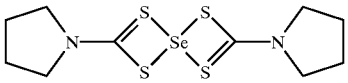
I-44
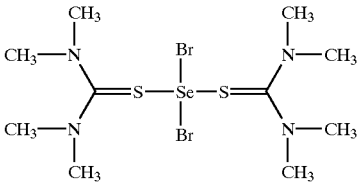
I-45
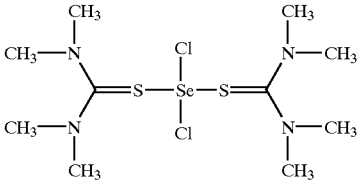
I-46
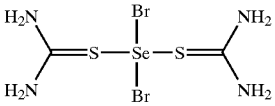
I-47
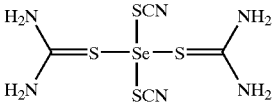
I-48
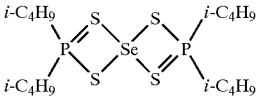
I-49
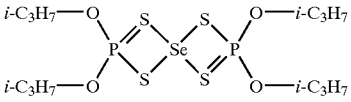
I-50
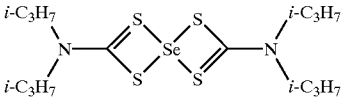
I-51
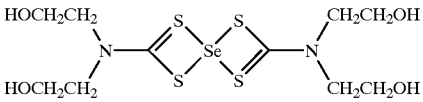
-continued
I-52
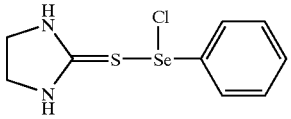
I-53
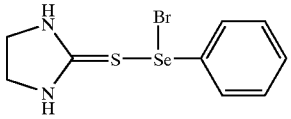
I-54
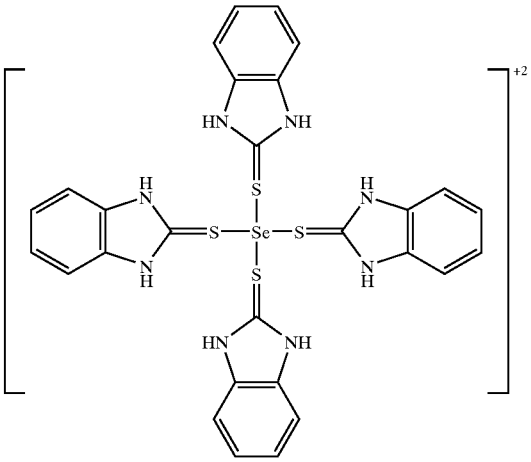
I-55
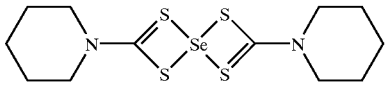
I-56
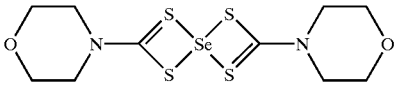
I-57
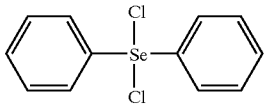
I-58
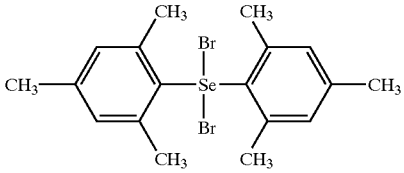
| | |
|---|---|
| $Pd[Se(p\text{-anisyl})_2]_2Br_2$ | II-1 |
| $Pd[Se(mesityl)_2]_2Cl_2$ | II-2 |
| $Pd\{Se[CH_2Si(CH_3)_3]_2\}_2(SCN)_2$ | II-3 |
| $Pd[P(p\text{-}CH_3O—C_6H_4)_3]_2[SeCN]_2$ | II-4 |
| $Pd[P(C_6H_5)_3]_2[SeCN]_2$ | II-5 |
| $Cu[P(p\text{-}CH_3O—C_6H_4)_3]_3SeCN$ | II-6 |
| $Pt[Se(p\text{-}CH_3—C_6H_4)_2]_2[SeC_6H_5]_2$ | II-7 |
| $Pt[P(p\text{-}CH_3O—C_6H_4)_3]_2[SeCN]_2$ | II-8 |
| $[Pt\{Se{=}C(NH_2)(NMe_2)\}_4]Br_2$ | II-9 |

| | |
|---|---|
| $Cu[P(C_6H_5)_3]_2SeCN$ | II-10 |
| $Cu[P(C_6H_5)_3]_3SeCN$ | II-11 |
| $Cu[Se(Mesityl)_2]_2Br$ | II-12 |
| $Cu[(C_6H_5)_2PCH_2CH_2P(C_6H_5)_2]SeCN$ | II-13 |
| $Cu[Se(CH_2—C_6H_5)_2]_3SeCN$ | II-14 |
| $Cu[P(p\text{-}CH_3—C_6H_4)_3]_2SeC_6H_5$ | II-15 |
| $Cu\{CH_3C[CH_2P(C_6H_5)_2]_3\}SeCN$ | II-16 |
| $[Cu\{Se{=}C(NH_2)(NMe_2)\}_3]BF_4$ | II-17 |
| $Cu[Se(C_6H_5)_2]_3SeCN$ | II-18 |
| $Pd[As(C_6H_5)_3]_2(SeCN)_2$ | II-19 |
| $Pd(C_5H_4N)_2(SeCN)_2$ | II-20 |
| $Pt[Sb(p\text{-}CH_3—C_6H_4)_3]_2(SeCN)_2$ | II-21 |
| $Cu[Se(2—C_5H_4N)_2](SeC_6H_5)$ | II-22 |
| $Cu[P(p\text{-}CH_3—C_6H_4)_3]_2SeCN$ | II-23 |
| $Cu[Se(C_6H_5)_2]_3SeC_6H_5$ | II-24 |
| $Pd[(CH_3)_2N(Se{=}C)NE_2]_2(SeCN)_2$ | II-25 |
| $Cu[P(C_6H_5)_3]SeCN$ | II-26 |
| $Cu[Se(C_6H_5)_2]_4BF_4$ | II-27 |
| $Pt[Se(C_6H_5)_2]_2(SeCN)_2$ | II-28 |
| $Pt[Se(C_6H_5)_2]_4(PF_6)_2$ | II-29 |
| $Pt[H_2N(Se{=}C)NH_2]_4(BF_4)_2$ | II-30 |
| $Pt[CH_3C(CH_2P(C_6H_5)_2]_3(SeCN)(PF_6)$ | II-31 |
| $Pd[Se(C_6H_5)_2]_3(SeC_6H_5)(BF_4)$ | II-32 |
| $Fe_3(\mu_3\text{-}Se)_2(CO)_9$ | III-1 |
| $Fe_4Se_4(CO)_{12}$ | III-2 |
| $Ru_3Se_2(CO)_9$ | III-3 |
| $RuCo_2Se(CO)_9$ | III-4 |
| $Os_3Se_2(CO)_9$ | III-5 |
| $Ru_4Se_4(CO)_{12}$ | III-6 |
| $[(CH_3)_4N][Rh_3Se_2(CO)_6]$ | III-7 |

The selenium chemical sensitizers described herein by Structures I, II, and III can be used individually or in mixtures. They can be present in one or more imaging layer(s) on the front side of the photothermographic material. Preferably, they are in every layer that contains the photocatalyst (for example, photosensitive silver halide). The total amount of such compounds in the material will generally vary depending upon the average size of silver halide grains. The total amount is generally at least $10^{-7}$ mole per mole of total silver, and preferably from about $10^{-5}$ to about $10^{-2}$ mole per mole of total silver for silver halide grains having an average size of from about 0.01 to about 2 $\mu$m. The upper limit can vary depending upon the compound used, the level of silver halide and the average grain size, and it would be readily determinable by one of ordinary skill in the art.

The selenium chemical sensitizers useful in the present invention can be prepared using readily available starting materials and known procedures as well as the procedures detailed in the Synthetic Examples below. The Se(2+) coordination complexes with thiourea and substituted thiourea ligands (for example, $[Se(L)_2(X^1)_2]$ and $[Se(L)_4](X^1)_2$, where $X^1$ is Cl or Br, and L is a thiourea or a substituted thiourea ligand) can be most conveniently prepared by reacting a solution of a Se(4+) compound, typically a salt of $[Se(X')_6]^{2-}$, with a thiourea ligand in an appropriate stoichiometry to give the di- or tetra-thiourea-selenium product. In these reactions the thiourea derivative functions both as the reducing agent for the Se(4+) to Se(2+) reduction, as well as a stabilizing ligand for the Se(2+) product.

Once prepared, compounds such as, for example, [Se(thiourea)$_2$Cl$_2$], can be used to prepare a wide variety of related derivatives such as, for example, $[Se(thiourea)_2(X^1)_2]$ (where $X^1$ is an anionic ligand such as a pseudohalide) by substitution reactions using an appropriate salt of the anion $(X^1)^-$ for example, K[SCN]. Examples of such syntheses can be found in S. V. Bjørnevåg and S. Hauge, *Acta. Chem. Scand.*, 1983, 37*A*, 235–240, S. Hauge and M. Tysseland, *Acta Chem. Scand.* 1971, 25, 3072–3080, O Vikane, *Acta Chem. Scand.*, 1975, 29*A*, 763–770, O. Vikane, *Acta Chem. Scand.*, 1975, 29*A*, 787–793, S. Sowrirajan, G. Aravamudan, M. Seshasayee, and G. C. Rout, *Acta Cryst.*, 1985, 41*C*, 576–579, K. J. Wynne, P. S. Pearson, M. G. Newton, and J. Golen, *Inorg. Chem.*, 1972, 11, 1192–1196.

Selenium(2+) complexes of the type Se(thiourea)(Aryl)$X^1$, where $X^1$ is, for example, Cl, Br, I, or SCN can be prepared by reaction of a diaryldiselenide with a thiourea and halogen (for example, $Cl_2$ or $Br_2$). These reactions are typically carried out in methanol. When such reactions are carried out using excess thiourea, derivatives of the type Se(thiourea)$_2$(Aryl)Cl can be prepared. Synthetic procedures for such mixed organometallic complexes have been described in the literature. Examples of such syntheses can be found in, for example, S. Hauge, Ø. Johnnesen, and O. Vikane, *Acta Chem. Scand.*, 1978, 32*A*, 901, O. Vikane, *Acta Chem. Scand.*, 1975, 29*A*, 763, O. Vikane, *Acta Chem. Scand.*, 1975, 29*A*, 787, and O. Vikane, *Acta Chem. Scand.*, 1975, 29*A*, 150.

Selenium(2+) coordination complexes with 1,1-dithio ligands such as, for example those described in Structure I-a where p is 2, and X is, for example, $CN(R_a)_2$, $COR_a$, $P(R_a)_2$, $P(OR_a)_2$, or $C(R_a)$ can be prepared by the addition of 2 equivalents of a water soluble salt of the 1,1-dithio anion (typically an alkali metal or ammonium salt, for example, $Na[S_2X]$) to an aqueous solution of the labile Se(2+) thiosulfate complex, $Na_2[Se(S_2O_3)_2].3H_2O$ (prepared as described in O. Foss, *Inorganic Syntheses*, 1953, 4, 88). The products, of such substitution reactions, $[Se(S_2X)_2]$, readily precipitate from the aqueous reaction solution, and after isolation by filtration, washing well with water, and vacuum or air drying, they can be recrystallized from organic solvents. Typical procedures for preparing such $[Se(S_2X)_2]$ type complexes have been reported in the literature. Compounds such as $[Se(S_2CNEt_2)_2]$, $[Se(S_2CNMe_2)_2]$, $[Se(S_2COMe)_2]$, and $[Se(S_2COEt)_2]$ have been prepared as described in O. Foss, *Inorganic Syntheses, 1953, 4, 91–93*. $[Se\{S_2CN(CH_2)_4O\}_2]$ has been prepared as described in O. P. Anderson and S. Husebye, *Acta Chem. Scand.*, 1970, 24, 3141. $[Se\{S_2P(OMe)_2\}_2]$, $[Se\{S_2P(OEt)_2\}_2]$, and $[Se\{S_2PEt_2\}_2]$ have been prepared as described in S. Husebye, *Acta Chem. Scand.*, 1965, 19, 1045.

Complexes of this type can be prepared more conveniently in a 1-step procedure in which the labile Se(2+)

thiosulfate complex, $Na_2[Se(S_2O_3)_2]$ is prepared in-situ at low temperature (typically −5° C. to 0° C.) and immediately reacted with 2 equivalents of the appropriate 1,1-dithio salt. Synthetic Examples 1 and 2 detail the use of this synthetic procedure to prepare $[Se(S_2CNEt_2)_2]$ and $[Se\{S_2P(OEt)_2\}_2]$. The analogous Se(2+) complex with the 1,3-dithio ligand, $[Ph_2P(S)NP(S)Ph_2](1-)$ (that is, $[Se\{Ph_2P(S)NP(S)Ph_2—S,S'\}_2]$) can be prepared by reaction of $[Se\{S_2P(OEt)_2\}_2]$ with 2 equivalents of $NH_4[Ph_2P(S)NP(S)Ph_2]$ in methanol solution as described in S. Husebye and K. Martmann-Moe, *Acta. Chem. Scand.*, 1983, 37*A*, 219–225.

SYNTHETIC EXAMPLE 1

Synthesis of $[Se(S_2CNEt_2)_2]$: $SeO_2$ (2.77 g, 25 mmol) was dissolved, with heating, in a solution of 4 ml of water and 18 ml of glacial acetic acid. After complete dissolution of the solid, the resulting pale yellow solution was cooled to −5° C. in an ice-salt bath and a solution of 20.96 g 25 (84.5 mmol) of $Na_2S_2O_3.5H_2O$ in 7 ml of water was slowly added with stirring (keeping the solution temperature below −5° C.). After complete addition of the $Na_2S_2O_3$ solution, 150 ml more of the cold $H_2O$-glacial acetic acid solution was added. To the resulting solution (T=−5° C.), in an ice-salt bath, a solution of $NaS_2CNEt_2.3H_2O$ (12.17 g, 55 mmol) in 250 ml water was added dropwise. After complete addition of the sodium diethyldithiocarbamate solution, the resulting reaction solution was diluted to 1 liter with water, stirred 15 minutes more at room temperature, and filtered. The isolated orange precipitate was washed well with water and air dried to give 8.5 g of a yellow powder. The crude product was recrystallized from 75 ml of hot toluene to give, on cooling for 12 hours at −10° C., a crop of yellow orange flakes [6.9g (73.5%)], m.p.=104° C. (gives clear, bright red melt).

Analysis: Calcd (Found) for $C_{10}H_{20}N_2S_4Se$ (MW=375.48), C, 31.99 (32.1), H, 5.37 (5.5), N, 7.46 (7.4), S, 34.16 (33.9).

SYNTHETIC EXAMPLE 2

Synthesis of $[Se(S_2P(OEt)_2)_2]$: $SeO_2$ (2.77 g, 25 mmol) was dissolved, with heating, in a solution of 4 ml of water and 18 ml of glacial acetic acid. After complete dissolution of the solid, the resulting pale yellow solution was cooled to −5° C. in an ice-salt bath and a solution of 20.96 g (84.5 mmol) of $Na_2S_2O_3.5H_2O$ in 7 ml of water was slowly added with stirring while keeping the solution temperature below −5° C. After complete addition of the $Na_2S_2O_3$ solution, an additional 150 ml of cold $H_2O$-glacial acetic acid solution (27 ml of $H_2O$ and 123 ml of glacial acetic acid) was added. To the resulting solution, maintained at −5° C. in an ice-salt bath, a solution of $NH_4[S_2P(OEt)_2]$ (11.18 g, 55 mmol) in 225 ml water was added dropwise. After complete addition of the ammonium diethyldithiophosphate solution, the resulting reaction solution was diluted to 1 liter with water, stirred 15 minutes at room temperature, and filtered. The isolated pale peach-colored precipitate was washed well with water and air dried to afford 7.5 g. The crude product was recrystallized from 225 ml of hot ethanol and cooled for 12 hours at −10° C. to give 6.3 g (73.5%) of $[Se(S_2P(OEt)_2)_2]$ as yellow needles, m.p.=71° C. (gives clear orange melt).

Analysis: Calcd (Found) for $C_8H_{20}O_4P_2S_4Se$ (MW=449.39), C, 21.38 (21.34), H, 4.49 (4.32), S, 28.54 (28.75).

Preparation of Compounds of Type $Se(R_a)_2$ and $Se(R_a)_2(X^1)_2$

Organoselenium compounds of the type $Se(R_a)_2$ and $Se(R_a)_2(X^1)_2$ (where $X^1$ is a halide such as Cl, Br, I, or a pseudohalide such as OCN, SCN, SeCN, TeCN, or $N_3$, and $R_a$ is alkyl or aryl) can be used to prepare compounds represented by Structures I and II. They can be prepared by methods known in the art and described, for example, in *Organic Selenium Compounds: Their Chemistry and Biology*, D. L. Klayman and W. H. H. Günther, Eds., Wiley, New York, 1973, *Organoselenium Chemistry*, D. Liotta, Ed., Wiley, New York, 1987, *The Chemistry of Organic Selenium and Tellurium Compounds*, S. Patai and Z. Rappoport, Eds., Vol 1 (1986) and Vol. 2 (1987), Wiley, New York, C. Paulmier, *Selenium Reagents and Intermediates in Organic Synthesis*, Pergamon Press, Oxford, 1988, and A. Krief and L. Hevesi, *Organoselenium Chemistry*, Springer, Berlin, 1988.

An improved method for the synthesis of compounds of the type $Se(R_a)_2$ (where $R_a$ is alkyl or aryl) is by reaction of $[Se(S_2CNEt_2)_2]$ (prepared as described above), with 2 equivalents of a Grignard or organolithium reagent in an ether solvent such as tetrahydrofuran:

$$Se(S_2CNEt_2)_2+2RMgBr(\text{or } R_aLi)\rightarrow Se(R_a)_2+2MgBr(S_2CNEt_2) \quad (1)$$

This procedure has the advantage of using a readily prepared and air stable Se(2+) compound as a convenient synthon for the unstable "$SeCl_2$".

In the synthetic route described in (1), $[Se(S_2CNEt_2)_2]$ can be weighed under ambient conditions and placed in a Schlenk reaction flask. After replacement of the air in the flask with argon using a double manifold, addition of tetrahydrofuran is followed by addition of two equivalents of the Grignard or lithium reagent using a metal cannula. Refluxing the reaction solution for about 30 minutes is followed by allowing the solution to cool to room temperature. Because the $Se(R_a)_2$ formed is stable in air, (note: the only air sensitive reagents used in this synthetic method are the Grignard or lithium reagent), the product can be worked-up and isolated in air.

SYNTHETIC EXAMPLE 3

Synthesis of $[Se(Mesityl)_2]$: To a solution of $[Se(S_2CNEt_2)_2]$ (3.75 g, 10 mmol) dissolved in 200 ml dry, deaerated tetrahydrofuran was added, via a metal cannula, 23 ml of a 1 M solution of mesityl magnesium bromide in tetrahydrofuran. The initial clear pale orange solution was immediately decolorized on addition of the Grignard reagent. The reaction solution was refluxed under an inert atmosphere for 30 min. After cooling to room temperature, the reaction solution, was poured into 300 ml of a 0.1 M aqueous solution of $NH_4Cl$ and this solution was extracted with 3×225 ml portions of methylene chloride. The combined methylene chloride extracts were dried over anhydrous $MgSO_4$. Filtration and solvent removal on a rotary evaporator gave a yellow oil. Upon addition of 50 ml of ethanol to this oil and brief cooling to −78° C., a heavy white solid precipitated. The solid was isolated by filtration, washed with cold ethanol, and vacuum dried to give 1.82 g of crude product. Recrystallization of this material from 75 ml of hot ethanol gave, on cooling at −5° C., a crop of white needles (1.05 g, 33.1%, m.p.=83° C. (gives a clear colorless melt)).

Analysis: Calcd. (Found) for $C_{18}H_{22}Se$ (MW=317.33, m/z=318), C, 68.13 (68.01), H, 6.99 (6.84), Se, 24.88 (24.61).

This compound was used in the preparation of $Pd^{2+}$ and $Pt^{2+}$ Complexes described below.

Preparation of $Pd^{2+}$ and $Pt^{2+}$ Complexes $Pd^{2+}$ and $Pt^{2+}$ complexes with selenium-containing ligands (for example, Structure II) of this invention can be prepared using the synthetic schemes shown below in Equations (2) through (8). In these schemes, M represents Pd or Pt, $R_a$ represents an alkyl or aryl group as defined above, and L' represents a neutral ligand with a Group 15 donor atom as defined above (for example, $ER_3$, where E is N, P, As, Sb, or Bi) or a Group 16 donor atom (for example, $ER_2$, where E is S, Se, Te, or $Se{=}P(R_a)(R_b)(R_c)$, or selenourea or a substituted selenourea), s is 2 to 4, and E'=S, Se:

$$K_2[MCl_4]+2Se(R_a)_2 \rightarrow [M(Se(R_a)_2)_2Cl_2]+2KCl \quad (2)$$

$$K_2[MBr_4]+2Se(R_a)_2 \rightarrow [M(Se(R_a)_2)_2Br_2]+2KBr \quad (3)$$

$$[M(NCPh)_2Cl_2]+2Se(R_a)_2 \rightarrow [M(Se(R_a)_2)_2Cl_2]+2PhCN \quad (4)$$

$$K_2[M(E'CN)_4]+2Se(R_a)_2 \rightarrow [M(E'CN)_2(Se(R_a)_2)_2]+2KE'CN \quad (5)$$

$$[ML'_2Cl_2]+2M'[SeR_a] \rightarrow [ML'_2(SeR_a)_2]+2(M'Cl) \quad (6)$$

$$[ML'_2Cl_2]+2M'[SeCN] \rightarrow [ML'2(SeCN)_2]+2(M'Cl) \quad (7)$$

$$[ML'_s]+R_aSeSeR_a \rightarrow [M(L')_2(SeR_a)_2]+(s-2)L' \quad (8).$$

In synthetic schemes (2) and (3) above, $K_2[M(X^2)_4]$ (where $X^2$ is Cl or Br) is dissolved in water and a solution of the diorganoselenium compound dissolved in an organic solvent such as methanol, ethanol, or acetone is then added. The electronically neutral product complex precipitates from the reaction solution, generally in less than 60 minutes. It can then be isolated by filtration, washed well with water, vacuum dried, and recrystallized from an appropriate organic solvent. An example of the synthesis of a typical metal complex of this type is shown below for $[Pd(SeCN)_2\{P(p\text{-anisyl})_3\}_2]$.

Syntheses illustrated by Equation (5) are typically carried out by dissolving the thio- or selenocyanate complex of Pd or Pt in methanol and adding the diorganoselenide as a solution in methanol or acetone.

Syntheses illustrated by Equations (4), (6), (7), and (8) are typically carried out in organic solvents such as methylene chloride, chloroform, tetrahydrofuran, acetonitrile, or acetone by procedures known to those skilled in the art. Detailed descriptions for carrying out such reactions for the synthesis of useful selenium-containing complexes of Pd and Pt can be found in literature references such as: S. G. Murray and F. R. Hartley, *Chem. Rev.*, 1981, 81, 365, Coordination Chemistry of Thioethers, Selenoethers, and Telluroethers in Transition-Metal Complexes, E. W. Abel, S. K. Bhargava, and K. G. Orrell, Progress in Inorganic Chemistry, Vol. 32, pp. 1–111(1984): The Stereochemistry of Metal Complexes of Sulfur-, Selenium-, and Tellurium-Containing Ligands, E. G. Hope and W. Levason, Coord. *Chem. Rev.*, 1993, 122, 109–170, Recent Developments in the Coordination Chemistry of Selenoether and Telluroether Ligand, H. J. Gysling, Ligand Properties of Organic Selenium and Tellurium Compounds in *The Chemistry of Organic Selenium and Tellurium Compounds*, Vol. 1, S. Patai and Z. Rappoport, Wiley, New York, 1986, and in W. Levason, S. D. Orchard, and G. Reid, *Inorg. Chem.*, 2000, 39, 3853.

SYNTHETIC EXAMPLE 3

Synthesis of $[Pd(SeCN)_2\{P(p\text{-anisyl})_3\}_2]$: A suspension of $PdCl_2$ (0.8867 g, 5 mmole) and KSeCN (1.44 g, 10 mmole) in 225 ml of methanol was stirred at room temperature for 30 min and filtered through a medium porosity glass filter frit into a receiver flask cooled to −5° C. in ice-salt bath. To the resulting dark red filtrate was added a solution of $P(p\text{-anisyl})_3$ (5.5237 g, 10 mmol) in 80 ml of acetone. After stirring in the ice-salt bath for 45 minutes, an orange precipitated formed. Filtration, followed by washing with water, ethanol, and ether, and vacuum drying, gave 3.4 g of product. Recrystallization of this material from 400 ml of hot 1:1 toluene:ethyl acetate gave a crop of orange crystals (2.8 g, 54.8%), m.p.=150° C.

Analysis: Calcd (found) for $C_{44}H_{42}N_2O_6P_2PdSe_2$ (MW=1021.11): C, 51.76 (51.76), H, 4.15 (3.92), N, 2.74 (2.58).

SYNTHETIC EXAMPLE 4

Synthesis of $[PtCl_2(SePh_2)_2]$: To a solution of $K_2[PtCl_4]$ (2.30 g, 5.54 mmol) dissolved in 60 ml of water at about 50° C., was added a solution of $SePh_2$ (2.58 g =1.92 ml, FW=233.17, D=1.338) dissolved in about 30 ml of EtOH. The reaction solution was stirred for 15 minutes at 50° C., an additional 0.55 g (0.41 ml=2.36 mmol) of $SePh_2$ was added, the solution stirred for 3.5 hours at 50° C., diluted to 500 ml with water, and stirred at room temperature for another 2 hours. The resulting murky yellow solution was then decanted from a brown gum that had formed on the bottom of the reaction flask. Addition of 150 ml of acetone to the brown gum, and stirring for 15 minutes at 40° C., gave a yellow powder and a brown solution. Concentration of this solution to dryness and recrystallization of the residue from 75 ml of toluene gave a crop of yellow microcrystals (2.71 g, 66.9%).

Analysis: Calcd. For $C_{24}H_{20}Cl_2PtSe_2$ (MW=732.33): C, 39.36 (39.12), H, 2.75 (2.59), Cl, 9.68 (9.31).

Preparation of Cu(1+) Complexes

Copper(1+) complexes with selenium-containing ligands having Structure II can likewise be prepared using the synthetic methods known in the art, or modifications of these methods. One general synthetic route uses the reaction of CuCl (prepared as described in R. N. Keller and H. D. Wycoff, *Inorganic Syntheses*, 1946, 2, 1), with a solution of a neutral ligand in a non-aqueous solvent such as methylene chloride, chloroform, or acetonitrile. On stirring such a suspension, the initially insoluble CuCl dissolves in a few minutes, to form a soluble complex of the type $[Cu(L')_sCl]$, where L' is a neutral ligand with a Group 15 or 16 donor atom as defined above and s is 1 to 3, its value generally being determined by the stoichiometry of neutral ligand used in the reaction. The solid complex can then be isolated from the reaction solution by concentration to dryness or by concentration to a small volume, addition of 1 to 4 volumes of methanol or ethanol and, if necessary, cooling the diluted solution, typically at −5° C. The isolated solid complexes, generally white or pale yellow, can then by recrysallized from organic solvents by procedures well known in the art. Having prepared such $[Cu(L')_sCl]$ complexes, the complexes with anionic Se-containing ligands, such as SeCN or SePh (for example, $[Cu(L')_sSeCN]$ or $[Cu(L')_sSePh]$) can then be prepared in a subsequent substitution reaction in an appropriate organic solvent. Typical organic solvents useful in such substitution reactions are alcohols such as methanol or ethanol and ethers such as tetrahydrofuran, and mixtures of these solvents with methylene chloride, chloroform, or acetonitrile, the particular solvent or solvent mixture used being determined by the solubility of the $[Cu(L')_sCl]$ complex and the salt of the selenium-containing anion (for example, K[SeCN] or Li[SePh]). Such substitution reactions are typically run at room temperature for 10 to 60 minutes and, after filtration of the reaction solution to remove the metal chloride by-product (such as KCl or LiCl), the desired product can be isolated from the filtrate by concentration and/or dilution with an organic solvent in which the product has poor solubility.

The reaction sequence described above can also be carried out without the isolation of the initial $[Cu(L')_sCl]$ complex, but with reaction of this complex, prepared in-situ, with the salt of the selenium containing anion. The general synthetic methodology useful for such Cu(1+) coordination complexes has been described in the literature, for example in B. J. Hathaway, Copper, Comprehensive Coordination Chemistry, G. Wilkinson, R. D. Gillard, and J. A. McCleverty, Eds., Vol. 5, Pergamon Press, New York, 1987, pp. 533–5[93], F. H. Jardine, Advances in Inorganic and Radiochemistry, Vol. 17, pages 115–163 (1974), Copper(I) Complexes, S. J. Lippard and J. J. Mayerle, *Inorg. Chem.*, 1972, 11, 753, F. H. Jardine, L. Rule, and A. G. Vohra, *J. Chem. Soc.*, (*A*), 1970, 238, J. T. Gill et al, *Inorg. Chem.*, 1976, 15, 1155, M. R. Churchill and F. J. Rotella, *Inorg. Chem.*, 1979, 18, 166, H. J. Gysling, L. J. Gerenser, and M. G., Mason, *J. Coord. Chem.*, 1980, 10, 67, M. D. Janssen, D. M. Grove, and G. Van Koten, Progress in Inorganic Chemistry, Vol. 46, pp. 97–148 (1997): Copper(I), Lithium, and Magnesium Thiolate Complexes: An Overview with Due Mention of Selenolate and Tellurolate Analogues and Related Silver(I) and Gold(I) Species., J. R. Black and W. Levason, *J. Coord. Chem.*, 1996, 37, 315, J. R. Black, N. R. Champness, W. Levason, and G. Reid, *Inorg. Chem.*, 1996, 35, 1820, and D. G. Booth, W. Levason, J. J. Quirk, G. Reid, and S. M. Smith, *J. Chem. Soc.* (*Dalton*), 1997, 3493.

An alternative synthetic route to selenium-containing copper complexes of the present invention is the reaction of Cu(2+) salts, typically copper(2+) chloride or copper(2+) nitrate, with an excess of certain neutral ligands with Group 15 or 16 donor atoms. In such redox type reactions, neutral ligands such as triorganophosphines $[P(R_a)(R_b)(R_c)]$, diorganosulfides $[S(R_a)(R_b)]$, and thiourea derivatives can reduce the Cu(2+) to Cu(1+), with some of the ligand being oxidized in the Cu(1+) to Cu(2+) reduction reaction, and the excess of the ligand forming the Cu(1+) complex, $[Cu(L')_s X^2]$, (where $X^2$ is Cl or $NO_3$). Such redox reactions are typically carried out in methanol. Once isolated, the chloro or nitrato ligands in such complexes can be subsequently replaced by selenium-containing anionic ligands such as $SeCN^-$ or $SeR^-$ by substitution reactions as described above. The syntheses of Cu(1+) complexes by such Cu(2+) reduction reactions have been reported in the literature and such methods, and modifications of such methods, can be used to prepare selenium-containing Cu(1+) complexes described by Structure II. Examples of such syntheses can be found, for example in, H. J. Gysling, *Inorganic Syntheses*, 1979, 19, 92–97, R. J. Restivo et al., *Can. J. Chem.*, 1975, 53, 1949, P, H, Davis, R. Belford, and I. C. Paul, *Inorg. Chem.*, 1973, 12, 213, H. A. Tayim, S. K. Thabet, and M. U. Karkanawi, *Inorg. Nucl. Chem. Lett.*, 1972, 8, 235, and H. J. Gysling, L. J. Gerenser, and M .G., Mason, *J. Coord. Chem.*, 1980, 10, 67.

Unlike the cases of Pt(2+) and Pd(2+) complexes of Structure II described above, which generally have a coordination number of 4 and form square planar complexes such as $[Pt(N,N\text{-dimethylselenourea})_4]Br_2$, $[Pt(SePh_2)_2Br_2]$, and $[Pd(PPh_3)_2(SeCN)_2]$, it is known in the art that the maximum coordination number of Cu(1+) is most commonly 4. However, Cu(1+) complexes with coordination numbers of 2 and 3 are also well known. Examples of these complexes are discussed in B. J. Hathaway, Copper, in Comprehensive Coordination Chemistry, G. Wilkinson, R. D. Gillard, and J. A. McCleverty, Eds., Vol. 5, Pergamon Press, New York, 1987, pp. 533–593. It is also to be understood that, within the scope of the Cu(1+) complexes of this invention, the coordination number of the Cu(1+) ion can also be achieved using monodentate ligands such as, for example, $P(R_a)(R_b)(R_c)$, $Te(R_a)(R_b)$, $Se(R_a)(R_b)$, $S(R_a)(R_b)$, thiourea, $SCN^-$, $SeCN^-$, or $Se(R_a)^-$, as well as bidentate ligands such as, for example, $(R_a)_2PCH_2CH_2P(R_a)_2$, $(R_a)SeCH_2CH_2Se(R_a)$, $S_2CN(R_a)(R_b)^{1-}$, $Se_2P(OR_a)(OR_b)^{1-}$ or tridentate ligands such as, for example, $CH_3C[CH_2P(R_a)_2]_3$, $RP[CH_2CH_2P(R_a)_2]_2$, or $PhSeCH_2CH_2SeCH_2CH_2SePh$. For example, Cu(1+) complexes within the scope of this invention include $[Cu(PPh_3)_3SeCN]$ and $[Cu\{CH_3C(CH_2PPh_2)_3\}SeCN]$, both of which contain 4-coordinate Cu(1+), and $[Cu(SePh_2)_2Se(p\text{-tolyl})]$ and $[Cu\{Ph_2PCH_2CH_2PPh_2\}Se(p\text{-tolyl})]$, both of which contain 3-coordinate Cu(1+), as well as $[Cu\{Se(2,4,6\text{-t-Bu-}C_6H_2)_2\}Se(Mesityl)]$ which contains 2-coordinate Cu(1+).

SYNTHETIC EXAMPLE 5

Synthesis of $[Cu\{P(p\text{-anisyl})_3\}_3SeCN]$: To a solution of $P(p\text{-anisyl})_3$ (22.88 g, 65 mmol) dissolved in 350 ml of $CHCl_3$, was added 2 g (20.2 mmol) of CuCl powder (prepared as described in R. N. Keller and H. D. Wycoff, *Inorganic Syntheses*, 1946, 2, 1). After stirring for 10 minutes at room temperature, the CuCl dissolved to form a clear, colorless solution. To this solution was added a solution of K[SeCN] (3.6 g, 25 mmol) dissolved in 80 ml of methanol. The resulting, slightly cloudy white solution was diluted to 550 ml with $CHCl_3$, stirred for 1 hour, and filtered through a medium porosity glass-frit filter. The clear, colorless filtrate was concentrated under vacuum to 75 ml, diluted to 200 ml with ethanol, and cooled for 10 hours at −5° C. to give a crop of white powder. The powder was isolated by filtration, washed with ethanol and ether, and vacuum dried to give 15.7 g of product. This product was then recrystallized from 300 ml of 2:1 cyclohexane:acetone to give a white, microcrystalline solid (9.8 g (39.6%): m.p.=82° C., $\nu_{CN}$=2100 $cm^{-1}$).

Analysis: Calcd. (Found) for $C_{64}H_{63}CuNO_9P_3Se$ (MW=1225.63): C, 62.72 (62.42), H, 5.18 (5.33), N, 1.14 (1.30), Cu, 5.18 4.93).

SYNTHETIC EXAMPLE 6

Synthesis of $Fe_3(\mu_3\text{-Se})_2(CO)_9$: Cluster compound $Fe_3(\mu_3\text{-Se})_2(CO)_9$ (Compound III-1) was prepared as described in W. Hieber and J. Gruber, Z. *Anorg. Allgem. Chem.*, 1958, 296, 91.

A variety of other metal carbonyl cluster compounds incorporating selenium in the cluster framework have also been reported and are included within the scope of this invention. Such cluster compounds of Fe, Ru, Os, Co, Rh, and Ir, within the scope of Structure III, have been described, for example, in H. J. Gysling, Ligand Properties of Organic Selenium and Tellurium Compounds, in *The Chemistry of Organic Selenium and Tellurium Compounds*, Vol. 1, S. Patai and Z. Rappoport, Eds., Wiley, NY, 1986, *Metal Clusters in Chemistry*, Vols. 1–3, P. Braunstein, L. A. Ora, and P. R. Raithby, Eds., Wiley-VCH, New York, 1999, D. F. Shriver, H. D. Kaesz, and R. D. Adams, *Chemistry of Metal Cluster Complexes*, VCH Publishers, NY, 1990, E. Rupp et al, *European Journal of Inorganic Chemistry*, 2001, 10, 2489, and in P. Mahur et al, *J. Organometal. Chem.*, 1993, 460, 83.

The selenium chemical sensitizers described herein can be added at one or more times during the preparation of the photothermographic emulsion formulations. For example, they can be added before, during or after addition of pyridinium hydrobromide perbromide, calcium bromide, zinc bromide or similar addenda. In some embodiments, they are added before any toning agents (described below) are added to the formulation, or before any spectral sensitizing dyes (described below) are added. It would be readily determinable by routine experimentation as to the optimum time for adding a particular selenium compound to achieve the maximum speed enhancement in the photothermographic emulsion.

Additional and conventional chemical sensitizers may be used in combination with the speed increasing selenium compounds described above. Such compounds may contain sulfur or tellurium, or may comprise a compound containing gold, platinum, palladium, ruthenium, rhodium, iridium, or combinations thereof, a reducing agent such as a tin halide or a combination of any of these. The details of these materials are provided for example, in T. H. James, *The Theory of the Photographic Process*, Fourth Edition, Eastman Kodak Company, Rochester, N.Y., 1977, Chapter 5, pp. 149–169. Suitable conventional chemical sensitization procedures are also described in U.S. Pat. No. 1,623,499 (Sheppard et al.), U.S. Pat. No. 2,399,083 (Waller et al.), U.S. Pat. No. 3,297,447 (McVeigh), U.S. Pat. No. 3,297,446 (Dunn), U.S. Pat. No. 5,049,485 (Deaton), U.S. Pat. No. 5,252,455 (Deaton), U.S. Pat. No. 5,391,727 (Deaton), U.S. Pat. No. 5,912,111 (Lok et al.), U.S. Pat. No. 5,759,761 (Lushington et al.), and EP-A-0 915,371 (Lok et al.).

In one embodiment, a second chemical sensitizer is used in combination with the selenium chemical sensitizers described herein.

For example, the photothermographic material may further comprise a sulfur chemical sensitizer. When used, sulfur sensitization is usually performed by adding a sulfur chemical sensitizer and stirring the emulsion for a predetermined time. Examples of sulfur chemical sensitizers are thioureas, thiosulfates, thiazoles, and rhodanines. One class of preferred sulfur chemical sensitizers are thiourea compounds as represented by Structures IV, V, or VI described above. Most preferred additional thiourea chemical sensitizers are the tetra-substituted thiourea compounds represented by Structure IV and those described in U.S. Ser. No. 09/667,748 (noted above).

In a further embodiment, the second chemical sensitizer comprises a tellurium chemical sensitizer. For example, U.S. Pat. No. 6,025,122 (Sakai et al.) and U.S. Pat. No. 5,968,725 (Katoh et al.) describe the use of conventional tellurides such as dibenzoyl ditelluride, and other tellurium compounds as chemical sensitizers. Other useful tellurium-containing chemical sensitizing compounds include those described for example, in U.S. Pat. No. 4,639,414 (Sakaguchi et al.), and *Research Disclosure* Vol. 166, pp. 54–56, 1978. Examples of tellurium chemical sensitizers include diacyltellurides, diacylditellurides, bis(carbamoyl) tellurides, bis(carbamoyl)ditellurides, phosphine tellurides, telluroureas, and colloidal tellurium.

A preferred class of tellurium chemical sensitizer compounds are described in U.S. Ser. No. 09/746,400 (filed Dec. 21, 2000 by Lynch, Opatz, Shor, Simpson, Willett, and Gysling) incorporated herein by reference.

These tellurium chemical sensitizers can be represented by the following Structures VII or VIII:

$$Te(L^{11})_{m'}(X^{11})_{n'} \quad \text{(VII)}$$

$$Pd[Te(R'')_2]_2(X^{12})_2 \quad \text{(VIII)}$$

wherein $X^{11}$ and $X^{12}$ independently represent halo, OCN, SCN, $S(C{=}S)N(R_{aa})(R_{bb})$, $S(C{=}S)OR_{aa}$, $S(C{=}S)SR_{aa}$, $S(P{=}S)(OR_{aa})(OR_{bb})$, $S(P{=}S)(R_{aa})(R_{bb})$, SeCN, TeCN, CN, $SR_{aa}$, $OR_{aa}$, $N_3$, alkyl, aryl, or $O(C{=}O)R_{aa}$ groups, $R_{aa}$ and $R_{bb}$ are as defined below, $L^{11}$ is a ligand derived from a neutral Lewis base, R" is an alkyl or aryl group, m' is 0, 1, 2, or 4, and n' is 2 or 4 provided that multiple $X^{11}$, $X^{12}$, $L^{11}$, $R_{aa}$, $R_{bb}$, or R" groups in the molecule can be the same or different.

In Structure VII, $X^{11}$ represents a halo (such as chloro, bromo, or iodo), OCN, SCN, $S(C{=}S)N(R_{aa})(R_{bb})$, $S(C{=}S)OR_{aa}$, $S(C{=}S)SR_{aa}$, $S(P{=}S)(OR_{aa})(OR_{bb})$, $S(P{=}S)(R_{aa})(R_{bb})$, SeCN, TeCN, CN, $SR_{aa}$, $OR_{aa}$, $N_3$, alkyl (as defined below for $R_{aa}$ and $R_{bb}$), aryl (as defined above for Ar), or $O(C{=}O)R_{aa}$ group wherein $R_{aa}$ and $R_{bb}$ are as defined above. Preferably, $X^{11}$ represents a halo (such as chloro or bromo), SCN, or $S(C{=}S)N(R_{aa})(R_{bb})$ group, and more preferably, it represents a halo group such as chloro or bromo. The multiple $X^{11}$ groups in a Structure VII compound can be the same or different groups.

The "$R_{aa}$ and $R_{bb}$" groups used to define $X^{11}$ can be any suitable substituted or unsubstituted alkyl group having 1 to 20 carbon atoms (including all possible isomers, such as methyl, ethyl, isopropyl, t-butyl, octyl, decyl, trimethylsilylmethyl, and 3-trimethylsilyl-n-propyl), substituted or unsubstituted alkenyl group having 2 to 20 carbon atoms (including all possible isomers such as ethenyl, 1-propenyl, and 2-propenyl) or substituted or unsubstituted carbocyclyl groups (such as cyclopentyl, cyclohexyl, or cycloheptyl), heterocyclyl groups (such as morpholinyl, piperidyl, and piperazyl), or aryl group (Ar) having 6 to 10 carbon atoms in the single- or fused-ring system (such as phenyl, 4-methylphenyl, anthryl, naphthyl, xylyl, mesityl, indenyl, 2,4,6-tri(t-butyl)phenyl, pentafluorophenyl, 4-methoxyphenyl, 3,5-dimethylphenyl, pyridyl, and 2-phenylethyl). In addition, when $X^{11}$ groups contain more than an $R_{aa}$ and an $R_{bb}$ group, these groups may be joined together to form a substituted or unsubstituted 5- to 7-membered heterocyclic ring. Preferably, $R_{aa}$ and $R_{bb}$ are a substituted or unsubstituted alkyl group having 1 to 8 carbon atoms. Unless otherwise noted, multiple $R_{aa}$ and $R_{bb}$ groups in a molecule can be the same or different groups.

$L^{11}$ represents the same or different neutral Lewis base ligands, such as ligands derived from thiourea, substituted thiourea, pyridine, and substituted pyridines. Preferably, $L^{11}$ is a ligand derived from thiourea or a substituted thiourea, and more preferably, it is a ligand derived from a substituted thiourea as defined above in Structures IV, V, or VI. Multiple $L^{11}$ groups in the Structure VII groups can be the same or different groups.

Also, in Structure VII, m' is an integer selected from the group of integers of 0, 1, 2, and 4, and n' is an integer of 2 or 4.

In Structure VIII, $X^{12}$ represents a halo, OCN, SCN, $S(C{=}S)N(R_{aa})(R_{bb})$, $S(C{=}S)OR_{aa}$, $S(C{=}S)SR_{aa}$, $S(P{=}S)(OR_{aa})(OR_{bb})$, $S(P{=}S)(R_{aa})(R_{bb})$, SeCN, TeCN, CN, $SR_{aa}$, $OR_{aa}$, alkyl (as defined for $R_{aa}$ and $R_{bb}$), aryl (as defined above for Ar), $N_3$, or $O_2CR_{aa}$ group in which $R_{aa}$ and $R_{bb}$ are as defined above. Preferably, $X^{12}$ represents a halo, SCN, or SeCN group. More preferably, $X^{12}$ is a chloro, bromo, or SCN group. The multiple $X^{12}$ groups in the Structure VIII compounds can be the same or different groups.

In addition, R" represents a substituted or unsubstituted alkyl or aryl group that is defined as described above for $R_{aa}$ and $R_{bb}$. Preferably, R" is a substituted or unsubstituted alkyl group having from 1 to 10 carbon atoms. The multiple R" groups in the molecule can be the same or different.

Additional chemical sensitization can also be achieved by the addition of a second chemical sensitizer, which is a gold chemical sensitizer. The gold chemical sensitizer may have a gold oxidation number of either +1 or +3. U.S. Pat. No. 5,858,637 (Eshelman et al.), JP 2001-296629 A2 (Kimura et al.), JP 2001-249426 A2 (Takiguchi), and JP 2001-228576 A2 (Takiguchi) describe various Au(1+) and Au(3+) compounds that can be used as chemical sensitizers in photothermographic compositions and materials. Examples of gold chemical sensitizers include chloroauric acid, potassium chloroaurate, auric trichloride, potassium auric thiocyanate, potassium iodoaurate, tetracyanoauric acid, ammonium aurothiocyanate, and pyridyltrichlorogold.

A preferred class of gold chemical sensitizer compounds are the trivalent gold compounds described in U.S. Ser. No. 09/768,094 (filed Jan. 23, 2001, by Simpson, Shor, and Whitcomb) incorporated herein by reference. These gold (3+)-containing compound can be represented by the following Structure IX:

$$Au[3+](L'')_{r'}(Y')_{q'} \quad \text{(IX)}$$

wherein L" represents the same or different ligands, each ligand comprising at least one heteroatom that is capable of forming a bond with gold, Y' is an anion, r' is an integer of from 1 to 4, and q' is an integer of from 0 to 3.

More particularly, L" represents the same or different ligands that comprise at least one oxygen, nitrogen, sulfur, or phosphorous atom. Examples of such ligands include, but are not limited to, pyridine, 2,2'-bipyridine, 2,2',2"-terpyridine, $P(C_6H_5)_3$, carboxylate, imine, phenol, mercaptophenol, imidazole, triazole, and dithiooxamide The preferred L" ligands are derived from terpyridine, $P(C_6H_5)_3$, and salicylimine compounds.

Also in the noted Structure IX, Y' represents an appropriate anionic ligand or counter anion having the appropriate charge. Useful anions include but are not limited to, halides (such as chloride and bromide), perchlorate, tetrafluoroborate, sulfate, sulfonate, methylsulfonate, p-toluenesulfonate, tetrafluoroantimonate, and nitrate. Halides are preferred.

In yet an even further embodiment, additional chemical sensitization can be achieved by oxidative decomposition of a sulfur-containing compound on or around the silver halide grains in an oxidizing environment. In some instances, the sulfur-containing compound is an organic sulfur-containing compound that is also known in the art as a spectral sensitizing dye. Such compounds are described, for example, in U.S. Pat. No. 5,891,615 (Winslow et al.). Upon decomposition in a oxidizing environment, such compounds provide chemical sensitization instead of spectral sensitization.

In a further embodiment, the photothermographic material further comprises a mixture of two or more of: a tellurium chemical sensitizer, a gold chemical sensitizer, a sulfur chemical sensitizer, an oxidatively decomposed sulfur-containing compound, or by combinations thereof. Preferred sulfur chemical sensitizers are those represented above by Structures IV, V, and VI. Preferred tellurium chemical sensitizers are those represented above by Structures VII and VIII. Preferred gold sensitizers are those represented above by Structure IX.

As noted above, the photothermographic emulsions useful to make the imaging materials of this invention can be prepared by the following steps, in order:

A) providing a photothermographic emulsion comprising silver halide grains and a non-photosensitive source of reducible silver ions, and B) positioning one or more of the selenium chemical sensitizers represented by Structures I, II, or III described above on or around the silver halide grains.

Methods of preparation can also comprise:

A) providing silver halide grains,

B) providing a photothermographic emulsion of the silver halide grains and a non-photosensitive source of reducible silver ions, and C) during or anytime after step A, chemically sensitizing the silver halide grains with a selenium chemical sensitizer represented by Structures I, II, or III described above.

In some embodiments of this method, step C can follow step B. That is, chemical sensitization takes place after the formation of the non-photo-sensitive source of reducible silver in the presence of the preformed silver halide grains or the mixing of the non-photosensitive source of reducible silver in the presence of the preformed silver halide grains.

Alternatively, step C can be carried out between steps A and B. In this instance, the preformed silver halide grains are chemically sensitized immediately before they are mixed with the non-photosensitive source of reducible silver ions, or immediately before the non-photosensitive source of reducible silver ions is formed in their presence.

Still further, step C can be carried out during step A by chemically sensitizing preformed silver halide grains as they are mixed with the non-photosensitive source of reducible silver ions or as the non-photosensitive source of reducible silver ions is formed in their presence.

Still further, during or at any time after step A, the silver halide grains can be chemically sensitized by oxidative decomposition of a sulfur-containing compound, or by addition of a sulfur chemical sensitizer, a tellurium chemical sensitizer, a gold chemical sensitizer, or by combinations thereof Preferred sulfur chemical sensitizers are thiourea compounds represented above by Structures IV, V, and VI. Preferred tellurium chemical sensitizers are those represented above by Structures VII and VIII. Preferred gold sensitizers are those represented above by Structure IX.

If the silver halide grains are further chemically sensitized with an organic sulfur-containing compound, step C can also include decomposing the sulfur-containing compound on or around the silver halide grains in an oxidizing environment. In some instances, the sulfur-containing compound is an organic sulfur-containing compound that is also known in the art as a spectral sensitizing dye. Such compounds are described, for example, in U.S. Pat. No. 5,891,615 (Winslow et al.). Upon decomposition in an oxidizing environment, such compounds provide chemical sensitization instead of spectral sensitization.

In such embodiments, the method of preparing photothermographic emulsions will likely further comprise adding a second spectral sensitizing dye (as described below) to the photothermographic emulsion to spectrally sensitize the silver halide grains.

Spectral Sensitizers

The photosensitive silver halides may be spectrally sensitized with various spectral sensitizing dyes that are known to enhance silver halide sensitivity to ultraviolet, visible, and/or infrared radiation. Non-limiting examples of sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. Cyanine dyes are particularly useful. The cyanine dyes preferably include benzothiazole, benzoxazole, and benzoselenazole dyes that include one or more thioalkyl, thioaryl, or thioether groups. Suitable visible sensitizing dyes such as those described in U.S. Pat. No. 3,719,495 (Lea), U.S. Pat. No. 4,439,520 (Kofron et al.), and U.S. Pat. No. 5,281,515 (Delprato et al.) are effective in the practice of the invention. Suitable infrared sensitizing dyes such as those described in U.S. Pat. No. 5,393,654 (Burrows et al.), U.S. Pat. No. 5,441,866 (Miller et al.) and U.S. Pat. No. 5,541,054 (Miller et al.) are also effective in the practice of this invention. A summary of generally useful spectral sensitizing dyes is contained in *Research Disclosure*, item 308119, Section IV, December, 1989. Additional classes of dyes useful for spectral sensitization, including sensitization at other wavelengths are described in *Research Disclosure*, 1994, item 36544, section V. All of the references and patents above are incorporated herein by reference.

An appropriate amount of spectral sensitizing dye added is generally about $10^{-10}$ to $10^{-1}$ mole, and preferably, about $10^{-7}$ to $10^{-2}$ mole per mole of silver halide.

Non-Photosensitive Source of Reducible Silver Ions

The non-photosensitive source of reducible silver ions used in photothermographic materials of this invention can be any metal-organic compound that contains reducible silver (1+) ions. Preferably, it is a silver salt or coordination complex that is comparatively stable to light and forms a silver image when heated to 50° C. or higher in the presence of an exposed photocatalyst (such as silver halide) and a reducing composition.

Silver salts of organic acids, particularly silver salts of long-chain carboxylic (fatty) acids are preferred. The chains typically contain 10 to 30, and preferably 15 to 28, carbon atoms. Suitable organic silver salts include silver salts of organic compounds having a carboxylic acid group. Examples thereof include a silver salt of an aliphatic carboxylic acid or a silver salt of an aromatic carboxylic acid. Preferred examples of the silver salts of aliphatic carboxylic acids include silver behenate, silver arachidate, silver stearate, silver oleate, silver laurate, silver caprate, silver myristate, silver palmitate, silver maleate, silver fumarate, silver tartarate, silver furoate, silver linoleate, silver butyrate, silver camphorate, and mixtures thereof. Preferably, at least silver behenate is used alone or in mixtures with other silver salts.

Representative examples of the silver salts of aromatic carboxylic acid and other carboxylic acid group-containing compounds include, but are not limited to, silver benzoate, silver-substituted benzoates, such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, silver gallate, silver tannate, silver phthalate, silver terephthalate, silver salicylate, silver phenylacetate, and silver pyromellitate.

Silver salts of aliphatic carboxylic acids containing a thioether group as described in U.S. Pat. No. 3,330,663 (Weyde et al.) are also useful. Soluble silver carboxylates having hydrocarbon chains incorporating ether or thioether linkages, or sterically hindered substitution in the α- (on a hydrocarbon group) or ortho- (on an aromatic group) position, and displaying increased solubility in coating solvents and affording coatings with less light scattering can also be used. Such silver carboxylates are described in U.S. Pat. No. 5,491,059 (Whitcomb). Mixtures of any of the silver salts described herein can also be used if desired.

Silver salts of sulfonates are also useful in the practice of this invention. Such materials are described, for example, in U.S. Pat. No. 4,504,575 (Lee). Silver salts of sulfosuccinates are also useful as described for example, in EP-A-0 227 141 (Leenders et al.).

Silver salts of compounds containing mercapto or thione groups and derivatives thereof can also be used. Preferred examples of these compounds include, but are not limited to, a heterocyclic nucleus containing 5 or 6 atoms in the ring, at least one of which is a nitrogen atom, and other atoms being carbon, oxygen, or sulfur atoms. Such heterocyclic nuclei include, but are not limited to, triazoles, oxazoles, thiazoles, thiazolines, imidazoles, diazoles, pyridines, and triazines. Representative examples of these silver salts include, but are not limited to, a silver salt of 3-mercapto-4-phenyl-1,2,4-triazole, a silver salt of 5-carboxylic-1-methyl-2-phenyl-4-thiopyridine, a silver salt of mercaptotriazine, a silver salt of 2-mercaptobenzoxazole, silver salts as described in U.S. Pat. No. 4,123,274 (Knight et al.) (for example, a silver salt of a 1,2,4-mercaptothiazole derivative, such as a silver salt of 3-amino-5-benzylthio-1,2,4-thiazole), and a silver salt of thione compounds [such as a silver salt of 3-(2-carboxyethyl)-4-methyl-4-thiazoline-2-thione as described in U.S. Pat. No. 3,785,830 (Sullivan et al.)].

Examples of other useful silver salts of mercapto or thione substituted compounds that do not contain a heterocyclic nucleus include, but are not limited to, silver salts of thioglycolic acids such as a silver salt of an S-alkylthioglycolic acid (wherein the alkyl group has from 12 to 22 carbon atoms), a silver salt of a dithiocarboxylic acid such as a silver salt of a dithioacetic acid, and a silver salt of a thioamide.

In some embodiments, a silver salt of a compound containing an imino group can be used. Preferred examples of these compounds include, but are not limited to, silver salts of benzotriazole and substituted derivatives thereof (for example, silver methylbenzotriazole and silver 5-chlorobenzotriazole), silver salts of 1,2,4-triazoles or 1-H-tetrazoles such as phenylmercaptotetrazole as described in U.S. Pat. No. 4,220,709 (deMauriac), and silver salts of imidazoles and imidazole derivatives as described in U.S. Pat. No. 4,260,677 (Winslow et al.).

Moreover, silver salts of acetylenes can also be used as described, for example, in U.S. Pat. No. 4,761,361 (Ozaki et al.) and U.S. Pat. No. 4,775,613 (Hirai et al.).

Silver complexes containing organophosphine ligands can also be used (for example, $Ag[P(R_8)_3]_nX^3$ (wherein $R_8$ is an alkyl or an aryl group, n is 1 to 4, and $X^3$ is $NO_3^-$, $BF_4^-$, $PF_6^-$, $SCN^-$, carboxylate, or $CF_3SO_3^-$). Examples of such silver complexes include, for example, $[Ag\{N(CH_2CH_2PPh_2)_3\}NO_3]$ as described in M. Khan et al., *Inorg. Chem.,* 1993, 32, 5800, $[Ag(PPh_3)(O_3SCF_3)]$ as described in M. Bardji et al., *Inorg. Chim. Acta*, 2000, 304, 7, $[(Ph_3P)_2AgNO_3]_2$ as described in P. G. Jones, *Acta Crystallogr.*, 1993, *C*49, 1148, $[Ag\{P(Mesityl)_3\}_2PF_6]$ as described in E. C. Alyea et al., *Inorg. Chem.* 1982, 21, 1369, $[Ag(PPh_3)_2(O_2CCH_3)]$ as described in B. Femi-Onadeko, Z. *Kristallogr.*, 1980, 152, 159, $[Ag(O_2CR_9)(PPh_3)_3]$ wherein $R_9$ is methyl, $CHCl_2$, $CH_2Cl$, $CCl_3$, phenyl, p-tolyl, o-tolyl, or m-tolyl as described in C. Oldham et al., *J. Chem. Soc.* (*Dalton Trans.*), 1977, 2068, and $[Ag(PPh_3)NO_3]$ as described in R. A. Stein et al., *Inorg. Chem.*, 1977, 16, 242. In the above structures, "Ph" represents a phenyl group and "Mesityl" represents a 2,4,6-trimethylphenyl group.

It is also convenient to use silver half soaps. A preferred example of a silver half soap is an equimolar blend of silver carboxylate and carboxylic acid, which analyzes for about 14.5% by weight solids of silver in the blend and which is prepared by precipitation from an aqueous solution of an ammonium or an alkali metal salt of a commercial fatty carboxylic acid, or by addition of the free fatty acid to the silver soap. For transparent films a silver carboxylate full soap, containing not more than about 15% of free fatty carboxylic acid and analyzing for about 22% silver, can be used. For opaque photothermographic materials, different amounts can be used.

The methods used for making silver soap emulsions are well known in the art and are disclosed in *Research Disclosure*, Apr. 1983, item 22812, *Research Disclosure*, October 1983, item 23419, U.S. Pat. No. 3,985,565 (Gabrielsen et al.) and the references cited above.

Non-photosensitive sources of reducible silver ions can also be provided as core-shell silver salts such as those described in commonly assigned and copending U.S. Ser. No. 09/761,954 (filed Jan. 17, 2001 by Whitcomb and Pham), that is incorporated herein by reference. These silver salts include a core comprised of one or more silver salts and a shell having one or more different silver salts.

Still another useful source of non-photosensitive reducible silver ions in the practice of this invention are the silver dimer compounds that comprise two different silver salts as described in copending U.S. Ser. No. 09/812,597 (filed Mar. 20, 2001 by Whitcomb), that is incorporated herein by reference. Such non-photosensitive silver dimer compounds comprise two different silver salts, provided that when the two different silver salts comprise straight-chain, saturated hydrocarbon groups as the silver coordinating ligands, those ligands differ by at least 6 carbon atoms.

As one skilled in the art would understand, the non-photosensitive source of reducible silver ions can include various mixtures of the various silver salt compounds described herein, in any desirable proportions.

The photocatalyst and the non-photosensitive source of reducible silver ions must be in catalytic proximity (that is, reactive association). It is preferred that these reactive components be present in the same emulsion layer.

The one or more non-photosensitive sources of reducible silver ions are preferably present in an amount of about 5% by weight to about 70% by weight, and more preferably, about 10% to about 50% by weight, based on the total dry weight of the emulsion layers. Stated another way, the amount of the sources of reducible silver ions is generally present in an amount of from about 0.001 to about 0.2 mol/m$^2$ of dried photothermographic material, and preferably from about 0.01 to about 0.05 mol/m$^2$ of that material.

The total amount of silver (from all silver sources) in the photothermographic materials is generally at least 0.002 mol/m$^2$ and preferably from about 0.01 to about 0.05 mol/m$^2$.

Reducing Agents

The reducing agent (or reducing agent composition comprising two or more components) for the reduction of the reducible silver ions can be any material, preferably an organic material, that can reduce silver(I)ion to metallic silver. Conventional photographic developers such as methyl gallate, hydroquinone, substituted hydroquinones, hindered phenols, amidoximes, azines, catechol, pyrogallol, ascorbic acid (and derivatives thereof), leuco dyes and other materials readily apparent to one skilled in the art can be used in this manner as described for example, in U.S. Pat. No. 6,020,117 (Bauer et al.).

In some instances, the reducing agent composition comprises two or more components such as a hindered phenol developer and a co-developer that can be chosen from the various classes of reducing agents described below. Ternary developer mixtures involving the further addition of contrast enhancing agents are also useful. Such contrast enhancing agents can be chosen from the various classes described below.

Hindered phenol reducing agents are preferred (alone or in combination with one or more high contrast co-developing agents and co-developer contrast-enhancing agents). These are compounds that contain only one hydroxy group on a given phenyl ring and have at least one additional substituent located ortho to the hydroxy group. Hindered phenol developers may contain more than one hydroxy group as long as each hydroxy group is located on different phenyl rings. Hindered phenol developers include, for example, binaphthols (that is dihydroxybinaphthyls), biphenols (that is dihydroxybiphenyls), bis(hydroxynaphthyl) methanes, bis(hydroxyphenyl)methanes (that is, bisphenols), hindered phenols, and hindered naphthols each of which may be variously substituted.

Representative binaphthols include, but are not limited to, 1,1'-bi-2-naphthol, 1,1'-bi-4-methyl-2-naphthol, and 6,6'-dibromo-bi-2-naphthol. For additional compounds see U.S. Pat. No. 3,094,417 (Workman) and U.S. Pat. No. 5,262,295 (Tanaka et al.), both incorporated herein by reference.

Representative biphenols include, but are not limited to, 2,2'-dihydroxy-3,3'-di-t-butyl-5,5-dimethylbiphenyl, 2,2'-dihydroxy-3,3',5,5,-tetra-t-butylbiphenyl, 2,2'-dihydroxy-3,3'-di-t-butyl-5,5'-dichlorobiphenyl, 2-(2-hydroxy-3-t-butyl-5-methylphenyl)-4-methyl-6-n-hexylphenol, 4,4'-dihydroxy-3,3',5,5, -tetra-t-butylbiphenyl and 4,4'-dihydroxy-3,3',5,5'-tetramethylbiphenyl. For additional compounds see U.S. Pat. No. 5,262,295 (noted above).

Representative bis(hydroxynaphthyl)methanes include, but are not limited to, 4,4'-methylenebis(2-methyl-1-naphthol). For additional compounds see U.S. Pat. No. 5,262,295 (noted above).

Representative bis(hydroxyphenyl)methanes include, but are not limited to, bis(2-hydroxy-3-t-butyl-5-methylphenyl) methane (CAO-5), 1,1-bis(2-hydroxy-3,5-dimethylphenyl)-3,5,5-trimethylhexane (NONOX or PERMANAX WSO), 1,1-bis(3,5-di-t-butyl-4-hydroxyphenyl)methane, 2,2-bis(4-hydroxy-3-methylphenyl)propane, 4,4-ethylidene-bis(2-t-butyl-6-methylphenol), 2,2'-isobutylidene-bis(4,6-dimethylphenol) (LOWINOX 221B46), and 2,2-bis(3,5-dimethyl-4-hydroxyphenyl)propane. For additional compounds see U.S. Pat. No. 5,262,295 (noted above).

Representative hindered phenols include, but are not limited to, 2,6-di-t-butylphenol, 2,6-di-t-butyl-4-methylphenol, 2,4-di-t-butylphenol, 2,6-dichlorophenol, 2,6-dimethylphenol and 2-t-butyl-6-methylphenol.

Representative hindered naphthols include, but are not limited to, 1-naphthol, 4-methyl-1-naphthol, 4-methoxy-1-naphthol, 4-chloro-1-naphthol and 2-methyl-1-naphthol. For additional compounds see U.S. Pat. No. 5,262,295 (noted above).

More specific alternative reducing agents that have been disclosed in dry silver systems include amidoximes such as phenylamidoxime, 2-thienyl-amidoxime and p-phenoxyphenylamidoxime, azines (for example, 4-hydroxy-3,5-dimethoxybenzaldehydrazine), a combination of aliphatic carboxylic acid aryl hydrazides and ascorbic acid [such as 2,2'-bis(hydroxymethyl)-propionyl-β-phenyl hydrazide in combination with ascorbic acid], a combination of polyhydroxybenzene and hydroxylamine, a reductone and/or a hydrazine [for example, a combination of hydroquinone and bis(ethoxyethyl)hydroxylamine], piperidino-hexose reductone or formyl-4-methylphenylhydrazine, hydroxamic acids (such as phenylhydroxamic acid, p-hydroxyphenylhydroxamic acid, and o-alaninehydroxamic acid), a combination of azines and sulfonamidophenols (for example, phenothiazine and 2,6-dichloro-4-benzenesulfonamidophenol), α-cyanophenylacetic acid derivatives (such as ethyl α-cyano-2-methylphenyl-acetate and ethyl-α-cyanophenylacetate), bis-o-naphthols [such as 2,2'-dihydroxyl-1-binaphthyl, 6,6'-dibromo-2,2'-dihydroxy-1,1'-binaphthyl, and bis(2-hydroxy-1-naphthyl)methane], a combination of bis-o-naphthol and a 1,3-dihydroxybenzene derivative (for example, 2,4-dihydroxybenzophenone or 2,4-dihydroxyacetophenone), 5-pyrazolones such as 3-methyl-1-phenyl-5-pyrazolone, reductones (such as dimethylaminohexose reductone, anhydrodihydro-aminohexose reductone and anhydrodihydro-piperidone-hexose reductone), sulfonamidophenol reducing agents (such as 2,6-dichloro-4-benzenesulfonamido-phenol, and p-benzenesulfonamidophenol), indane-1,3-diones (such as 2-phenylindane-1,3-dione), chromans (such as 2,2-dimethyl-7-t-butyl-6-hydroxychroman), 1,4-dihydropyridines (such as 2,6-dimethoxy-3,5-dicarbethoxy-1,4-dihydropyridine), ascorbic acid derivatives (such as 1-ascorbylpalmitate, ascorbylstearate and unsaturated aldehydes and ketones), and 3-pyrazolidones.

An additional class of reducing agents that can be used as developers are substituted hydrazines including the sulfonyl hydrazides described in U.S. Pat. No. 5,464,738 (Lynch et al.). Still other useful reducing agents are described for example, in U.S. Pat. No. 3,074,809 (Owen), U.S. Pat. No. 3,094,417. (Workman), U.S. Pat. No. 3,080,254 (Grant, Jr.) and U.S. Pat. No. 3,887,417 (Klein et al.). Auxiliary reducing agents may be useful as described in U.S. Pat. No. 5,981,151 (Leenders et al.). All of these patents are incorporated herein by reference.

Useful co-developer reducing agents can also be used as described for example, in copending U.S. Ser. No. 09/239,182 (filed Jan. 28, 1999 by Lynch and Skoug), incorporated herein by reference. Examples of these compounds include, but are not limited to, 2,5-dioxo-cyclopentane carboxaldehydes, 5-(hydroxymethylene)-2,2-dimethyl-1,3-dioxane-4,6-diones, 5-(hydroxymethylene)-1,3-dialkylbarbituric acids, and 2-(ethoxymethylene)-1H-indene-1,3(2H)-diones.

Additional classes of reducing agents that can be used as co-developers are trityl hydrazides and formyl phenyl hydrazides as described in U.S. Pat. No. 5,496,695 (Simpson et al.), 2-substituted malondialdehyde compounds as described in U.S. Pat. No. 5,654,130 (Murray), and 4-substituted isoxazole compounds as described in U.S. Pat. No. 5,705,324 (Murray). Additional developers are described in U.S. Pat. No. 6,100,022 (Inoue et al.). All of the patents above are incorporated herein by reference.

Yet another class of co-developers includes substituted acrylonitrile compounds that are described in U.S. Pat. No. 5,635,339 (Murray) and U.S. Pat. No. 5,545,515 (Murray et al.), both incorporated herein by reference. Examples of such compounds include, but are not limited to, the compounds identified as HET-01 and HET-02 in U.S. Pat. No. 5,635,339 (noted above) and CN-01 through CN-13 in U.S. Pat. No. 5,545,515 (noted above). Particularly useful compounds of this type are (hydroxymethylene)cyanoacetates and their metal salts.

Various contrast enhancing agents can be used in some photothermographic materials with specific co-developers. Examples of useful contrast enhancers include, but are not limited to, hydroxylamine, alkanolamines and ammonium phthalamate compounds as described for example, in U.S. Pat. No. 5,545,505 (Simpson), hydroxamic acid compounds as described for example, in U.S. Pat. No. 5,545,507 (Simpson et al.), N-acylhydrazine compounds as described for example, in U.S. Pat. No. 5,558,983 (Simpson et al.), and hydrogen atom donor compounds as described in U.S. Pat. No. 5,637,449 (Harring et al.). All of the patents noted above are incorporated herein by reference.

The reducing agent (or mixture thereof) described herein is generally present as 1 to 10% (dry weight) of the emulsion layer. In multilayer constructions, if the reducing agent is added to a layer other than an emulsion layer, slightly higher proportions, of from about 2 to 15 weight % may be more desirable. Any co-developers may be present generally in an amount of from about 0.001% to about 1.5% (dry weight) of the emulsion layer coating.

For color imaging materials (for example, monochrome, dichrome, or full color images), one or more reducing agents can be used that can be oxidized directly or indirectly to form or release one or more dyes.

The dye-forming or releasing compound may be any colored, colorless, or lightly colored compound that can be oxidized to a colored form, or to release a preformed dye when heated, preferably to a temperature of from about 80° C. to about 250° C. for a duration of at least I second. When used with a dye- or image-receiving layer, the dye can diffuse through the imaging layers and interlayers into the image-receiving layer of the photothermographic material.

Leuco dyes or "blocked" leuco dyes are one class of dye-forming compounds (or "blocked" dye-forming compounds) that form and release a dye upon oxidation by silver ion to form a visible color image in the practice of the present invention. Leuco dyes are the reduced form of dyes that are generally colorless or very lightly colored in the visible region (optical density of less than 0.2). Thus, oxidation provides a color change that is from colorless to colored, an optical density increase of at least 0.2 units, or a substantial change in hue.

Representative classes of useful leuco dyes include, but are not limited to, chromogenic leuco dyes (such as indoaniline, indophenol, or azomethine dyes), imidazole leuco dyes such as 2-(3,5-di-t-butyl-4-hydroxyphenyl)-4,5-diphenylimidazole as described for example in U.S. Pat. No. 3,985,565 (Gabrielson et al.), dyes having an azine, diazine, oxazine, or thiazine nucleus such as those described for example in U.S. Pat. No. 4,563,415 (Brown et al.), U.S. Pat. No. 4,622,395 (Bellus et al.), U.S. Pat. No. 4,710,570 (Thien), and U.S. Pat. No. 4,782,010 (Mader et al.), and benzylidene leuco compounds as described for example in U.S. Pat. No. 4,923,792 (Grieve et al.), all incorporated herein by reference. Further details about the chromogenic leuco dyes noted above can be obtained from U.S. Pat. No. 5,491,059 (noted above, Column 13) and references noted therein.

Another useful class of leuco dyes includes what are known as "aldazine" and "ketazine" leuco dyes that are described for example in U.S. Pat. No. 4,587,211 (Ishida et al.) and U.S. Pat. No. 4,795,697 (Vogel et al.), both incorporated herein by reference.

Still another useful class of dye-releasing compounds are those that release diffusible dyes upon oxidation. These are known as preformed dye release (PDR) or redox dye release (RDR) compounds. In such compounds, the reducing agents release a mobile preformed dye upon oxidation. Examples of such compounds are described in U.S. Pat. No. 4,981,775 (Swain), incorporated herein by reference.

Further, other useful image-forming compounds are those in which the mobility of a dye moiety changes as a result of an oxidation-reduction reaction with silver halide, or a nonphotosensitive silver salt at high temperature, as described for example in JP Kokai 165,054/84.

Still further, the reducing agent can be a compound that releases a conventional photographic dye forming color coupler or developer upon oxidation as is known in the photographic art.

The dyes that are formed or released can be in the same or different imaging layers. A difference of at least 60 nm in reflective maximum absorbance is preferred. More preferably, this difference is from about 80 to about 100 nm. Further details about the various dye absorbances are provided in U.S. Pat. No. 5,491,059 (noted above, Col. 14).

The total amount of one or more dye-forming or releasing compound that can be incorporated into the photothermographic materials of this invention is generally from about 0.5 to about 25 weight % of the total weight of each imaging layer in which they are located. Preferably, the amount in each imaging layer is from about 1 to about 10 weight %, based on the total dry layer weight. The useful relative proportions of the leuco dyes would be readily known to a skilled worker in the art.

Other Addenda

The photothermographic materials of the invention can also contain other additives such as shelf-life stabilizers, toners, antifoggants, contrast enhancing agents, development accelerators, acutance dyes, thermal solvents, post-processing stabilizers or stabilizer precursors, and other image-modifying agents as would be readily apparent to one skilled in the art.

To further control the properties of photothermographic materials, (for example, contrast, $D_{min}$, speed, or fog), it may be preferable to add one or more heteroaromatic mercapto compounds or heteroaromatic disulfide compounds of the formulae: Ar—S—$M^1$ and Ar—S—S—Ar, wherein $M^1$ represents a hydrogen atom or an alkali metal atom and Ar represents a heteroaromatic ring or fused heteroaromatic ring containing one or more of nitrogen, sulfur, oxygen, selenium, or tellurium atoms. Preferably, the heteroaromatic ring comprises benzimidazole, naphthimidazole, benzothiazole, naphthothiazole, benzoxazole, naphthoxazole, benzoselenazole, benzotellurazole, imidazole, oxazole, pyrazole, triazole, thiazole, thiadiazole, tetrazole, triazine, pyrimidine, pyridazine, pyrazine, pyridine, purine, quinoline, or quinazolinone. Compounds having other hetero-aromatic rings and compounds providing enhanced sensitization at other wavelengths are also envisioned to be suitable. For example, hetreroaromatic mercapto compounds are described as supersensitizers for infrared photothermographic materials in EP-B1-0 559 228. (Philip Jr. et al.).

The heteroaromatic ring may also carry substituents. Examples of preferred substituents are halo groups (such as bromo and chloro), hydroxy, amino, carboxy, alkyl groups (for example, of 1 or more carbon atoms and preferably 1 to 4 carbon atoms), and alkoxy groups (for example, of 1 or more carbon atoms and preferably of 1 to 4 carbon atoms).

Heteroaromatic mercapto compounds are most preferred. Examples of preferred heteroaromatic mercapto compounds are 2-mercaptobenzimidazole, 2-mercapto-5-methylbenzimidazole, 2-mercaptobenzothiazole and 2-mercaptobenzoxazole, and mixtures thereof.

If used, a heteroaromatic mercapto compound is generally present in an emulsion layer in an amount of at least about 0.0001 mole per mole of total silver in the emulsion layer. More preferably, the heteroaromatic mercapto compound is present within a range of about 0.001 mole to about 1.0 mole, and most preferably, about 0.005 mole to about 0.2 mole, per mole of total silver.

The photothermographic materials of the present invention can be further protected against the production of fog and can be stabilized against loss of sensitivity during storage. While not necessary for the practice of the invention, it may be advantageous to add mercury(2+) salts to the emulsion layer(s) as an antifoggant. Preferred mercury (2+) salts for this purpose are mercuric acetate and mercuric bromide. Other useful mercury salts include those described in U.S. Pat. No. 2,728,663 (Allen).

Other suitable antifoggants and stabilizers that can be used alone or in combination include thiazolium salts as described in U.S. Pat. No. 2,131,038 (Staud) and U.S. Pat. No. 2,694,716 (Allen), azaindenes as described in U.S. Pat. No. 2,886,437 (Piper), triazaindolizines as described in U.S. Pat. No. 2,444,605 (Heimbach), the urazoles described in U.S. Pat. No. 3,287,135 (Anderson), sulfocatechols as described in U.S. Pat. No. 3,235,652 (Kennard), the oximes described in GB 623,448 (Carrol et al.), polyvalent metal salts as described in U.S. Pat. No. 2,839,405 (Jones), thiuronium salts as described in U.S. Pat. No. 3,220,839 (Herz), palladium, platinum and gold salts as described in U.S. Pat. No. 2,566,263 (Trirelli) and U.S. Pat. No. 2,597,915 (Damshroder), compounds having —$SO_2CBr_3$ groups as described, for example, in U.S. Pat. No. 5,594,143 (Kirk et al.) and U.S. Pat. No. 5,374,514 (Kirk et al.), and 2-(tribromomethylsulfonyl)quinoline compounds as described in U.S. Pat. No. 5,460,938 (Kirk et al.), all incorporated herein by reference.

Stabilizer precursor compounds capable of releasing stabilizers upon application of heat during development can also be used. Such precursor compounds are described in for example, U.S. Pat. No. 5,158,866 (Simpson et al.), U.S. Pat. No. 5,175,081 (Krepski et al.), U.S. Pat. No. 5,298,390 (Sakizadeh et al.) and U.S. Pat. No. 5,300,420 (Kenney et al.).

In addition, certain substituted-sulfonyl derivatives of benzotriazoles (for example, alkylsulfonylbenzotriazoles and arylsulfonylbenzotriazoles) have been found to be useful stabilizing compounds (such as for post-processing print stabilizing), as described in U.S. Pat. No. 6,171,767 (Kong et al.), incorporated herein by reference.

Furthermore, specific useful antifoggants/stabilizers are described in more detail in U.S. Pat. No. 6,083,681 (Lynch et al.), incorporated herein by reference.

Other antifoggants are hydrobromic acid salts of heterocyclic compounds (such as pyridinium hydrobromide perbromide) as described, for example, in U.S. Pat. No. 5,028,523 (Skoug), benzoyl acid compounds as described, for example, in U.S. Pat. No. 4,784,939 (Pham), substituted propenenitrile compounds as described, for example, in U.S. Pat. No. 5,686,228 (Murray et al.), silyl blocked compounds as described, for example, in U.S. Pat. No. 5,358,843 (Sakizadeh et al.), vinyl sulfones as described, for example, in U.S. Pat. No. 6,143,487 (Philip, Jr. et al.), diisocyanate compounds as described, for example in EP-A-0 600,586 (Philip, Jr. et al.), and tribromomethylketones as described, for example, in EP-A-0 600,587 (Oliff et al.).

Preferably, the photothermographic materials of this invention include one or more polyhalo antifoggants that include one or more polyhalo substituents including but not limited to, dichloro, dibromo, trichloro, and tribromo groups. The antifoggants can be aliphatic, alicyclic or aromatic compounds, including aromatic heterocyclic and carbocyclic compounds.

Particularly useful antifoggants are polyhalo antifoggants, such as those having a $—SO_2C(X^1)_3$ group wherein X' represents the same or different halogen atoms. Most particularly, X' represents a bromine atom.

The use of "toners" or derivatives thereof that improve the image is highly desirable. Toners are compounds that when added to the photothermographic imaging layer shift the color of the developed silver image from yellowish-orange to dark brown-black/blue-black. Preferably, if used, a toner can be present in the one or more imaging layers in an amount of about 0.01% by weight to about 10%, and more preferably about 0.1% by weight to about 10% by weight, based on the total dry weight of the layer in which it is included. Toners may be incorporated in the photothermographic emulsion layer or in an adjacent layer. Toners are well known materials in the photothermographic art, as shown in U.S. Pat. No. 3,080,254 (Grant, Jr.), U.S. Pat. No. 3,847,612 (Winslow), U.S. Pat. No. 4,123,282 (Winslow), U.S. Pat. No. 4,082,901 (Laridon et al.), U.S. Pat. No. 3,074,809 (Owen), U.S. Pat. No. 3,446,648 (Workman), U.S. Pat. No. 3,844,797 (Willems et al.), U.S. Pat. No. 3,951,660 (Hagemann et al.), U.S. Pat. No. 5,599,647 (Defieuw et al.) and GB 1,439,478 (AGFA).

Examples of toners include but are not limited to phthalimide and N-hydroxyphthalimide, cyclic imides (such as succinimide), pyrazoline-5-ones, quinazolinone, 1-phenylurazole, 3-phenyl-2-pyrazoline-5-one, and 2,4-thiazolidinedione, naphthalimides (such as N-hydroxy-1,8-naphthalimide), cobalt complexes [such as hexaamminecobalt(3+) trifluoroacetate], mercaptans (such as 3-mercapto-1,2,4-triazole, 2,4-dimercaptopyrimidine, 3-mercapto-4,5-diphenyl-1,2,4-triazole and 2,5-dimercapto-1,3,4-thiadiazole), N-(aminomethyl)aiyldicarboximides [such as (N,N-dimethylaminomethyl)phthalimide, and N-(dimethylaminomethyl)naphthalene-2,3-dicarboximide, a combination of blocked pyrazoles, isothiuronium derivatives, and certain photobleach agents [such as a combination of N,N'-hexamethylene-bis(1-carbamoyl-3,5-dimethylpyrazole), 1,8-(3,6-diazaoctane)bis(isothiuronium) trifluoroacetate, and 2-(tribromomethylsulfonyl benzothiazole)], merocyanine dyes (such as 3-ethyl-5-[(3-ethyl-2-benzothiazolinylidene)-1-methyl-ethylidene]-2-thio-2,4-o-azolidinedione), phthalazine and derivatives thereof [such as those described in U.S. Pat. No. 6,146,822 (Asanuma et al.)], phthalazinone and phthalazinone derivatives, or metal salts or these derivatives (such as 4-(1-naphthyl)phthalazinone, 6-chlorophthalazinone, 5,7-dimethoxyphthalazinone, and 2,3-dihydro-1,4-phthalazinedione), a combination of phthalazine (or derivative thereof) plus one or more phthalic acid derivatives (such as phthalic acid, 4-methylphthalic acid, 4-nitrophthalic acid, and tetrachlorophthalic anhydride), quinazolinediones, benzoxazine or naphthoxazine derivatives, rhodium complexes functioning not only as tone modifiers but also as sources of halide ion for silver halide formation in-situ [such as ammonium hexachlororhodate(3+), rhodium bromide, rhodium nitrate, and potassium hexachlororhodate(3+)], benzoxazine-2,4-diones (such as 1,3-benzoxazine-2,4-dione, 8-methyl-1,3-benzoxazine-2,4-dione and 6-nitro-1,3-benzoxazine-2,4-dione), pyrimidines and asym-triazines (such as 2,4-dihydroxypyrimidine, 2-hydroxy-4-aminopyrimidine and azauracil) and tetraazapentalene derivatives (such as 3,6-dimercapto-1,4-diphenyl-1H,4H-2,3a,5,6a-tetraazapentalene and 1,4-di-(o-chlorophenyl)-3,6-dimercapto-1H,4H-2,3a,5,6a-tetraazapentalene).

Phthalazine and phthalazine derivatives [such as those described in U.S. Pat. No. 6,146,822 (noted above), incorporated herein by reference] as well as phthalazinone and phthalazinone derivatives, are particularly useful toners.

Binders

The photocatalyst (such as photosensitive silver halide), the non-photosensitive source of reducible silver ions, the reducing agent composition, and any other additives used in the present invention are generally added to one or more binders that are either hydrophilic or hydrophobic. Thus, either aqueous or solvent-based formulations can be used to prepare the photothermographic materials of this invention. Mixtures of either or both types of binders can also be used. It is preferred that the binder be selected from hydrophobic polymeric materials, such as, for example, natural and synthetic resins that are sufficiently polar to hold the other ingredients in solution or suspension.

Examples of typical hydrophobic binders include, but are not limited to, polyvinyl acetals, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers and other materials readily apparent to one skilled in the art. Copolymers (including terpolymers) are also included in the definition of polymers. The polyvinyl acetals (such as polyvinyl butyral and polyvinyl formal) and vinyl copolymers (such as polyvinyl acetate and polyvinyl chloride) are particularly preferred. Particularly suitable binders are polyvinyl butyral resins that are available as BUTVAR B79 (Solutia, Inc.) and PIOLOFORM BS-18 or PIOLOFORM BL-16 (Wacker Chemical Company). Aqueous dispersions (or latices) of hydrophobic binders may also be used.

Examples of useful hydrophilic binders include, but are not limited to, proteins and protein derivatives, gelatin and gelatin-like derivatives (hardened or unhardened, including alkali- and acid-treated gelatins, acetylated gelatin, oxidized gelatin, phthalated gelatin, and deionized gelatin), cellulosic materials such as hydroxymethyl cellulose and cellulosic esters, acrylamide/methacrylamide polymers, acrylic/methacrylic polymers polyvinyl pyrrolidones, polyvinyl alcohols, poly(vinyl lactams), polymers of sulfoalkyl acrylate or methacrylates, hydrolyzed polyvinyl acetates, polyacrylamides, polysaccharides (such as dextrans and starch ethers), and other synthetic or naturally occurring polymers commonly known for use in aqueous-based photographic emulsions (see for example, *Research Disclosure*, item 38957, noted above). Cationic starches can be used as peptizers for tabular silver halide grains as described in U.S. Pat. No. 5,620,840 (Maskasky) and U.S. Pat. No. 5,667,955 (Maskasky).

Hardeners for various binders may be present if desired. Useful hardeners are well known and include diisocyanate compounds as described for example, in EP-0 600 586B1, vinyl sulfone compounds as described in U.S. Pat. No. 6,143,487, and aldehydes and various other hardeners as described in U.S. Pat. No. 6,190,822 (Dickerson et al.). The hydrophilic binders used in the photothermographic materials are generally partially or fully hardened using any conventional hardener. Useful hardeners are well known and are described, for example, in T. H. James, *The Theory of the Photographic Process*, Fourth Edition, Eastman Kodak Company, Rochester, N.Y., 1977, Chapter 2, pp. 77–8.

Where the proportions and activities of the photothermographic materials require a particular developing time and temperature, the binder(s) should be able to withstand those conditions. When a hydrophobic binder is used, it is preferred that the binder does not decompose or lose its structural integrity at 120° C. for 60 seconds. When a hydrophilic binder is used it is preferred that it not lose its structural integrity at 150° C. for 60 seconds. It is more preferred that the binder not be decomposed or lose its structural integrity at 177° C. for 60 seconds.

The polymer binder(s) is used in an amount sufficient to carry the components dispersed therein. The effective range of amount of polymer can be appropriately determined by one skilled in the art. Preferably, a binder is used at a level of about 10% by weight to about 90% by weight, and more preferably at a level of about 20% by weight to about 70% by weight, based on the total dry weight of the layer in which it is included.

Support Materials

The photothermographic materials of this invention comprise a polymeric support that is preferably a flexible, transparent film that has any desired thickness and is composed of one or more polymeric materials, depending upon their use. The supports are generally transparent (especially if the material is used as a photomask) or at least translucent, but in some instances, opaque supports may be useful. They are required to exhibit dimensional stability during thermal development and to have suitable adhesive properties with overlying layers. Useful polymeric materials for making such supports include, but are not limited to, polyesters (such as polyethylene terephthalate and polyethylene naphthalate), cellulose acetate and other cellulose esters, polyvinyl acetal, polyolefins (such as polyethylene and polypropylene), polycarbonates, and polystyrenes (and polymers of styrene derivatives). Preferred supports are composed of polymers having good heat stability, such as polyesters and polycarbonates. Support materials may also be treated or annealed to reduce shrinkage and promote dimensional stability. Polyethylene terephthalate film is a particularly preferred support. Various support materials are described, for example, in *Research Disclosure*, August 1979, item 18431. A method of making dimensionally stable polyester films is described in *Research Disclosure*, September 1999, item 42536.

Opaque supports can also be used, such as dyed polymeric films and resin-coated papers that are stable to high temperatures.

Support materials can contain various colorants, pigments, antihalation or acutance dyes if desired. Support materials may be treated using conventional procedures (such as corona discharge) to improve adhesion of overlying layers, or subbing or other adhesion-promoting layers can be used. Useful subbing layer formulations include those conventionally used for photographic materials such as vinylidene halide polymers.

Photothermographic Formulations

The formulation for the photothermographic emulsion layer(s) can be prepared by dissolving and dispersing the binder, the photocatalyst, the non-photosensitive source of reducible silver ions, the reducing composition, and optional addenda in an organic solvent, such as toluene, 2-butanone (methyl ethyl ketone), acetone, or tetrahydrofuran.

Alternatively, these components can be formulated with a hydrophilic binder in water or water-organic solvent mixtures to provide aqueous-based coating formulations.

Photothermographic materials of this invention can contain plasticizers and lubricants such as polyalcohols and diols of the type described in U.S. Pat. No. 2,960,404 (Milton et al.), fatty acids or esters such as those described in U.S. Pat. No. 2,588,765 (Robijns) and U.S. Pat. No. 3,121,060 (Duane), and silicone resins such as those described in GB 955,061 (DuPont). The materials can also contain matting agents such as starch, titanium dioxide, zinc oxide, silica, and polymeric beads, including beads of the type described in U.S. Pat. No. 2,992,101 (Jelley et al.) and U.S. Pat. No. 2,701,245 (Lynn). Polymeric fluorinated surfactants may also be useful in one or more layers of the imaging materials for various purposes, such as improving coatability and optical density uniformity as described in U.S. Pat. No. 5,468,603 (Kub).

EP-A-0 792 476 (Geisler et al.) describes various means of modifying the photothermographic materials to reduce what is known as the "woodgrain" effect, or uneven optical density. This effect can be reduced or eliminated by several means, including treatment of the support, adding matting agents to the topcoat, using acutance dyes in certain layers, or other procedures described in the noted publication.

The photothermographic materials of this invention can include antistatic or conducting layers. Such layers may contain soluble salts (for example, chlorides or nitrates), evaporated metal layers, or ionic polymers such as those described in U.S. Pat. No. 2,861,056 (Minsk) and U.S. Pat. No. 3,206,312 (Sterman et al.), or insoluble inorganic salts such as those described in U.S. Pat. No. 3,428,451 (Trevoy), electroconductive underlayers such as those described in U.S. Pat. No. 5,310,640 (Markin et al.), electronically-conductive metal antimonate particles such as those described in U.S. Pat. No. 5,368,995 (Christian et al.), and electrically-conductive metal-containing particles dispersed in a polymeric binder such as those described in EP-A-0 678 776 (Melpolder et al.). Other antistatic agents are well known in the art.

The photothermographic materials of this invention can be constructed of one or more layers on a support. Single layer materials should contain the photocatalyst, the non-photosensitive source of reducible silver ions, the reducing composition, the binder, as well as optional materials such as toners, acutance dyes, coating aids and other adjuvants.

Two layer constructions comprising a single imaging layer coating containing all the ingredients and a surface protective topcoat are generally found in the materials of this invention. However, two-layer constructions containing photocatalyst and non-photosensitive source of reducible silver ions in one imaging layer (usually the layer adjacent to the support) and the reducing composition and other ingredients in the second imaging layer or distributed between both layers are also envisioned.

Layers to promote adhesion of one layer to another in photothermographic materials are also known, as described for example, in U.S. Pat. No. 5,891,610 (Bauer et al.), U.S. Pat. No. 5,804,365 (Bauer et al.) and U.S. Pat. No. 4,741,992 (Przezdziecki). Adhesion can also be promoted using specific polymeric adhesive materials as described for example, in U.S. Pat. No. 5,928,857 (Geisler et al.).

Layers to reduce emissions from the film may also be present, including the polymeric barrier layers described in copending U.S. Ser. No. 09/728,416 (filed Dec. 1, 2000 by Kenney, Skoug, Ishida, and Wallace), U.S. Ser. No. 09/821,983 (filed Mar. 30, 2001 by Bauer, Horch, Miller, Yacobucci, and Ishida), and U.S. Ser. No. 09/916,366 (filed Jul. 27, 2001 by Bauer, Horch, Miller, Teegarden, Hunt, and Sakizadeh), all incorporated herein by reference.

Photothermographic formulations described herein can be coated by various coating procedures including wire wound rod coating, dip coating, air knife coating, curtain coating, slide coating, or extrusion coating using hoppers of the type described in U.S. Pat. No. 2,681,294 (Beguin). Layers can be coated one at a time, or two or more layers can be coated simultaneously by the procedures described in U.S. Pat. No. 2,761,791 (Russell), U.S. Pat. No. 4,001,024 (Dittman et al.), U.S. Pat. No. 4,569,863 (Keopke et al.), U.S. Pat. No. 5,340,613 (Hanzalik et al.), U.S. Pat. No. 5,405,740 (LaBelle), U.S. Pat. No. 5,415,993 (Hanzalik et al.), U.S. Pat. No. 5,525,376 (Leonard), U.S. Pat. No. 5,733,608 (Kessel et al.), U.S. Pat. No. 5,849,363 (Yapel et al.), U.S. Pat. No. 5,843,530 (Jerry et al.), U.S. Pat. No. 5,861,195 (Bhave et al.) and GB 837,095 (Ilford). A typical coating gap for the emulsion layer can be from about 10 to about 750 $\mu$m, and the layer can be dried in forced air at a temperature of from about 20° C. to about 100° C. It is preferred that the thickness of the layer be selected to provide maximum image densities greater than about 0.2, and more preferably, from about 0.5 to 5.0 or more, as measured by a MacBeth Color Densitometer Model TD 504.

When the layers are coated simultaneously using various coating techniques, a "carrier" layer formulation comprising a single-phase mixture of the two o01 more polymers, described above, may be used. Such formulations are described in copending and commonly assigned U.S. Ser. No. 09/510,648 filed Feb. 23, 2000 by Ludemann, LaBelle, Geisler, WarTen, Crump, and Bhave).

Mottle and other surface anomalies can be reduced in the materials of this invention by incorporation of a fluorinated polymer as described for example, in U.S. Pat. No. 5,532, 121 (Yonkoski et al.) or by using particular drying techniques as described, for example, in U.S. Pat. No. 5,621,983 (Ludemann et al.).

Preferably, two or more layers are applied to a film support using slide coating. The first layer can be coated on top of the second layer while the second layer is still wet. The first and second fluids used to coat these layers can be the same or different organic solvents (or organic solvent mixtures).

While the first and second layers can be coated on one side of the film support, a manufacturing method can also include forming on the opposing or backside of said polymeric support, one or more additional layers, including an antihalation layer, an antistatic layer, or a layer containing a matting agent (such as silica), or a combination of such layers.

It is also contemplated that the photothermographic materials of this invention can include emulsion layers on both sides of the support and at least one infrared radiation absorbing heat-bleachable compositions as an antihalation underlayer beneath at least one emulsion layer.

To promote image sharpness, photothermographic materials according to the present invention can contain one or more layers containing acutance and/or antihalation dyes. These dyes are chosen to have absorption close to the exposure wavelength and are designed to absorb scattered light. One or more antihalation dyes may be incorporated into one or more antihalation layers according to known techniques, as an antihalation backing layer, as an antihalation underlayer, or as an antihalation overcoat. Additionally, one or more acutance dyes may be incorporated into one or more frontside layers such as the phototheimographic emulsion layer, primer layer, underlayer, or topcoat layer according to known techniques. It is preferred that the photothermographic materials of this invention contain an antihalation coating on the support opposite to the side on which the emulsion and topcoat layers are coated.

Dyes useful as antihalation and acutance dyes include squaraine dyes described in U.S. Pat. No. 5,380,635 (Gomez et al.), U.S. Pat. No. 6,063,560 (Suzuki et al.), and EP 1 083 459 A1 (Kimura), the indolenine dyes described in EP-A 0342 810 (Leichter), and the cyanine dyes described in U.S. Ser. No. 10/011,892 (filed Dec. 5, 2001 by Hunt, Kong, Ramsden, and LaBelle). All of the above are incorporated herein by reference.

It is also useful in the present invention to employ compositions including acutance or antihalation dyes that will decolorize or bleach with heat during processing. Dyes and constructions employing these types of dyes are described in, for example, U.S. Pat. No. 5,135,842 (Kitchin et al.), U.S. Pat. No. 5,266,452 (Kitchin et al.), U.S. Pat. No. 5,314,795 (Helland et al.), U.S. Pat. No. 6,306,566, (Sakurada et al.), U.S. Published Application 2001-0001704 (Sakurada et al.), JP 2001-142175 (Hanyu et al.), and JP 2001-183770 (Hanye et al.). Also useful are bleaching compositions described in JP 11-302550 (Fujiwara), JP 2001-109101 (Adachi), JP 2001-51371 (Yabuki et al.), and JP 2000-029168 (Noro). All of the above are incorporated herein by reference.

Particularly useful heat-bleachable backside antihalation compositions can include an infrared radiation absorbing compound such as an oxonol dyes and various other compounds used in combination with a hexaarylbiimidazole (also known as a "HABI"), or mixtures thereof. Such HABI compounds are well known in the art, such as U.S. Pat. No. 4,196,002 (Levinson et al.), U.S. Pat. No. 5,652,091 (Perry et al.), and U.S. Pat. No. 5,672,562 (Perry et al.), all incorporated herein by reference. Examples of such heat-bleachable compositions are described for example in copending and commonly assigned U.S. Ser. No. 09/875, 772 (filed Jun. 6, 2001 by Goswami, Ramsden, Zielinski, Baird, Weinstein, Helber, and Lynch) and U.S. Ser. No. 09/944,573 (filed Aug. 31, 2001 by Ramsden and Baird) both incorporated herein by reference.

Under practical conditions of use, the compositions are heated to provide bleaching at a temperature of at least 90° C. for at least 0.5 seconds. Preferably, bleaching is carried out at a temperature of from about 100° C. to about 200° C. for from about 5 to about 20 seconds. Most preferred bleaching is carried out within 20 seconds at a temperature of from about 110° C. to about 130° C.

In preferred embodiments, the photothermographic materials of this invention include a surface protective layer on the same side of the support as the one or more thermally-developable layers, an antihalation layer on the opposite side of the support, or both a surface protective layer and an antihalation layer on their respective sides of the support.

Imaging/development

Generally, the materials are sensitive to radiation in the range of from about 300 to about 850 nm. In a preferred embodiment, the photothermographic materials are sensitive to radiation in the range of from about at least 300 nm to about 700 nm.

Imaging can be achieved by exposing the photothermographic materials of this invention to a suitable source of radiation to which they are sensitive, including ultraviolet radiation, visible light, near infrared radiation and infrared radiation to provide a latent image. Suitable exposure means are well known and include sources of radiation, including:

incandescent or fluorescent lamps, xenon flash lamps, lasers, laser diodes, light emitting diodes, infrared lasers, infrared laser diodes, infrared light-emitting diodes, infrared lamps, or any other ultraviolet, visible, or infrared radiation source readily apparent to one skilled in the art, and others described in the art, such as in *Research Disclosure*, September, 1996, item 38957. Particularly useful infrared exposure means include laser diodes, including laser diodes that are modulated to increase imaging efficiency using what is known as multi-longitudinal exposure techniques as described in U.S. Pat. No. 5,780,207 (Mohapatra et al.). Other exposure techniques are described in U.S. Pat. No. 5,493,327 (McCallum et al.).

Thermal development conditions will vary, depending on the construction used but will typically involve heating the imagewise exposed material at a suitably elevated temperature. Thus, the latent image can be developed by heating the exposed material at a moderately elevated temperature of, for example, from about 50° C. to about 250° C. (preferably from about 80° C. to about 200° C. and more preferably from about 100° C. to about 200° C.) for a sufficient period of time, generally from about 1 to about 120 seconds. Heating can be accomplished using any suitable heating means such as a hot plate, a steam iron, a hot roller or a heating bath.

In some methods, the development is carried out in two steps. Thermal development takes place at a higher temperature for a shorter time (for example, at about 150° C. for up to 10 seconds), followed by thermal diffusion at a lower temperature (for example, at about 80° C.) in the presence of a transfer solvent.

Use as a Photomask

The photothermographic materials of the present invention are sufficiently transmissive in the range of from about 350 to about 450 nm in non-imaged areas to allow their use in a process where there is a subsequent exposure of an ultraviolet or short wavelength visible radiation sensitive imageable medium. For example, imaging the photothermographic material of this invention and subsequent development affords a visible image. This heat-developed photothermographic material absorbs ultraviolet or short wavelength visible radiation in the areas where there is a visible image and transmits ultraviolet or short wavelength visible radiation where there is no visible image. The heat-developed material may then be used as a mask and positioned between a source of imaging radiation (such as an ultraviolet or short wavelength visible radiation energy source) and an imageable material that is sensitive to such imaging radiation, such as a photopolymer, diazo material, photoresist, or photosensitive printing plate. Exposing the imageable material to the imaging radiation through the visible image in the exposed and heat-developed photothermographic material provides an image in the imageable material. This process is particularly useful where the imageable medium comprises a printing plate and the photothermographic material serves as an imagesetting film.

The present invention also provides a method for the formation of a visible image (usually a black-and-white image) by first exposing to electromagnetic radiation and thereafter heating the inventive photothermographic material. In one embodiment, the present invention provides a method comprising:

A) imagewise exposing the photothermographic materials of this invention to electromagnetic radiation to which the photocatalyst (for example, a photosensitive silver halide) of the material is sensitive, to form a latent image, and B) simultaneously or sequentially, heating the exposed photothermographic material to develop the latent image into a visible image.

The photothermographic material may be exposed in step A using any source of radiation to which it is sensitive, including ultraviolet radiation, visible light, near infrared radiation, infrared radiation, or any other radiation source readily apparent to one skilled in the art.

This visible image can also be used as a mask for exposure of other photosensitive imageable materials, such as graphic arts films, proofing films, printing plates and circuit board films, that are sensitive to suitable imaging radiation (for example, UV radiation). This can be done by imaging an imageable material (such as a photopolymer, a diazo material, a photoresist, or a photosensitive printing plate) through the exposed and heat-developed photothermographic material. Thus, in some other embodiments wherein the photothermographic material comprises a transparent support, the image-forming method further comprises:

C) positioning the exposed and heat-developed photothermographic material with the visible image therein between a source of imaging radiation and an imageable material that is sensitive to the imaging radiation, and D) thereafter exposing the imageable material to the imaging radiation through the visible image in the exposed and heat-developed photothermographic material to provide an image in the imageable material.

The following examples are provided to illustrate the practice of this invention, and are not intended to be limiting in any manner. The examples provide exemplary synthetic procedures and preparatory procedures using the selenium speed increasing compounds within the scope of the present invention.

Materials and Methods for the Examples

All materials used in the following examples are readily available from standard commercial sources, such as Aldrich Chemical Co. (Milwaukee Wisconsin) unless otherwise specified. All percentages are by weight unless otherwise indicated. The following additional terms and materials were used.

ACRYLOID A-21 is an acrylic copolymer available from Rohm and Haas (Philadelphia, Pa.).

BUTVAR B-79 is a polyvinyl butyral resin available from Solutia, Inc. (St. Louis, Mo.).

CBBA is 2-(4-chlorobenzoyl) benzoic acid [CAS RN=85-56-3].

CAB 171-15S is a cellulose acetate butyrate resin available from Eastman Chemical Company (Kingsport, Tenn.).

DESMODUR N3300 is an aliphatic hexamethylene diisocyanate available from Bayer Chemicals (Pittsburgh, Pa.).

PERMANAX WSO (or NONOX) is ],1-bis(2-hydroxy-3,5-dimethylphenyl)-3,5,5-trimethylhexane [CAS RN=7292-14-0] and is available from St-Jean PhotoChemicals, Inc. (Quebec, Canada).

PHP is pyridinium hydrobromide perbromide.

MEK is methyl ethyl ketone (or 2-butanone).

Dye A is

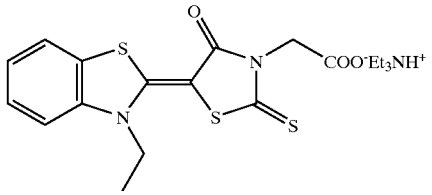

Sensitizing Dye A is

SSD-A

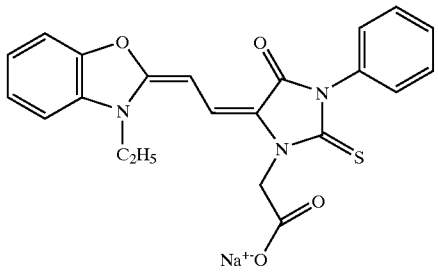

Sensitizing Dye B is

SSD-B

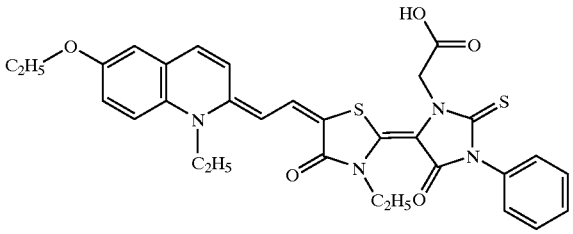

$[Au(TPYR)Cl]Cl_2$ is gold(3+) 2,2',2"-terpyridine trichloride. It is described in L. Hollis et al., *J. Am. Chem. Soc.*, 1983, 105, 4293 and has the structure shown below.

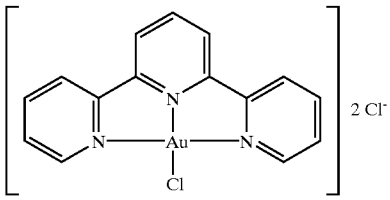

$[Au(TPYR)Cl]Cl_2$ $Te(TMTU)_2Cl_4$ is [bis-(tetranethylthiourea)tetrachlorotellurium(4+)]. It is described in U.S. Ser. No. 09/746,400 (noted above), and can be prepared as described in O. Foss and W. Johannessen, *Acta Chem. Scand.*, 1961, 15, 1939.

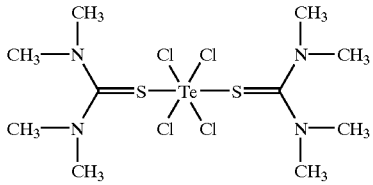

$Te(TMTU)_2Cl_4$

Compound HC-1 is described in U S. Pat. No. 5,545,515 (noted above) and has the following structure:

HC-1

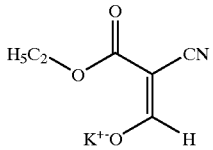

Vinyl Sulfone-1 (VS-1) is described in U.S. Pat. No. 6,143,487 and has the following structure:

VS-1

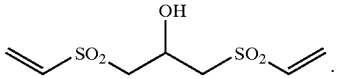

Antifoggant A is 2-(tribromomethylsulfonyl)quinoline and has the following structure:

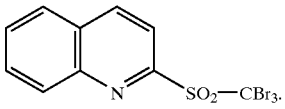

Antifoggant B is:

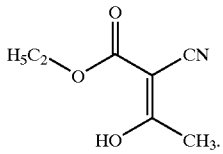

Backcoat Dye BC-1 is cyclobutenediylium, 1,3-bis[2,3-dihydro-2,2-bis[[1-oxohexyl)oxy]methyl]-1H-perimidin-4-yl]-2,4-dihydroxy-, bis(inner salt), It is believed to have the structure shown below.

BC-1

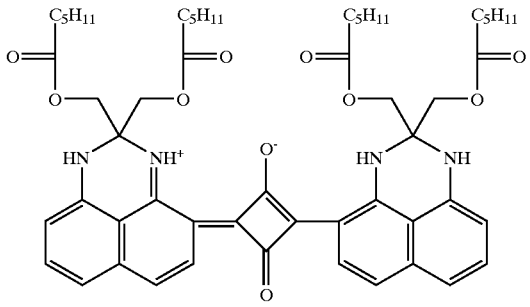

Comparative Compound C-1 can be represented by the structure:

C-1

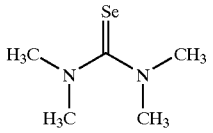

Densitometry measurements were made on a custom built computer-scanned densitometer using a filter appropriate to the sensitivity of the photothermographic material and are believed to be comparable to measurements from commercially available densitometers. Dmin is the density of the non-exposed areas after development and it is the average of the eight lowest density values. "SP-2" is Log(1/E)+4, corresponding to the density value of 1.00 above $D_{min}$ where E is the exposure in ergs/cm$^2$. "SP-3" is Log(1/E)+4, corresponding to the density value of 2.90 above $D_{min}$ where E is the exposure in ergs/cm$^2$. "Con-D" is the absolute value of the slope of the line joining the density points at 1.00 and 3.00 above $D_{min}$.

EXAMPLE 1

This example demonstrates the effect of selenium chemical sensitizers in photothermographic materials prepared using preformed 0.065 $\mu$m iridium-doped core-shell silver halide grains prepared as described in U.S. Pat. No. 5,434,043 (noted above). The silver halide grains were sensitized using red sensitizing dye B. All of the materials incorporated high contrast agent HC-1 and contained 2-mercaptobenzoxazole ("MBO") as a mercapto additive. All of the materials provided a "Con-D" greater than 10.

Photothermographic Emulsion Formulation

To 182 g of a silver soap dispersion containing 46 g of preformed silver carboxylate were added:

| | |
|---|---|
| MEK | 8 g |
| PHP | 0.25 g in 0.76 g of methanol |
| Zinc bromide | 0.29 g in 0.77 g of methanol |
| Chemical sensitizer | (see TABLE I below) |
| Dye premix | (see below for formulation) |
| BUTVAR ™ B-79 | 31.8 g |
| Antifoggant A | 1.6 g in 21.35 g of MEK |
| DESMODUR N3300 | 0.49 g in 0.98 g of MEK |
| Phthalazine | 1.2 g in 5.65 g of MEK |

-continued

| | |
|---|---|
| Tetrachlorophthalic acid | 0.27 g in 0.54 g of MEK and 0.54 g of methanol |
| 4-Methylphthalic acid | 0.60 g in 0.47 g of methanol and 4.52 g of MEK |
| PERMANAX WSO | 12.0 g |
| HC-1 high contrast agent | 0.22 g in 3.7 g of methanol |

Dye Premix Formulation

A dye premix formulation was prepared by mixing the following ingredients.

| | |
|---|---|
| Sensitizing Dye B (SSD-B) | ($2.368 \times 10^{-5}$ mol) |
| CBBA | 2.32 g |
| MBO | 0.014 g |
| Methanol | 9.82 g |

Protective topcoat Formulation

A protective topcoat for the photothermographic emulsion layer was prepared as follows:

| | |
|---|---|
| ACRYLOID ™ A-21 polymer | 0.65 g |
| CAB 171-15S | 16.8 g |
| MEK | 217.6 g |
| Methanol | 14.2 g |
| VS-1 | 0.99 g |

The photothermographic emulsion and topcoat formulations were coated under safelight conditions onto a 4 mil (102 $\mu$m) polyethylene terephthalate support provided with an antihalation backcoat comprising a dye that has an absorbance >1.0 at the wavelength of exposure (670 nm), using a dual knife coating machine. Coating and drying were carried out as described in U.S. Pat. No. 6,083,681 (noted above), incorporated herein by reference. Samples were dried for 5 minutes at 82° C.

The resulting photothermographic materials were imagewise exposed using a scanning laser sensitometer having a 670 nm laser diode. The materials were then developed using a heated roller processor for 13 seconds at 118° C.

The sensitometric results, shown below in TABLE I, demonstrate an increase in speed with virtually no increase in $D_{min}$ upon incorporation of selenium chemical sensitizers into the photothermographic emulsion. Changes (Δ) in $D_{min}$ and SP-3 are relative to a control photothermographic material from which the chemical sensitizer was omitted, but otherwise prepared identically to the invention materials.

TABLE I

| Sample | Chemical Sensitizer | Amount (moles) | Δ $D_{min}$ | Δ SP-3 | Comment |
|---|---|---|---|---|---|
| 1-1 | I-39 | $2.8 \times 10^{-6}$ | 0.005 | 0.894 | Invention |
| 1-2 | I-43 | $5.9 \times 10^{-6}$ | 0.003 | 0.835 | Invention |
| 1-3 | I-22 | $5.9 \times 10^{-6}$ | 0.003 | 0.610 | Invention |
| 1-4 | I-37 | $6.6 \times 10^{-6}$ | 0.009 | 0.892 | Invention |
| 1-5 | I-38 | $3.3 \times 10^{-6}$ | 0.027 | 0.989 | Invention |
| 1-6 | II-5 | $1.4 \times 10^{-6}$ | 0.006 | 0.226 | Invention |
| 1-7 | II-4 | $4.1 \times 10^{-6}$ | 0.016 | 0.580 | Invention |
| 1-8 | II-6 | $2.8 \times 10^{-6}$ | 0.039 | 0.448 | Invention |

TABLE I-continued

| Sample | Chemical Sensitizer | Amount (moles) | Δ $D_{min}$ | Δ SP-3 | Comment |
|---|---|---|---|---|---|
| 1-9 | III-1 | $4.3 \times 10^{-6}$ | 0.003 | 0.474 | Invention |
| 1-10 | C-1 | $1.31 \times 10^{-5}$ | High Fog | | Comparison |

EXAMPLE 2

This example demonstrates the use of selenium compounds as chemical sensitizers in UV-sensitive photothermographic materials.

A silver carboxylate soap dispersion was prepared incorporating preformed non-core-shell silver halide grains grown in the presence of phenyl mercaptotetrazole (0.25 g/mole of AgX), as described in U.S. Ser. No. 09/833,533 (noted above) and incorporated herein by reference. The average silver halide grain size was 0.12 μm.

Preparation of Photothermographic Emulsion: A photothermographic emulsion was prepared from the photosensitive silver soap dispersion prepared above.

To 194.2 g of the silver soap dispersion at 23.6% solids was added in order:

| | |
|---|---|
| PHP | 0.2 g in 1.58 g of methanol |
| Calcium bromide | 0.15 g in 1.19 g of methanol |
| Chemical sensitizer I-39 | $22.3 \times 10^{-6}$ moles or $8.8 \times 10^{-6}$ moles in 5.0 g of methanol |
| CBBA | 1.42 g |
| BUTVAR B-79 | 20.0 g |
| Antifoggant A | 0.6 g in 10.0 g MEK |
| PERMANAX WSO | 10.6 g |
| DESMODUR N3300 | 0.63 g in 1.5 g MEK |
| Tetrachlorophthalic acid | 0.35 g in 2.0 g of MEK |
| Phthalazine | 1.0 g in 5.0 g of MEK |
| 4-Methylphthalic acid | 0.45 g in 4.0 g of MEK |

Protective Topcoat Formulation

A protective topcoat for the photothermographic emulsion layer was prepared by mixing the following ingredients.

| | |
|---|---|
| ACRYLOID A-21 | 0.92 g |
| CAB 171-15S | 23.9 g |
| MEK | 293.8 g |
| Benzotriazole | 1.28 g |
| Antifoggant B | 0.19 g |
| VS-1 | 0.24 g |

The photothermographic emulsions and topcoat formulations were coated under safelight conditions using a dual knife coating machine onto a 7 mil (178 μm) blue-tinted polyethylene terephthalate support provided with a backside antihalation layer comprising dye BC-1 in CAB 171-15S resin binder. Coating and drying were carried out as described in U.S. Pat. No. 6,083,681 (noted above), incorporated herein by reference. Samples were dried for 5 minutes at 82° C.

Photothermographic materials were imagewise exposed for $10^{-3}$ seconds using an EG&G Flash Sensitometer with both a P-16 and a neutral density filter attached. Samples were developed on a heated roller processor for 15 seconds at 124° C.

The sensitometric results, shown below in TABLE II, demonstrate an increase in speed with virtually no increase in $D_{min}$ upon incorporation of selenium chemical sensitizers into the photothermographic emulsion. Changes (Δ) in $D_{min}$ and speed are relative to an identically prepared control photothermographic material from which the selenium chemical sensitizer had been omitted.

TABLE II

| Sample | Chemical Sensitizer | Amount (moles) | Δ $D_{min}$ | Δ SP-2 |
|---|---|---|---|---|
| 2-1 | I-39 | $8.8 \times 10^{-6}$ | 0.003 | 0.497 |
| 2-2 | I-39 | $22.3 \times 10^{-6}$ | 0.113 | 0.684 |

EXAMPLE 3

A photothermographic emulsion was prepared as described in Example 2, but 0.005 g of high contrast agent HC-1, was added to 20 g batches of the topcoat solution.

The photothermographic materials were coated, dried, imagewise exposed, and developed as described in Example 2. All samples had an Average Contrast (AC-1) greater than 8.

The sensitometric results, shown below in TABLE III demonstrate an increase in speed with virtually no increase in $D_{min}$ upon incorporation of selenium chemical sensitizers into the photothermographic emulsion. Changes (Δ) in $D_{min}$ and speed are relative to an identically prepared control photothermographic material from which the selenium chemical sensitizer has been omitted.

TABLE III

| Sample | Chemical Sensitizer | Amount (moles) | Δ $D_{min}$ | Δ SP-2 |
|---|---|---|---|---|
| 3-1 | I-39 | $8.8 \times 10^{-6}$ | −0.003 | 0.568 |
| 3-2 | I-39 | $22.3 \times 10^{-6}$ | 0.081 | 0.748 |

EXAMPLE 4

This example demonstrates the use of selenium chemical sensitizers in combination with gold chemical sensitizers in UV-sensitive photothermographic materials.

A silver carboxylate soap dispersion was prepared incorporating preformed non-core-shell silver halide grains grown in the presence of phenyl mercaptotetrazole (0.25 g/mole of AgX), as described in U.S. Ser. No. 09/833,533 and incorporated herein by reference. The average silver halide grain size was 0.12 μm.

This dispersion was used to prepare photothermographic materials as described in Example 1 except that $2.21 \times 10^{-7}$ moles of $[Au(TPYR)Cl]Cl_2$ in 1.25 g of methanol was added after the selenium chemical sensitizer I-39.

Emulsions incorporating $[Au(TPYR)Cl]Cl_2$ as a gold chemical sensitizer are described in U.S. Ser. No. 09/768,094. Samples were prepared both with and without high contrast agent HC-1 in the topcoat.

The photothermographic materials were coated, dried, imagewise exposed and heat developed as described in Example 2.

The sensitometric results, shown below in TABLE IV demonstrate an increase in speed with virtually no increase in $D_{min}$ upon incorporation of both a selenium chemical sensitizer and a gold chemical sensitizer into the photothermographic emulsion. Changes (Δ) in $D_{min}$ and speed are relative to identically prepared control photothermographic materials from which the selenium and gold chemical sensitizers had been omitted.

TABLE IV

| Sample | Chemical Sensitizer | Amount (moles) | HC-1 Present | Δ $D_{min}$ | Δ SP-2 |
|---|---|---|---|---|---|
| 4-1 | I-39 | $8.8 \times 10^{-6}$ | No | 0.054 | 0.884 |
| 4-2 | I-39 | $8.8 \times 10^{-6}$ | Yes | 0.039 | 1.140 |

EXAMPLE 5

This example demonstrates the use of selenium compounds as chemical sensitizers in green-sensitive photothermographic materials.

A silver carboxylate soap dispersion was prepared incorporating preformed non-core-shell silver halide grains grown in the presence of phenyl mercaptotetrazole (0.25 g/mole of AgX), as described in U.S. Ser. No. 09/833,533 and incorporated herein by reference. The average silver halide grain size was 0.12 μm.

Preparation of Photothermographic Emulsion: A photothermographic emulsion was prepared from the photosensitive silver soap dispersion prepared above.

To 190.8 g of the photosensitive silver soap prepared above at 24.2% solids was added in order:

| | |
|---|---|
| PHP | 0.2 g in 1.58 g of methanol |
| Calcium bromide | 0.15 g in 1.19 g of methanol |
| Chemical sensitizer I-39 | $8.8 \times 10^{-6}$ moles in 5.0 g of methanol |
| Spectral Sensitizing Dye Solution | see below |
| BUTVAR B-79 | 20.0 g |
| PERMANAX WSO | 10.6 g |
| DESMODUR N3300 | 0.63 g in 1.5 g MEK |
| Tetrachlorophthalic acid | 0.35 g in 2.0 g of MEK |
| Phthalazine | 1.0 g in 5.0 g of MEK |
| 4-Methylphthalic acid | 0.45 g in 4.0 g of MEK |

Spectral Sensitizing Dye solution for Green Sensitization

A spectral sensitizing dye solution for the photothermographic formulation layer was prepared as follows:

| | |
|---|---|
| SSD-A | $4.75 \times 10^{-5}$ mol |
| CBBA | 1.42 g |
| Methanol | 5.0 g |

Protective Topcoat Formulation

A protective topcoat for the photothermographic formulation layer was prepared as follows:

| | |
|---|---|
| ACRYLOID A-21 | 0.92 g |
| CAB 171-15S | 23.9 g |
| MEK | 293.8 g |
| Benzotriazole | 2.56 g |

-continued

| | |
|---|---|
| Antifoggant B | 0.19 g |
| VS-1 | 0.48 g |

The photothermographic emulsions and topcoat formulations were coated under safelight conditions using a dual knife coater onto a 7 mil (178 μm) blue-tinted polyethylene terephthalate support provided with a backside antihalation layer comprising dye BC-1 in CAB 171-15S resin binder. Samples were dried for 5 minutes at 82° C.

Photothermographic materials were imagewise exposed for $10^{-3}$ seconds using an EG&G Flash Sensitometer with a P-31 filter attached. Samples were developed on a heated roller processor for 15 seconds at 124° C.

The sensitometric results, shown below in TABLE V demonstrate an increase in speed with virtually no increase in $D_{min}$ upon incorporation of selenium chemical sensitizers into the photothermographic emulsion. Changes (Δ) in $D_{min}$ and speed are relative to an identically prepared control photothermographic material from which the selenium chemical sensitizer had been omitted.

TABLE V

| Sample | Chemical Sensitizer | Amount (moles) | Δ $D_{min}$ | Δ SP-2 |
|---|---|---|---|---|
| 5-1 | I-39 | $8.8 \times 10^{-6}$ | 0.007 | 0.323 |

EXAMPLE 6

A photothermographic emulsion was prepared as described in Example 5, but 0.005 g of high contrast agent HC-1, was added to 20 g batches of the topcoat solution.

The photothermographic materials were coated, dried, imagewise exposed, and developed as described in Example 5. All samples had an Average Contrast (AC-1) greater than 8.

The sensitometric results, shown below in TABLE VI demonstrate an increase in speed with virtually no increase in $D_{min}$ upon incorporation of selenium chemical sensitizers into the photothermographic emulsion. Changes (Δ) in $D_{min}$ and speed are relative to an identically prepared control photothermographic material from which the selenium chemical sensitizer has been omitted.

TABLE VI

| Sample | Chemical Sensitizer | Amount (moles) | Δ $D_{min}$ | Δ SP-2 |
|---|---|---|---|---|
| 6-1 | I-39 | $8.8 \times 10^{-6}$ | 0.002 | 0.403 |

EXAMPLE 7

This example demonstrates a green sensitive photothermographic material employing a combination of selenium chemical sensitizing compound and a gold chemical sensitizing compounds described in U.S. Ser. No. 09/768,094.

This dispersion was used to prepare photothermographic materials as described in Example 5 except that $2.21 \times 10^{-7}$ moles of $[Au(TPYR)Cl]Cl_2$ in 1.25 g of methanol was added after the selenium chemical sensitizer I-39. Emulsions incorporating $[Au(TPYR)Cl]Cl_2$ as a gold chemical sensitizer are described in U.S. Ser. No. 09/768,094 (noted above).

Samples were prepared both with and without high contrast agent HC-1 in the topcoat.

The photothermographic materials were coated, dried, imagewise exposed, and heat developed as described above.

The sensitometric results, shown below in TABLE VII demonstrate an increase in speed with virtually no increase in $D_{min}$ upon incorporation of both a selenium chemical sensitizer and a gold chemical sensitizer into the photothermographic emulsion. Changes (Δ) in $D_{min}$ and speed are relative to identically prepared control photothermographic materials from which the selenium and gold chemical sensitizers had been omitted.

TABLE VII

| Sample | Chemical Sensitizer | Amount (moles) | HC-1 Present | Δ $D_{min}$ | Δ SP-2 |
|---|---|---|---|---|---|
| 7-1 | I-39 | $8.8 \times 10^{-6}$ | No | 0.042 | 0.476 |
| 7-2 | I-39 | $8.8 \times 10^{-6}$ | Yes | 0.045 | 0.984 |

EXAMPLE 8

This example demonstrates the use of selenium chemical sensitizers in combination with tellurium chemical sensitizers in red-sensitive photothermographic materials.

A silver carboxylate soap dispersion was prepared incorporating preformed 0.065 μm iridium-doped core-shell silver halide grains as described in U.S. Pat. No. 5,434,043 (noted above).

This dispersion was used to prepare photothermographic materials as described in Example 1 where the selenium chemical sensitizer I-22 was added after the zinc bromide and allowed to mix. Next, $1.6\times10^{-5}$ moles of $Te(TMTU)_2Cl_4$ in 2.10 g of methanol was added and allowed to mix before addition of the dye premix. Emulsions incorporating $Te(TMTU)_2Cl_4$ as a tellurium chemical sensitizer are described in U.S. Ser. No. 09/746,400 (noted above).

The photothermographic materials were coated, dried, imagewise exposed, and heat developed as described in Example 1.

The sensitometric results, shown below in TABLE VIII demonstrate an increase in speed with virtually no increase in $D_{min}$ upon incorporation of both a selenium chemical sensitizer and a tellurium chemical sensitizer into the photothermographic emulsion. Changes (Δ) in $D_{min}$ and speed are relative to identically prepared control photothermographic materials from which the selenium and tellurium chemical sensitizers had been omitted.

TABLE VIII

| Sample | Chemical Sensitizer | Amount (moles) | Δ $D_{min}$ | Δ SP-3 |
|---|---|---|---|---|
| 8-1 | 1-22 | $5.9 \times 10^{-6}$ | 0.057 | 1.363 |

EXAMPLE 9

This example demonstrates the use of selenium chemical sensitizers in combination with tellurium chemical sensitizers in red-sensitive photothermographic materials.

A silver carboxylate soap dispersion was prepared incorporating preformed 0.065 μm iridium-doped core-shell silver halide grains as described in U.S. Pat. No. 5,434,043 (noted above).

This dispersion was used to prepare photothermographic materials as described in Example 1 except that $1.6\times10^{-5}$ moles of $Te(TMTU)_2Cl_4$ and $4.3\times10^{-6}$ moles of selenium chemical sensitizer III-1 in 2.10 g of methanol and 1.61 g of MEK was added. This combined solution was added after the zinc bromide and allowed to mix before the addition of dye premix. Emulsions incorporating $Te(TMTU)_2Cl_4$ as a tellurium chemical sensitizer are described in U.S. Ser. No. 09/746,400 (noted above).

The photothermographic materials were coated, dried, imagewise exposed, and heat developed as described in Example 1.

The sensitometric results, shown below in TABLE IX demonstrate an increase in speed with virtually no increase in $D_{min}$ upon incorporation of both a selenium chemical sensitizer and a tellurium chemical sensitizer into the photothermographic emulsion. Changes (Δ) in $D_{min}$ and speed are relative to identically prepared control photothermographic materials from which the selenium and tellurium chemical sensitizers had been omitted.

TABLE IX

| Sample | Chemical Sensitizer | Amount (moles) | Δ $D_{min}$ | Δ SP-2 |
|---|---|---|---|---|
| 9-1 | III-1 | $4.3 \times 10^{-6}$ | 0.010 | 0.957 |

EXAMPLE 10

This example demonstrates the use of selenium chemical sensitizers in combination with sulfur chemical sensitizers in red-sensitive photothermographic materials.

A silver carboxylate soap dispersion was prepared incorporating preformed 0.065 μm iridium-doped core-shell silver halide grains as described in U.S. Pat. No. 5,434,043 (noted above).

This dispersion was used to prepare photothermographic materials as described in Example 1 except that $7.9\times10^{-6}$ moles of dye A in 0.37 g of methanol and 0.37 g of MEK was added after the zinc bromide. Then an additional $7.8\times10^{-5}$ moles of PHP in 0.15 g methanol was added before incorporating the selenium chemical sensitizer I-39. Emulsions incorporating dye A as a sulfur chemical sensitizer are described in U.S. Pat. No. 5,891,615 (noted above).

The photothermographic materials were coated, dried, imagewise exposed, and heat developed as described in Example 1.

The sensitometric results, shown below in TABLE X demonstrate an increase in speed with virtually no increase in $D_{min}$ upon incorporation of both a selenium chemical sensitizer and a sulfur chemical sensitizer into the photothermographic emulsion. Changes (Δ) in $D_{min}$ and speed are relative to identically prepared control photothermographic materials from which the selenium and sulfur chemical sensitizers had been omitted.

TABLE X

| Sample | Chemical Sensitizer | Amount (moles) | Δ $D_{min}$ | Δ SP-3 |
|---|---|---|---|---|
| 10-1 | I-39 | $2.8 \times 10^{-6}$ | 0.044 | 1.244 |

The invention has been described in detail with particular reference to certain preferred embodiments thereof, but it will be understood that variations and modifications can be effected within the spirit and scope of the invention.

We claim:

1. A photothermographic material comprising a support having thereon one or more layers comprising a binder and in reactive association:

a. a preformed photosensitive silver halide, b. a non-photosensitive source of reducible silver ions, c. a reducing composition for said reducible silver ions, and d. a selenium chemical sensitizer represented by the following Structures I, II, or III:

$$Se(L)_m(X^1)_n \quad \text{I}$$

$$M(L')_s(X^2)_r \quad \text{II}$$

$$(Z)_w M'_x Se_y(CO)_z \quad \text{III}$$

wherein $X^1$ and $X^2$ independently represent halo, CN, SCN, SeCN, TeCN, $N_3$, $BF_4$, $ClO_4$, $BPh_4$, $PF_6$, $NO_3$, $SO_3CF_3$, $R_a$, $R_b$, $O(C{=}O)CF_3$, $S(C{=}S)N(R_a)(R_b)$, $S(C{=}S)OR_a$, $S(C{=}S)SR_a$, $S(P{=}S)(OR_a)(OR_b)$, $S(P{=}S)(R_a)(R_b)$, $SR_a$, $SeR_a$, $TeR_aOR_a$, or $O(C{=}O)R_a$ groups, $R_a$ and $R_b$ independently represent alkyl, alkenyl, cycloalkyl, heterocyclyl, or aryl groups, or $R_a$ and $R_b$ taken together can form a 5-, 6- or 7-membered heterocyclic ring, L is a ligand derived from a neutral Lewis base, m is 0, 1, 2, 3, or 4 and n is 2 or 4 with the proviso that when m is 0, n is 2 or 4, and when m is 0 and n is 2, then $X^1$ is not $R_a$, $R_b$ , or $R_aSe$, M represents Cu(1+), Pd(2+), or Pt(2+), L' represents a neutral ligand with a Group 15 atom or a Group 16 atom, provided that at least one of L' or $X^2$ contains a selenium atom, r is 1 or 2 and s is 1, 2, 3, or 4 such that when M represents Cu(1+), r is 1 and when M represents Pd(2+) or Pt(2+), r is 2, Z represents a monovalent cation, M' represents Fe, Ru, Os, Co, Rh, or Ir, x is an integer of from 1 to 6, y is an integer of from 1 through 6, z is an integer of from 6 through 20, w is an integer inclusive of from 0 through 4 and represents the number of Z groups necessary to neutralize the electronic charge on the rest of the compound, and further provided that multiple $X^1$, $X^2$, L, L', $R_a$, $R_b$, groups in the molecule can be the same or different.

2. The photothermographic material of claim 1 wherein said selenium chemical sensitizer is present in said material in an amount of at least $1\times10^{-7}$ mole per mole of total silver and total silver present in said material is at least 0.002 mol/$m^2$.

3. The photothermographic material of claim 2 wherein said selenium chemical sensitizer is present in said material in an amount of from about $1\times10^{-5}$ to about 0.01 mole per mole of total silver.

4. The photothermographic material of claim 1 wherein L is derived from thiourea, a substituted thiourea, pyridine, or a substituted pyridine.

5. The photothermographic material of claim 1 wherein said selenium chemical sensitizer is represented by Structure I and L is the same or different thiourea ligand derived from a compound represented by the following Structures IV, V, or VI:

IV

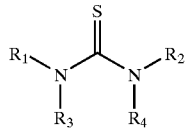

V

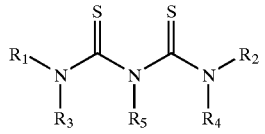

VI

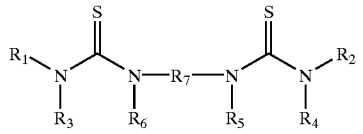

wherein:

in Structure IV, $R_1$, $R_2$, $R_3$ and $R_4$ are independently hydrogen, alkyl, cycloalkyl, allyl, alkenyl, alkynyl, aryl or heterocyclic groups, or $R_1$ and $R_2$ taken together, $R_3$ and $R_5$ taken together, $R_1$ and $R_3$ taken together or $R_2$ and $R_4$ taken together, can form a 5- to 7-membered heterocyclic ring, in Structure V, $R_1$, $R_2$, $R_3$, $R_4$ and $R_5$ are independently hydrogen, alkyl, cycloalkyl, allyl, alkenyl, alkynyl, aryl or heterocyclic groups, or $R_3$ and $R_5$ taken together, $R_4$ and $R_5$ taken together, $R_1$ and $R_3$ taken together or $R_2$ and $R_4$ taken together, can form a substituted or unsubstituted 5- to 7-membered heterocyclic ring, and in Structure VI, $R_1$, $R_2$, $R_3$, $R_4$, $R_5$ and $R_6$ are independently hydrogen, alkyl, cycloalkyl, allyl, alkenyl, alkynyl, aryl or heterocyclic groups, or $R_3$ and $R_6$ taken together, $R_4$ and $R_5$ taken together, $R_1$ and $R_3$ taken together, $R_2$ and $R_4$ taken together, or $R_5$ and $R_6$ taken together, can form a substituted or unsubstituted 5- to 7-membered heterocyclic ring, and $R_7$ is a divalent aliphatic or alicyclic linking group.

6. The photothermographic material of claim 1 wherein $X^1$ is a halo, SCN, or $S(C{=}S)N(R_a)(R_b)$ group.

7. The photothermographic material of claim 6 wherein $X^1$ is chloro or bromo.

8. The photothermographic material of claim 1 wherein said selenium chemical sensitizer is represented by Structure I, m is 2, and n is 4.

9. The photothermographic material of claim 1 wherein said selenium chemical sensitizer is represented by Structure I-a:

III

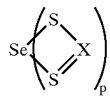

wherein X represents the same or different $COR_a$, $CSR_a$, $CN(R_a)(R_b)$, $CR_a$, $P(R_a)(R_b)$, or $P(OR_a)(OR_b)_2$ group, $R_a$ and $R_b$ are independently substituted or unsubstituted alkyl groups, and p is 2 or 4.

10. The photothermographic material of claim 9 wherein X is the same or different $CN(R_a)(R_b)$ group.

11. The photothermographic material of claim 1 wherein said selenium chemical sensitizer is represented by Structure II wherein $X^2$ is a halo, SCN, or SeCN group.

12. The photothermographic material of claim 1 wherein $R_a$ and $R_b$ are independently a substituted or unsubstituted alkyl group having from 1 to 10 carbon atoms.
13. The photothermographic material of claim 1 wherein said selenium chemical sensitizer is selected from the following group of compounds:
I-1
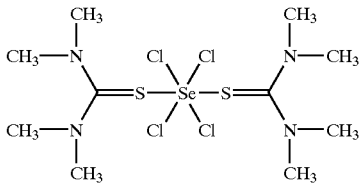
I-2
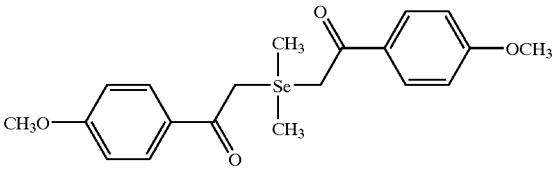
I-3
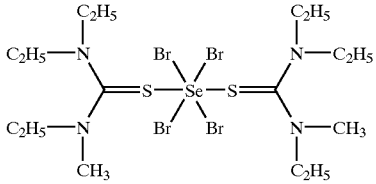
I-4
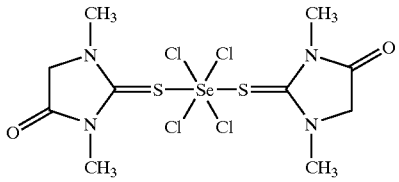
I-5
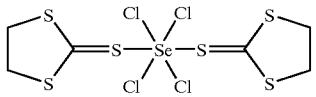
I-6
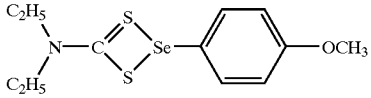
I-7
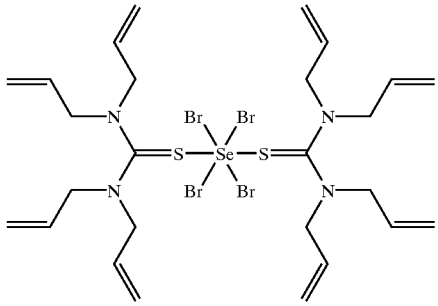
-continued
I-8
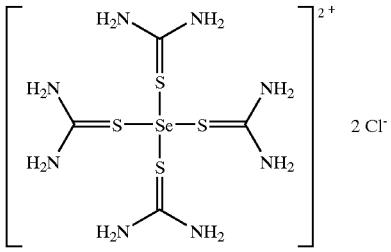
I-9
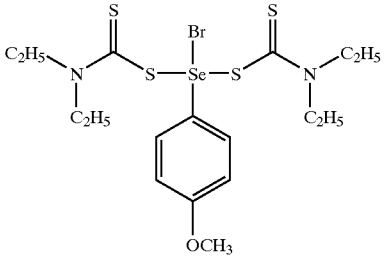
I-10
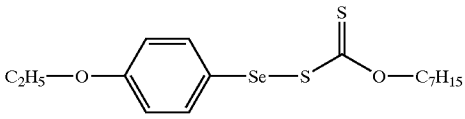
I-11
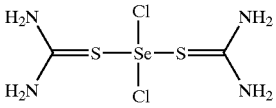
I-12
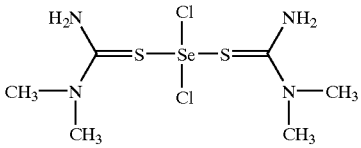
I-13
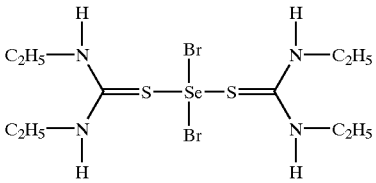
I-14
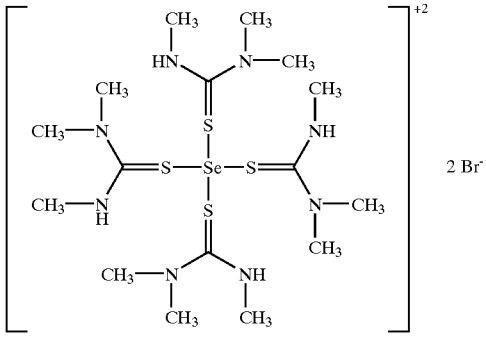

-continued
I-15
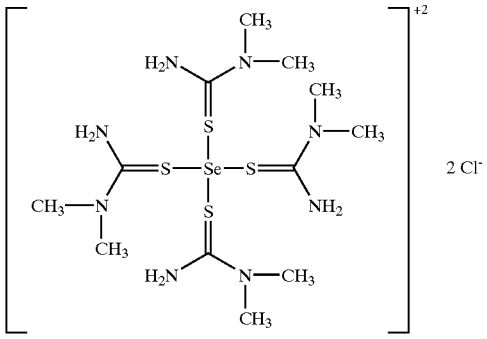
I-16
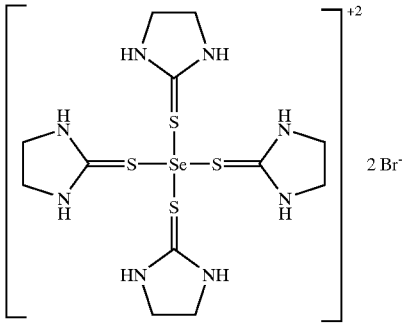
I-17
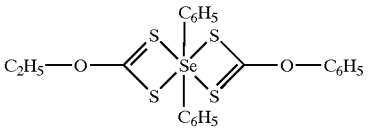
I-18
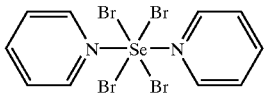
I-19
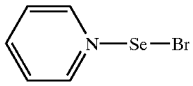
I-20
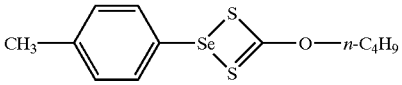
I-21
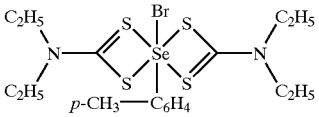
I-22
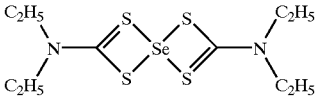
I-23
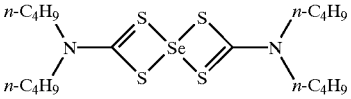
I-24
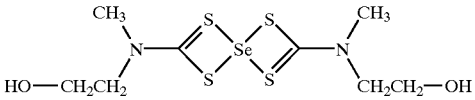
-continued
I-25
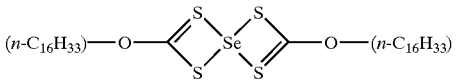
I-26
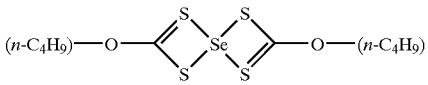
I-27
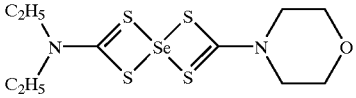
I-28
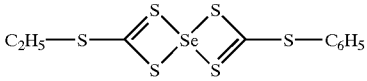
I-29
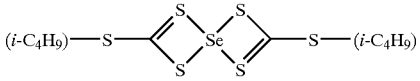
I-30
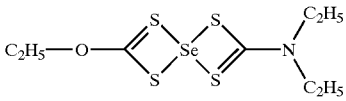
I-31
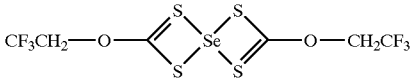
I-32
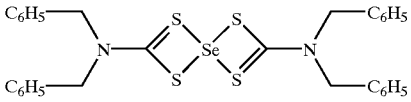
I-33
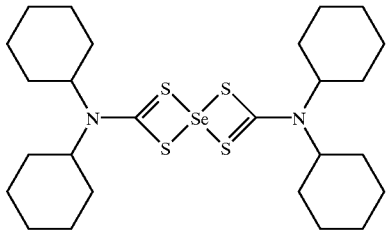
I-34
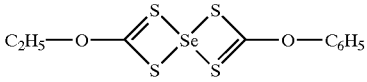
I-35
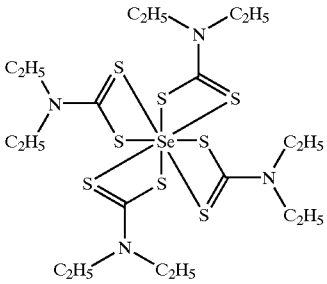
I-36
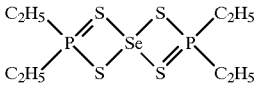

-continued
I-37
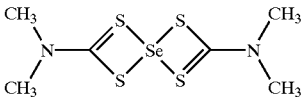
I-38
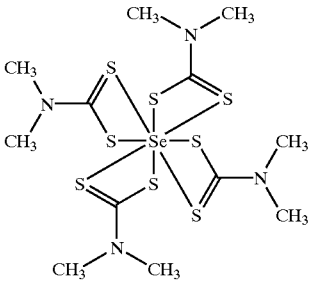
I-39
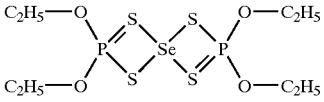
I-40
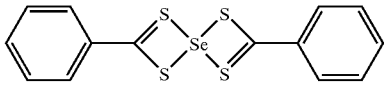
I-41
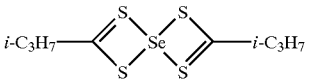
I-42
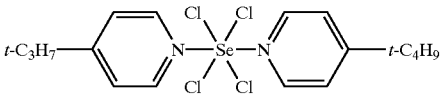
I-43
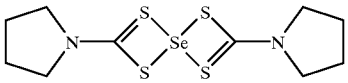
I-44
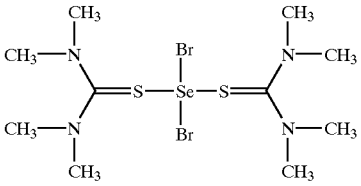
I-45
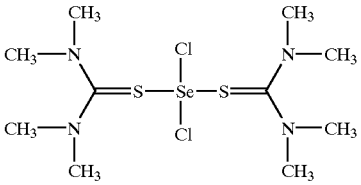
I-46
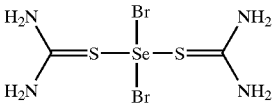
I-47
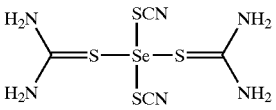
-continued
I-49
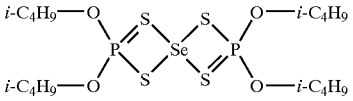
I-50
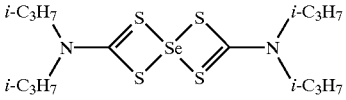
I-51
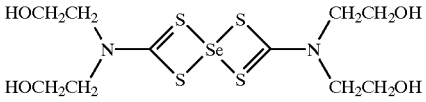
I-52
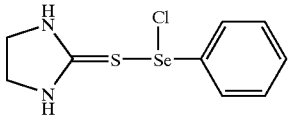
I-53
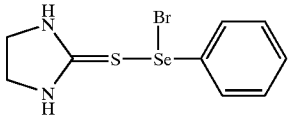
I-54
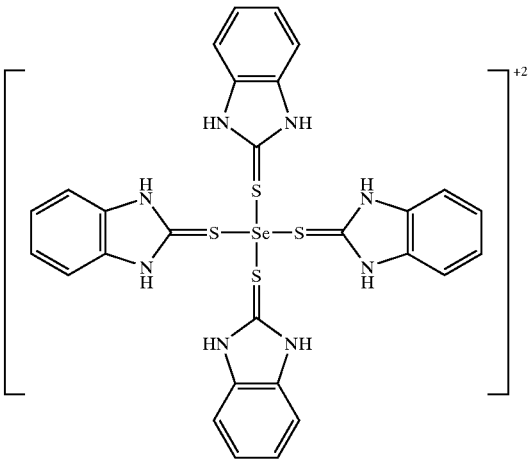
I-55
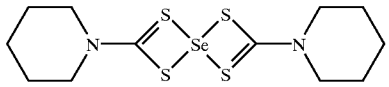
I-56
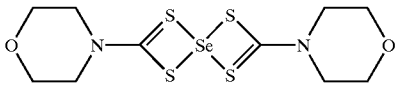
I-57
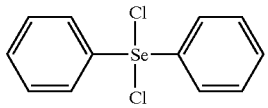
I-58
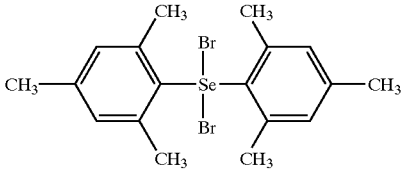

| | |
|---|---|
| $Pd[Se(p\text{-}anisyl)_2]_2Br_2$ | II-1 |
| $Pd[Se(mesityl)_2]_2Cl_2$ | II-2 |
| $Pd\{Se[CH_2Si(CH_3)_3]_2\}_2(SCN)_2$ | II-3 |
| $Pd[P(p\text{-}CH_3O—C_6H_4)_3]_2[SeCN]_2$ | II-4 |
| $Pd[P(C_6H_5)_3]_2[SeCN]_2$ | II-5 |
| $Cu[P(p\text{-}CH_3O—C_6H_4)_3]_3SeCN$ | II-6 |
| $Pt[Se(p\text{-}CH_3—C_6H_4)_2]_2[SeC_6H_5]_2$ | II-7 |
| $Pt[P(p\text{-}CH_3O—C_6H_4)_3]_2[SeCN]_2$ | II-8 |
| $[Pt\{Se{=}C(NH_2)(NMe_2)\}_4]Br_2$ | II-9 |
| $Cu[P(C_6H_5)_3]_2SeCN$ | II-10 |
| $Cu[P(C_6H_5)_3]_3SeCN$ | II-11 |
| $Cu[Se(Mesityl)_2]_2Br$ | II-12 |
| $Cu[(C_6H_5)_2PCH_2CH_2P(C_6H_5)_2]SeCN$ | II-13 |
| $Cu[Se(CH_2—C_6H_5)_2]_3SeCN$ | II-14 |
| $Cu[P(p\text{-}CH_3—C_6H_4)_3]_2SeC_6H_5$ | II-15 |
| $Cu\{CH_3C[CH_2P(C_6H_5)_2]_3\}SeCN$ | II-16 |
| $[Cu\{Se{=}C(NH_2)(NMe_2)\}_3]BF_4$ | II-17 |
| $Cu[Se(C_6H_5)_2]_3SeCN$ | II-18 |
| $Pd[As(C_6H_5)_3]_2(SeCN)_2$ | II-19 |
| $Pd(C_5H_4N)_2(SeCN)_2$ | II-20 |
| $Pt[Sb(p\text{-}CH_3—C_6H_4)_3]_2(SeCN)_2$ | II-21 |
| $Cu[Se(2—C_5H_4N)_2](SeC_6H_5)$ | II-22 |
| $Cu[P(p\text{-}CH_3—C_6H_4)_3]_2SeCN$ | II-23 |
| $Cu[Se(C_6H_5)_2]_3SeC_6H_5$ | II-24 |
| $Pd[(CH_3)_2N(Se{=}C)NE_2]_2(SeCN)_2$ | II-25 |
| $Cu[P(C_6H_5)_3]SeCN$ | II-26 |
| $Cu[Se(C_6H_5)_2]_4BF_4$ | II-27 |
| $Pt[Se(C_6H_5)_2]_2(SeCN)_2$ | II-28 |
| $Pt[Se(C_6H_5)_2]_4(PF_6)_2$ | II-29 |
| $Pt[H_2N(Se{=}C)NH_2]_4(BF_4)_2$ | II-30 |
| $Pt[CH_3C(CH_2P(C_6H_5)_2]_3(SeCN)(PF_6)$ | II-31 |
| $Pd[Se(C_6H_5)_2]_3(SeC_6H_5)(BF_4)$ | II-32 |
| $Fe_3(\mu_3\text{-}Se)_2(CO)_9$ | III-1 |
| $Fe_4Se_4(CO)_{12}$ | III-2 |
| $Ru_3Se_2(CO)_9$ | III-3 |
| $RuCo_2Se(CO)_9$ | III-4 |
| $Os_3Se_2(CO)_9$ | III-5 |
| $Ru_4Se_4(CO)_{12}$ | III-6 |
| $[(CH_3)_4N][Rh_3Se_2(CO)_6]$ | III-7. |

14. The photothermographic material of claim 1 wherein said photocatalyst is a silver bromide, silver iodobromide, or a mixture of silver halides.

15. The photothermographic material of claim 1 wherein said non-photosensitive source of reducible silver ions is a silver salt of a fatty acid having from 10 to 30 carbon atoms, or a mixture of said silver salts.

16. The photothermographic material of claim 1 further including a co-developer selected from the group consisting of trityl hydrazides, formyl phenyl hydrazides, 3-heteroaromatic-substituted acrylonitriles, 2-substituted malondialdehydes, substituted propenitriles, 4-substituted isoxazoles, 2,5-dioxo-cyclopentane carboxaldehydes, 5-(hydroxymethylene)-1,3-dialkylbarbituric acids, 2-(ethoxymethylene)-1H-indene-1,3(2H)-diones, and 2-substituted malondialdehyde compounds.

17. The photothermographic material of claim 16 further including a contrast enhancing agent selected from the group consisting of hydroxylamines, alkanolamines, ammonium phthalamate compounds, hydroxamic acids, N-acylhydrazines, and hydrogen atom donor compounds.

18. The photothermographic material of claim 1 further comprising a heteroaromatic mercapto compound in an amount of at least 0.0001 mole per mole of total silver.

19. The photothermographic material of claim 18 wherein said heteroaromatic mercapto compound is 2-mercaptobenzimidazole, 2-mercapto-5-methylbenzimidazole, 2-mercaptobenzothiazole, 2-mercaptobenzoxazole, or a mixture of two or more of these compounds.

20. The photothermographic material of claim 1 further comprising a sulfur chemical sensitizer selected from the group consisting of a thiosulfate compound, a thiazole compound, a rhodanine compound, or a thiourea compound.

21. The photothermographic material of claim 20 wherein the thiourea compound is represented by the following Structures IV, V, or VI:

IV

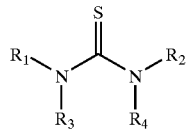

V

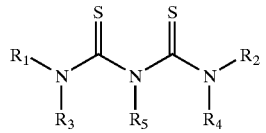

VI

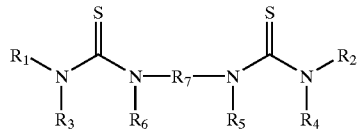

wherein:

in Structure IV, $R_1$, $R_2$, $R_3$ and $R_4$ are independently hydrogen, alkyl, cycloalkyl, allyl, alkenyl, alkynyl, aryl or heterocyclic groups, or $R_1$ and $R_2$ taken together, $R_3$ and $R_5$ taken together, $R_1$ and $R_3$ taken together or $R_2$ and $R_4$ taken together, can form a 5- to 7-membered heterocyclic ring, in Structure V, $R_1$, $R_2$, $R_3$, $R_4$ and $R_5$ are independently hydrogen, alkyl, cycloalkyl, allyl, alkenyl, alkynyl, aryl or heterocyclic groups, or $R_3$ and $R_5$ taken together, $R_4$ and $R_5$ taken together, $R_1$ and $R_3$ taken together or $R_2$ and $R_4$ taken together, can form a substituted or unsubstituted 5- to 7-membered heterocyclic ring, and in Structure VI, $R_1$, $R_2$, $R_3$, $R_4$, $R_5$ and $R_6$ are independently hydrogen, alkyl, cycloalkyl, allyl, alkenyl, alkynyl, aryl or heterocyclic groups, or $R_3$ and $R_6$ taken together, $R_4$ and $R_5$ taken together, $R_1$ and $R_3$ taken together, $R_2$ and $R_4$ taken together, or $R_5$ and $R_6$ taken together, can form a substituted or unsubstituted 5- to 7-membered heterocyclic ring, and $R_7$ is a divalent aliphatic or alicyclic linking group.

22. The photothermographic material of claim 1 further comprising a tellurium chemical sensitizer.

23. The photothermographic material of claim 22 wherein the tellurium chemical sensitizer is represented by the following Structures VII or VIII:

$$Te(L^{11})_{m'}(X^{11})_{n'} \quad \text{VII}$$

$$Pd(X^{12})_2[Te(R'')_2]_2 \quad \text{VIII}$$

wherein $X^{11}$ and $X^{12}$ independently represent halo, OCN, SCN, $S(C{=}S)N(R_{aa})(R_{bb})$, $S(C{=}S)OR_{aa}$, $S(C{=}S)SR_{aa}$, $S(P{=}S)(OR_{aa})(OR_{bb})$, $S(P{=}S)(R_{aa})(R_{bb})$, SeCN, TeCN, CN, $SR_{aa}$, $OR_{aa}$, $N_3$, alkyl, aryl, or $O(C{=}O)R_{aa}$ groups, $R_{aa}$ and $R_{bb}$ are an alkyl, alkenyl, cycloalkyl, heterocyclyl, or aryl group, or $R_{aa}$ and $R_{bb}$ taken together can form a 5-, 6- or 7-membered heterocyclic ring, $L^{11}$ is a ligand derived from a neutral Lewis base, R" is an alkyl or aryl group, m' is 0, 1, 2, or 4, and n' is 2 or 4 provided that multiple $X^{11}$, $X^{12}$, $L^{11}$, $R_{aa}$, $R_{bb}$, or R" groups in the molecule can be the same or different.

24. The photothermographic material of claim 1 further comprising a gold chemical sensitizer.

25. The photothermographic material of claim 24 wherein the gold chemical sensitizer is represented by the following Structure IX:

$$Au[3+](L'')_{r'}(Y')_{q'} \quad \text{IX}$$

wherein L" represents the same or different ligands, each ligand comprising at least one heteroatom that is capable of forming a bond with gold, Y' is an anion, r' is an integer of from 1 to 4, and q' is an integer of from 0 to 3.

26. The photothermographic material of claim 1 further comprising an oxidatively decomposed sulfur-containing compound.

27. The photothermographic material of claim 26 wherein the oxidatively decomposed sulfur-containing compound is a spectral sensitizing dye.

28. The photothermographic material of claim 1 achieving further chemical sensitization by oxidative decomposition of a sulfur-containing compound on or around the silver halide grains in an oxidizing environment.

29. The photothermographic material of claim 1 further comprising a mixture of two or more of: a tellurium chemical sensitizer, a gold chemical sensitizer, a sulfur chemical sensitizer, or an oxidatively decomposed sulfur-containing compound.

30. The photothermographic material of claim 29 wherein:

the sulfur chemical sensitizer is represented by the following Structures IV, V, and VI:

IV

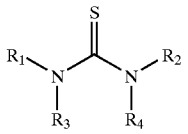

-continued

V

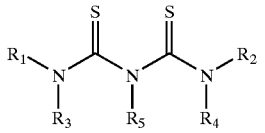

VI

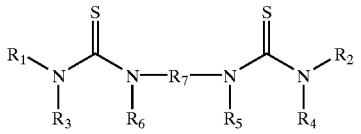

wherein:

in Structure IV, $R_1$, $R_2$, $R_3$ and $R_4$ are independently hydrogen, alkyl, cycloalkyl, allyl, alkenyl, alkynyl, aryl or heterocyclic groups, or $R_1$ and $R_2$ taken together, $R_3$ and $R_5$ taken together, $R_1$ and $R_3$ taken together or $R_2$ and $R_4$ taken together, can form a 5- to 7-membered heterocyclic ring, in Structure V, $R_1$, $R_2$, $R_3$, $R_4$ and $R_5$ are independently hydrogen, alkyl, cycloalkyl, allyl, alkenyl, alkynyl, aryl or heterocyclic groups, or $R_3$ and $R_5$ taken together, $R_4$ and $R_5$ taken together, $R_1$ and $R_3$ taken together or $R_2$ and $R_4$ taken together, can form a substituted or unsubstituted 5- to 7-membered heterocyclic ring, and in Structure VI, $R_1$, $R_2$, $R_3$, $R_4$, $R_5$, and $R_6$ are independently hydrogen, alkyl, cycloalkyl, allyl, alkenyl, alkynyl, aryl or heterocyclic groups, or $R_3$ and $R_6$ taken together, $R_4$ and $R_5$ taken together, $R_1$ and $R_3$ taken together, $R_2$ and $R_4$ taken together, or $R_5$ and $R_6$ taken together, can form a substituted or unsubstituted 5- to 7-membered heterocyclic ring, and $R_7$ is a divalent aliphatic or alicyclic linking group, the tellurium chemical sensitizer is represented by the following Structures VII and VIII:

$$Te(L^{11})_{m'}(X^{11})_{n'} \quad \text{VII}$$

$$Pd(X^{12})_2[Te(R'')_2]_2 \quad \text{VIII}$$

wherein $X^{11}$ and $X^{12}$ independently represent halo, OCN, SCN, $S(C{=}S)N(R_{aa})(R_{bb})$, $S(C{=}S)OR_{aa}$, $S(C{=}S)SR_{aa}$, $S(P{=}S)(OR_{aa})(OR_{bb})$, $S(P{=}S)(R_{aa})(R_{bb})$, SeCN, TeCN, CN, $SR_{aa}$, $OR_{aa}$, $N_3$, alkyl, aryl, or $O(C{=}O)R_{aa}$ groups, $R_{aa}$ and $R_{bb}$ are an alkyl, alkenyl, cycloalkyl, heterocyclyl, or aryl group, or $R_{aa}$ and $R_{bb}$ taken together can form a 5-, 6- or 7-membered heterocyclic ring, $L^{11}$ is a ligand derived from a neutral Lewis base, R" is an alkyl or aryl group, m' is 0, 1, 2, or 4, and n' is 2 or 4 provided that multiple $X^{11}$, $X^{12}$, $L^{11}$, $R_{aa}$, $R_{bb}$, or R" groups in the molecule can be the same or different, the gold chemical sensitizer is represented by the following Structure IX:

$$Au[3+](L'')_{r'}(Y')_{q'} \quad \text{IX}$$

wherein L" represents the same or different ligands, each ligand comprising at least one heteroatom that is capable of forming a bond with gold, Y' is an anion, r' is an integer of from 1 to 4, and q' is an integer of from 0 to 3, and the oxidatively decomposed sulfur-containing compound is a spectral sensitizing dye.

31. The photothermographic material of claim 1 further comprising in-situ generated silver halide.

32. A method for forming a visible image comprising:

A) imagewise exposing the photothermographic material of claim 1 to electromagnetic radiation to form a latent image, and B) simultaneously or sequentially, heating said exposed photothermographic material to develop said latent image into a visible image.

33. The method of claim 32 wherein said photothermographic material support is transparent, and said method further comprises:

C) positioning said exposed and heat-developed photothermographic material with a visible image therein between a source of imaging radiation and an imageable material that is sensitive to said imaging radiation, and D) thereafter exposing said imageable material to said imaging radiation through said visible image in said exposed and heat-developed photothermographic material to provide a visible image in said imageable material.

34. A photothermographic material comprising a transparent support having on one side thereof, one or more photothermographic emulsion layers comprising:

a. one or more preformed silver halides present in an amount of from about 0.005 to about 0.5 mole per mole of a non-photosensitive source of reducible silver ions, b. a non-photosensitive source of reducible silver ions that comprises one or more silver carboxylates of fatty acids having from 10 to 30 carbon atoms, said one or more silver carboxylates being present in an amount of from about 10 to about 50 weight % of the total dry weight of said emulsion layer(s), c. one or more hindered phenol reducing agents, d. one or more hydrophobic binders, e. a heteroaromatic mercapto compound, and f. a selenium chemical sensitizer represented by the following Structures I, II, or III:

$$Se(L)_m(X^1)_n \quad \text{I}$$

$$M(L')_s(X^2)_r \quad \text{II}$$

$$(Z)_w M'_x Se_y (CO)_z \quad \text{III}$$

wherein $X^1$ and $X^2$ independently represent halo, CN, SCN, SeCN, TeCN, $N_3$, $BF_4$, $ClO_4$, $BPh_4$, $PF_6$, $NO_3$, $SO_3CF_3$, $R_a$, $R_b$, $O(C{=}O)CF_3$, $S(C{=}S)N(R_a)(R_b)$, $S(C{=}S)OR_a$, $S(C{=}S)SR_a$, $S(P{=}S)(OR_a)(OR_b)$, $S(P{=}S)(R_a)(R_b)$, $SR_a$, $SeR_a$, $TeR_aOR_a$, or $O(C{=}O)R_a$ groups, $R_a$ and $R_b$ independently represent alkyl, alkenyl, cycloalkyl, heterocyclyl, or aryl groups, or $R_a$ and $R_b$ taken together can form a 5-, 6- or 7-membered heterocyclic ring, L is a ligand derived from a neutral Lewis base, m is 0, 1, 2, 3, or 4 and n is 2 or 4 with the proviso that when m is 0, n is 2 or 4, and when m is 0 and n is 2, then $X^1$ is not $R_a$, $R_b$, or $R_aSe$, M represents Cu(1+), Pd(2+), or Pt(2+), L' represents a neutral ligand with a Group 15 atom or a Group 16 atom, provided that at least one of L' or $X^2$ contains a selenium atom, r is 1 or 2 and s is 1, 2, 3, or 4 such that when M represents Cu(1+), r is 1 and when M represents Pd(2+) or Pt(2+), r is 2, Z represents a monovalent cation, M' represents Fe, Ru, Os, Co, Rh, or Ir, x is an integer of from 1 to 6, y is an integer of from 1 through 6, z is an integer of from 6 through 20, w is an integer inclusive of from 0 through 4 and represents the number of Z groups necessary to neutralize the electronic charge on the rest of the compound, and further provided that multiple $X^1$, $X^2$, L, L', $R_a$, $R_b$, groups in the molecule can be the same or different, and wherein L is the same or different thiourea ligand derived from a compound represented by the following Structures IV, V, or VI:

IV

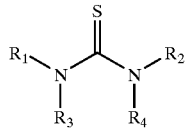

V

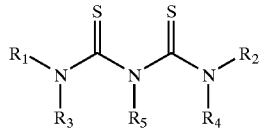

VI

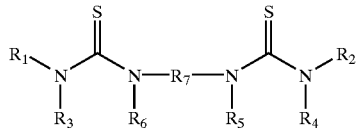

wherein:

in Structure IV, $R_1$, $R_2$, $R_3$ and $R_4$ are independently hydrogen, alkyl, cycloalkyl, allyl, alkenyl, alkynyl, aryl or heterocyclic groups, or $R_1$ and $R_2$ taken together, $R_3$ and $R_5$ taken together, $R_1$ and $R_3$ taken together or $R_2$ and $R_4$ taken together, can form a 5- to 7-membered heterocyclic ring, in Structure V, $R_1$, $R_2$, $R_3$, $R_4$ and $R_5$ are independently hydrogen, alkyl, cycloalkyl, allyl, alkenyl, alkynyl, aryl or heterocyclic groups, or $R_3$ and $R_5$ taken together, $R_4$ and $R_5$ taken together, $R_1$ and $R_3$ taken together or $R_2$ and $R_4$ taken together, can form a substituted or unsubstituted 5- to 7-membered heterocyclic ring, and in Structure VI, $R_1$, $R_2$, $R_3$, $R_4$, $R_5$, and $R_6$ are independently hydrogen, alkyl, cycloalkyl, allyl, alkenyl, alkynyl, aryl or heterocyclic groups, or $R_3$ and $R_6$ taken together, $R_4$ and $R_5$ taken together, $R_1$ and $R_3$ taken together, $R_2$ and $R_4$ taken together, or $R_5$ and $R_6$ taken together, can form a substituted or unsubstituted 5- to 7-membered heterocyclic ring, and $R_7$ is a divalent aliphatic or alicyclic linking group, said selenium chemical sensitizer represented by Structures I, II, or III being present in said material in an amount of from about $1\times10^{-5}$ to about 0.01 mole per mole of total silver.

35. The photothermographic material of claim 34 further comprising an antihalation dye or an acutance dye.

36. The photothermographic material of claim 35 further comprising a backside antihalation layer comprising a heat-bleachable antihalation composition.

37. A method for preparing a photothermographic emulsion comprising the following steps, in order:

A) providing a photothermographic emulsion comprising silver halide grains and a non-photosensitive source of reducible silver ions, and B) positioning one or more of the selenium chemical sensitizers represented by Structures I, II, or III shown below on or around said silver halide grains, $$Se(L)_m(X^1)_n \quad \text{I}$$

$$M(L')_s(X^2)_r \quad \text{II}$$

$$(Z)_w M'_x Se_y(CO)_z \quad \text{III}$$

wherein $X^1$ and $X^2$ independently represent halo, CN, SCN, SeCN, TeCN, $N_3$, $BF_4$, $ClO_4$, $BPh_4$, $PF_6$, $NO_3$, $SO_3CF_3$, $R_a$, $R_b$, $O(C{=}O)CF_3$, $S(C{=}S)N(R_a)(R_b)$, $S(C{=}S)OR_a$, $S(C{=}S)SR_a$, $S(P{=}S)(OR_a)(OR_b)$, $S(P{=}S)(R_a)(R_a)$, $SR_a$, $SeR_a$, $TeR_aOR_a$, or $O(C{=}O)R_a$ groups, $R_a$ and $R_b$ independently represent alkyl, alkenyl, cycloalkyl, heterocyclyl, or aryl groups, or $R_a$ and $R_b$ taken together can form a 5-, 6- or 7-membered heterocyclic ring, L is a ligand derived from a neutral Lewis base, m is 0, 1, 2, 3, or 4 and n is 2 or 4 with the proviso that when m is 0, n is 2 or 4, and when m is 0 and n is 2, then $X^1$ is not $R_a$, $R_b$, or $R_aSe$, M represents Cu(1+), Pd(2+), or Pt(2+), L' represents a neutral ligand with a Group 15 atom or a Group 16 atom, provided that at least one of L' or $X^2$ contains a selenium atom, r is 1 or 2 and s is 1, 2, 3, or 4 such that when M represents Cu(1+), r is 1 and when M represents Pd(2+) or Pt(2+), r is 2, Z represents a monovalent cation, M' represents Fe, Ru, Os, Co, Rh, or Ir, x is an integer of from 1 to 6, y is an integer of from 1 through 6, z is an integer of from 6 through 20, w is an integer inclusive of from 0 through 4 and represents the number of Z groups necessary to neutralize the electronic charge on the rest of the compound, and further provided that multiple $X^1$, $X^2$, L, L', $R_a$, $R_b$, groups in the molecule can be the same or different.

38. A method of preparing a photothermographic emulsion comprising:

A) providing silver halide grains,

B) providing a photothermographic emulsion of said silver halide grains and a non-photosensitive source of reducible silver ions, and C) during or anytime after step A, chemically sensitizing said silver halide grains with a selenium chemical sensitizer represented by Structures I, II, or II shown below $$Se(L)_m(X^1)_n \quad \text{I}$$

$$M(L')_s(X^2)_r \quad \text{II}$$

$$(Z)_w M'_x Se_y(CO)_z \quad \text{III}$$

wherein $X^1$ and $X^2$ independently represent halo, CN, SCN, SeCN, TeCN, $N_3$, $BF_4$, $ClO_4$, $BPh_4$, $PF_6$, $NO_3$, $SO_3CF_3$, $R_a$, $R_b$, $O(C{=}O)CF_3$, $S(C{=}S)N(R_a)(R_b)$, $S(C{=}S)OR_a$, $S(C{=}S)SR_a$, $S(P{=}S)(OR_a)(OR_b)$, $S(P{=}S)(R_a)(R_b)$, $SR_a$, $SeR_a$, $TeR_aOR_a$, or $O(C{=}O)R_a$ groups, $R_a$ and $R_b$ independently represent alkyl, alkenyl, cycloalkyl, heterocyclyl, or aryl groups, or $R_a$ and $R_b$ taken together can form a 5-, 6- or 7-membered heterocyclic ring, L is a ligand derived from a neutral Lewis base, m is 0, 1, 2, 3, or 4 and n is 2 or 4 with the proviso that when m is 0, n is 2 or 4, and when m is 0 and n is 2, then $X^1$ is not $R_a$, $R_b$, or $R_aSe$, M represents Cu(1+), Pd(2+), or Pt(2+), L' represents a neutral ligand with a Group 15 atom or a Group 16 atom, provided that at least one of L' or $X^2$ contains a selenium atom, r is 1 or 2 and s is 1, 2, 3, or 4 such that when M represents Cu(1+), r is 1 and when M represents Pd(2+) or Pt(2+), r is 2, Z represents a monovalent cation, M' represents Fe, Ru, Os, Co, Rh, or Ir, x is an integer of from 1 to 6, y is an integer of from 1 through 6, z is an integer of from 6 through 20, w is an integer inclusive of from 0 through 4 and represents the number of Z groups necessary to neutralize the electronic charge on the rest of the compound, and further provided that multiple $X^1$, $X^2$, L, L', $R_a$, $R_b$, groups in the molecule can be the same or different.

39. The method of claim 38 wherein said silver halide grains are further chemically sensitized with an organic sulfur-containing compound and step C also includes decomposing said sulfur-containing compound on or around said silver halide grains in an oxidizing environment.

40. The method of claim 38 wherein said organic sulfur-containing compound is a spectral sensitizing dye.

41. The method of claim 40 further comprising adding a second spectral sensitizing dye to said photothermographic emulsion to spectrally sensitize said photosensitive silver halide grains.

42. The method of claim 38 wherein said silver halide grains are chemically sensitized using a sulfur chemical sensitizer selected from the group consisting of a thiourea, a thiosulfate, a thiazole, or a rhodanine compound.

43. The method of claim 42 wherein said thiourea compound is represented by the following Structures IV, V, or VI:

IV

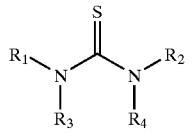

V

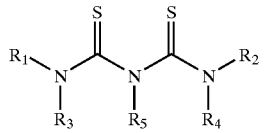

VI

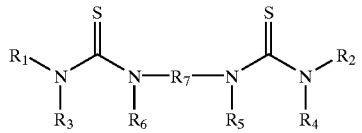

wherein:

in Structure IV, $R_1$, $R_2$, $R_3$ and $R_4$ are independently hydrogen, alkyl, cycloalkyl, allyl, alkenyl, alkynyl, aryl or heterocyclic groups, or $R_1$ and $R_2$ taken together, $R_3$ and $R_5$ taken together, $R_1$ and $R_3$ taken together or $R_2$ and $R_4$ taken together, can form a 5- to 7-membered heterocyclic ring, in Structure V, $R_1$, $R_2$, $R_3$, $R_4$ and $R_5$ are independently hydrogen, alkyl, cycloalkyl, allyl, alkenyl, alkynyl, aryl or heterocyclic groups, or $R_3$ and $R_5$ taken together, $R_4$ and $R_5$ taken together, $R_1$ and $R_3$ taken together or $R_2$ and $R_4$ taken together, can form a substituted or unsubstituted 5- to 7-membered heterocyclic ring, and in Structure VI, $R_1$, $R_2$, $R_3$, $R_4$, $R_5$, and $R_6$ are independently hydrogen, alkyl, cycloalkyl, allyl, alkenyl, alkynyl, aryl or heterocyclic groups, or $R_3$ and $R_6$ taken together, $R_4$ and $R_5$ taken together, $R_1$ and $R_3$ taken together, $R_2$ and $R_4$ taken together, or $R_5$ and $R_6$ taken together, can form a substituted or unsubstituted 5- to 7-membered heterocyclic ring, and $R_7$ is a divalent aliphatic or alicyclic linking group.

44. The method of claim 38 wherein said silver halide grains are chemically sensitized using a tellurium chemical sensitizer.

45. The method of claim 44 wherein said tellurium chemical sensitizer is represented by the following Structures VII or VIII:

$$Te(L^{11})_{m'}(X^{11})_{n'} \quad \text{VII}$$

$$Pd(X^{12})_2[Te(R'')_2]_2 \quad \text{VIII}$$

wherein $X^{11}$ and $X^{12}$ independently represent halo, OCN, SCN, $S(C{=}S)N(R_{aa})(R_{bb})$, $S(C{=}S)OR_{aa}$, $S(C{=}S)SR_{aa}$, $S(P{=}S)(OR_{aa})(OR_{bb})$, $S(P{=}S)(R_{aa})(R_{bb})$, SeCN, TeCN, CN, $SR_{aa}$, $OR_{aa}$, $N_3$, alkyl, aryl, or $O(C{=}O)R_{aa}$ groups, $R_{aa}$ and $R_{bb}$ are an alkyl, alkenyl, cycloalkyl, heterocyclyl, or aryl group, or $R_{aa}$ and $R_{bb}$ taken together can form a 5-, 6- or 7-membered heterocyclic ring, $L^{11}$ is a ligand derived from a neutral Lewis base, R" is an alkyl or aryl group, m' is 0, 1, 2, or 4, and n' is 2 or 4 provided that multiple $X^{11}$, $X^{12}$, $L^{11}$, $R_{aa}$, $R_{bb}$, or R" groups in the molecule can be the same or different.

46. The method of claim 38 wherein said silver halide grains are chemically sensitized using a gold chemical sensitizer.

47. The method of claim 46 wherein said gold chemical sensitizer is represented by the following Structure IX:

$$Au[3+](L'')_{r'}(Y')_{q'} \quad \text{IX}$$

wherein L" represents the same or different ligands, each ligand comprising at least one heteroatom that is capable of forming a bond with gold, Y' is an anion, r' is an integer of from 1 to 4, and q' is an integer of from 0 to 3.

48. The method of claim 38 wherein said silver halide grains are chemically sensitized using a mixture of two or more of: a tellurium chemical sensitizer, a gold chemical sensitizer, a sulfur chemical sensitizer, or an oxidatively decomposed sulfur-containing compound.

49. The method of claim 48 wherein:

the sulfur chemical sensitizer is represented by the following Structures IV, V, and VI:

IV

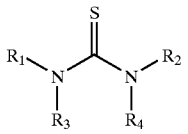

V

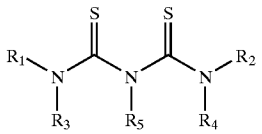

-continued

VI

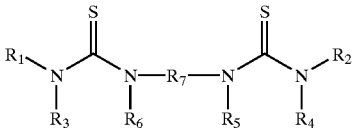

wherein:

in Structure IV, $R_1$, $R_2$, $R_3$ and $R_4$ are independently hydrogen, alkyl, cycloalkyl, allyl, alkenyl, alkynyl, aryl or heterocyclic groups, or $R_1$ and $R_2$ taken together, $R_3$ and $R_5$ taken together, $R_1$ and $R_3$ taken together or $R_2$ and $R_4$ taken together, can form a 5- to 7-membered heterocyclic ring, in Structure V, $R_1$, $R_2$, $R_3$, $R_4$ and $R_5$ are independently hydrogen, alkyl, cycloalkyl, allyl, alkenyl, alkynyl, aryl or heterocyclic groups, or $R_3$ and $R_5$ taken together, $R_4$and $R_5$ taken together, $R_1$ and $R_3$ taken together or $R_2$ and $R_4$ taken together, can form a substituted or unsubstituted 5- to 7-membered heterocyclic ring, and in Structure VI, $R_1$, $R_2$, $R_3$, $R_4$, $R_5$, and $R_6$ are independently hydrogen, alkyl, cycloalkyl, allyl, alkenyl, alkynyl, aryl or heterocyclic groups, or $R_3$ and $R_6$ taken together, $R_4$ and $R_5$ taken together, $R_1$ and $R_3$ taken together, $R_2$ and $R_4$ taken together, or $R_5$ and $R_6$ taken together, can form a substituted or unsubstituted 5- to 7-membered heterocyclic ring, and $R_7$ is a divalent aliphatic or alicyclic linking group, the tellurium chemical sensitizer is represented by the following Structures VII and VIII:

$$Te(L^{11})_{m'}(X^{11})_{n'} \quad \text{VII}$$

$$Pd(X^{12})_2[Te(R'')_2]_2 \quad \text{VIII}$$

wherein $X^{11}$ and $X^{12}$ independently represent halo, OCN, SCN, $S(C{=}S)N(R_{aa})(R_{bb})$, $S(C{=}S)OR_{aa}$, $S(C{=}S)SR_{aa}$, $S(P{=}S)(OR_{aa})(OR_{bb})$, $S(P{=}S)(R_{aa})(R_{bb})$, SeCN, TeCN, CN, $SR_{aa}$, $OR_{aa}$, $N_3$, alkyl, aryl, or $O(C{=}O)R_{aa}$ groups, $R_{aa}$ and $R_{bb}$ are an alkyl, alkenyl, cycloalkyl, heterocyclyl, or aryl group, or $R_{aa}$ and $R_{bb}$ taken together can form a 5-, 6- or 7-membered heterocyclic ring, $L^{11}$ is a ligand derived from a neutral Lewis base, R" is an alkyl or aryl group, m' is 0, 1, 2, or 4, and n' is 2 or 4 provided that multiple $X^{11}$, $X^{12}$, $L^{11}$, $R_{aa}$, $R_{bb}$, or R" groups in the molecule can be the same or different, the gold chemical sensitizer is represented by the following Structure IX:

$$Au[3+](L'')_{r'}(Y')_{q'} \quad \text{IX}$$

wherein L" represents the same or different ligands, each ligand comprising at least one heteroatom that is capable of forming a bond with gold, Y' is an anion, r' is an integer of from 1 to 4, and q' is an integer of from 0 to 3, and the oxidatively decomposed sulfur-containing compound is a spectral sensitizing dye.

50. A photothermographic material comprising a support having thereon one or more layers comprising a binder and in reactive association:

a. a photocatalyst, b. a non-photosensitive source of reducible silver ions, c. a reducing composition for said reducible silver ions, and d. a selenium chemical sensitizer represented by the following Structures I, II, or III:

$$Se(L)_m(X^1)_n \quad \text{I}$$

$$M(L')_s(X^2)_r \quad \text{II}$$

$$(Z)_w M'_x Se_y(CO)_z \quad \text{III}$$

wherein $X^1$ and $X^1$ independently represent halo, CN, SCN, SeCN, TeCN, $N_3$, $BF_4$, $ClO_4$, $BPh_4$, $PF_6$, $NO_3$, $SO_3CF_3$, $R_a$, $R_b$, $O(C{=}O)CF_3$, $S(C{=}S)N(R_a)(R_b)$, $S(C{=}S)OR_a$, $S(C{=}S)SR_a$, $S(P{=}S)(OR_a)(OR_b)$, $S(P{=}S)(R_a)(R_b)$, $SR_a$, $SeR_a$, $TeR_aOR_a$, or $O(C{=}O)R_a$ groups, $R_a$ and $R_b$ independently represent alkyl, alkenyl, cycloalkyl, heterocyclyl, or aryl groups, or $R_a$ and $R_b$ taken together can form a 5-, 6- or 7-membered heterocyclic ring, L is a ligand derived from a neutral Lewis base, m is 0, 1, 2, 3, or 4 and n is 2 or 4 with the proviso that when m is 0, n is 2 or 4, and when m is 0 and n is 2, then $X^1$ is not $R_a$, $R_b$, or $R_aSe$, M represents Cu(1+), Pd(2+), or Pt(2+), L' represents a neutral ligand with a Group 15 atom or a Group 16 atom, provided that at least one of L' or $X^2$ contains a selenium atom, r is 1 or 2 and s is 1, 2, 3, or 4 such that when M represents Cu(1+), r is 1 and when M represents Pd(2+) or Pt(2+), r is 2, Z represents a monovalent cation, M' represents Fe, Ru, Os, Co, Rh, or Ir, x is an integer of from 1 to 6, y is an integer of from 1 through 6, z is an integer of from 6 through 20, w is an integer inclusive of from 0 through 4 and represents the number of Z groups necessary to neutralize the electronic charge on the rest of the compound, and further provided that multiple $X^1$, $X^2$, L, L', $R_a$, $R_b$, groups in the molecule can be the same or different.

51. The photothermographic material of claim 50 wherein said selenium chemical sensitizer is represented by Structure I and L is the same or different thiourea ligand derived from a compound represented by the following Structures IV, V, or VI:

IV

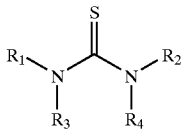

V

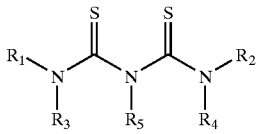

VI

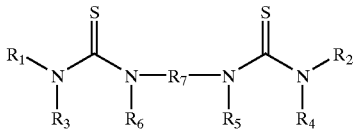

wherein:

in Structure IV, $R_1$, $R_2$, $R_3$ and $R_4$ are independently hydrogen, alkyl, cycloalkyl, allyl, alkenyl, alkynyl, aryl or heterocyclic groups, or $R_1$ and $R_2$ taken together, $R_3$ and $R_5$ taken together, $R_1$ and $R_3$ taken together or $R_2$ and $R_4$ taken together, can form a 5- to 7-membered heterocyclic ring, in Structure V, $R_1$, $R_2$, $R_3$, $R_4$ and $R_5$ are independently hydrogen, alkyl, cycloalkyl, allyl, alkenyl, alkynyl, aryl or heterocyclic groups, or $R_3$ and $R_5$ taken together, $R_4$ and $R_5$ taken together, $R_1$ and $R_3$ taken together or $R_2$ and $R_4$ taken together, can form a substituted or unsubstituted 5- to 7-membered heterocyclic ring, and in Structure VI, $R_1$, $R_2$, $R_3$, $R_4$, $R_5$, and $R_6$ are independently hydrogen, alkyl, cycloalkyl, allyl, alkenyl, alkynyl, aryl or heterocyclic groups, or $R_3$ and $R_6$ taken together, $R_4$ and $R_5$ taken together, $R_1$ and $R_3$ taken together, $R_2$ and $R_4$ taken together, or $R_5$ and $R_6$ taken together, can form a substituted or unsubstituted 5- to 7-membered heterocyclic ring, and $R_7$ is a divalent aliphatic or alicyclic linking group.

52. The photothermographic material of claim 50 wherein said selenium chemical sensitizer is represented by Structure I-a:

III

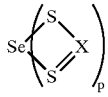

wherein X represents the same or different $COR_a$, $CSR_a$, $CN(R_a)(R_b)$, $CR_a$, $P(R_a)(R_b)$, or $P(OR_a)(OR_b)_2$ group, $R_a$ and $R_b$ are independently substituted or unsubstituted alkyl groups, and p is 2 or 4.

53. The photothermographic material of claim 50 wherein said photocatalyst is silver bromide, silver iodide, silver chloride, silver bromoiodide, silver chlorobromoiodide, silver chlorobromide or mixtures of silver halides.

54. The photothermographic material of claim 50 wherein said non-photosensitive source of reducible silver ions is a silver salt of a fatty acid having from 10 to 30 carbon atoms, or a mixture of said silver salts.

55. The photothermographic material of claim 50 further including a co-developer selected from the group consisting of trityl hydrazides, formyl phenyl hydrazides, 3-heteroaromatic-substituted acrylonitriles, 2-substituted malondialdehydes, substituted propenitriles, 4-substituted isoxazoles, 2,5-dioxo-cyclopentane carboxaldehydes, 5-(hydroxymethylene)-1,3-dialkylbarbituric acids, 2-(ethoxymethylene)-1H-indene-1,3(2H)-diones, and 2-substituted malondialdehyde compounds.

56. The photothermographic material of claim 55 further including a contrast enhancing agent selected from the group consisting of hydroxylamines, alkanolamines, ammonium phthalamate compounds, hydroxamic acids, N-acylhydrazines, and hydrogen atom donor compounds.

57. The photothermographic material of claim 50 further comprising a heteroaromatic mercapto compound in an amount of at least 0.0001 mole per mole of total silver.

58. The photothermographic material of claim 57 wherein said heteroaromatic mercapto compound is 2-mercaptobenzimidazole, 2-mercapto-5-methylbenzimidazole, 2-mercaptobenzothiazole, 2-mercaptobenzoxazole, or a mixture of two or more of these compounds.

59. The photothermographic material of claim 50 further comprising a sulfur chemical sensitizer selected from the group consisting of a thiosulfate compound, a thiazole compound, a rhodanine compound, or a thiourea compound.

60. The photothermographic material of claim 59 wherein the thiourea compound is represented by the following Structures IV, V, or VI:

IV

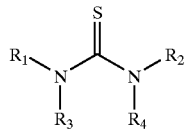

V

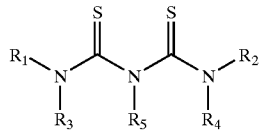

VI

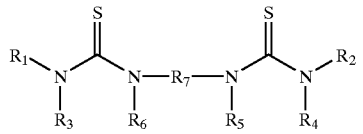

wherein:

in Structure IV, $R_1$, $R_2$, $R_3$ and $R_4$ are independently hydrogen, alkyl, cycloalkyl, allyl, alkenyl, alkynyl, aryl or heterocyclic groups, or $R_1$ and $R_2$ taken together, $R_3$ and $R_5$ taken together, $R_1$ and $R_3$ taken together or $R_2$ and $R_4$ taken together, can form a 5- to 7-membered heterocyclic ring, in Structure V, $R_1$, $R_2$, $R_3$, $R_4$ and $R_5$ are independently hydrogen, alkyl, cycloalkyl, allyl, alkenyl, alkynyl, aryl or heterocyclic groups, or $R_3$ and $R_5$ taken together, $R_4$ and $R_5$ taken together, $R_1$ and $R_3$ taken together or $R_2$ and $R_4$ taken together, can form a substituted or unsubstituted 5- to 7-membered heterocyclic ring, and in Structure VI, $R_1$, $R_2$, $R_3$, $R_4$, $R_5$, and $R_6$ are independently hydrogen, alkyl, cycloalkyl, allyl, alkenyl, alkynyl, aryl or heterocyclic groups, or $R_3$ and $R_6$ taken together, $R_4$ and $R_5$ taken together, $R_1$ and $R_3$ taken together, $R_2$ and $R_4$ taken together, or $R_5$ and $R_6$ taken together, can form a substituted or unsubstituted 5- to 7-membered heterocyclic ring, and $R_7$ is a divalent aliphatic or alicyclic linking group.

61. The photothermographic material of claim 50 further comprising a tellurium chemical sensitizer.

62. The photothermographic material of claim 61 wherein the tellurium chemical sensitizer is represented by the following Structures VII or VIII:

$$Te(L^{11})_{m'}(X^{11})_{n'} \quad \text{VII}$$

$$Pd(X^{12})_2[Te(R'')_2]_2 \quad \text{VIII}$$

wherein $X^{11}$ and $X^{12}$ independently represent halo, OCN, SCN, $S(C{=}S)N(R_{aa})(R_{bb})$, $S(C{=}S)OR_{aa}$, $S(C{=}S)SR_{aa}$, $S(P{=}S)(OR_{aa})(OR_{bb})$, $S(P{=}S)(R_{aa})(R_{bb})$, SeCN, TeCN, CN, $SR_{aa}$, $OR_{aa}$, $N_3$, alkyl, aryl, or $O(C{=}O)R_{aa}$ groups, $R_{aa}$ and $R_{bb}$ are an alkyl, alkenyl, cycloalkyl, heterocyclyl, or aryl group, or $R_{aa}$ and $R_{bb}$ taken together can form a 5-, 6- or 7-membered heterocyclic ring, $L^{11}$ is a ligand derived from a neutral Lewis base, R" is an alkyl or aryl group, m' is 0, 1, 2, or 4, and n' is 2 or 4 provided that multiple $X^{11}$, $X^{12}$, $L^{11}$, $R_{aa}$, $R_{bb}$, or R" groups in the molecule can be the same or different.

63. The photothermographic material of claim 50 further comprising a gold chemical sensitizer.

64. The photothermographic material of claim 63 wherein the gold chemical sensitizer is represented by the following Structure IX:

$$Au[3+](L'')_{r'}(Y')_{q'} \quad \text{IX}$$

wherein L" represents the same or different ligands, each ligand comprising at least one heteroatom that is capable of forming a bond with gold, Y' is an anion, r' is an integer of from 1 to 4, and q' is an integer of from 0 to 3.

65. The photothermographic material of claim 50 further comprising an oxidatively decomposed sulfur-containing compound.

66. The photothermographic material of claim 65 wherein the oxidatively decomposed sulfur-containing compound is a spectral sensitizing dye.

67. The photothermographic material of claim 50 achieving further chemical sensitization by oxidative decomposition of a sulfur-containing compound on or around the silver halide grains in an oxidizing environment.

68. The photothermographic material of claim 50 further comprising a mixture of two or more of: a tellurium chemical sensitizer, a gold chemical sensitizer, a sulfur chemical sensitizer, or an oxidatively decomposed sulfur-containing compound.

69. The photothermographic material of claim 68 wherein:

the sulfur chemical sensitizer is represented by the following Structures IV, V, and VI:

IV

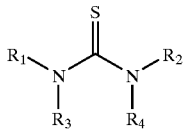

V

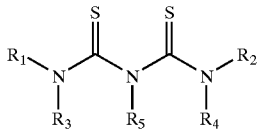

VI

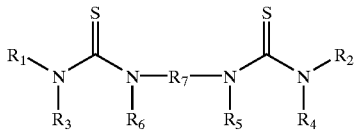

wherein:

in Structure IV, $R_1$, $R_2$, $R_3$ and $R_4$ are independently hydrogen, alkyl, cycloalkyl, allyl, alkenyl, alkynyl, aryl or heterocyclic groups, or $R_1$ and $R_2$ taken together, $R_3$ and $R_5$ taken together, $R_1$ and $R_3$ taken together or $R_2$ and $R_4$ taken together, can form a 5- to 7-membered heterocyclic ring, in Structure V, $R_1$, $R_2$, $R_3$, $R_4$ and $R_5$ are independently hydrogen, alkyl, cycloalkyl, allyl, alkenyl, alkynyl, aryl or heterocyclic groups, or $R_3$ and $R_5$ taken together, $R_4$ and $R_5$ taken together, $R_1$ and $R_3$ taken together or $R_2$ and $R_4$ taken together, can form a substituted or unsubstituted 5- to 7-membered heterocyclic ring, and in Structure VI, $R_1$, $R_2$, $R_3$, $R_4$, $R_5$, and $R_6$ are independently hydrogen, alkyl, cycloalkyl, allyl, alkenyl, alkynyl, aryl or heterocyclic groups, or $R_3$ and $R_6$ taken together, $R_4$ and $R_5$ taken together, $R_1$ and $R_3$ taken together, $R_2$ and $R_4$ taken together, or $R_5$ and $R_6$ taken together, can form a substituted or unsubstituted 5- to 7-membered heterocyclic ring, and $R_7$ is a divalent aliphatic or alicyclic linking group, the tellurium chemical sensitizer is represented by the following Structures VII and VIII:

$Te(L^{11})_{m'}(X^{11})_{n'}$ VII $Pd(X^{12})_2[Te(R'')_2]_2$ VIII wherein $X^{11}$ and $X^{12}$ independently represent halo, OCN, SCN, $S(C{=}S)N(R_{aa})(R_{bb})$, $S(C{=}S)OR_{aa}$, $S(C{=}S)SR_{aa}$, $S(P{=}S)(OR_{aa})(OR_{bb})$, $S(P{=}S)(R_{aa})(R_{bb})$, SeCN, TeCN, CN, $SR_{aa}$, $OR_{aa}$, $N_3$, alkyl, aryl, or $O(C{=}O)R_{aa}$ groups, $R_{aa}$ and $R_{bb}$ are an alkyl, alkenyl, cycloalkyl, heterocyclyl, or aryl group, or $R_{aa}$ and $R_{bb}$ taken together can form a 5-, 6- or 7-membered heterocyclic ring, $L^{11}$ is a ligand derived from a neutral Lewis base, R" is an alkyl or aryl group, m' is 0, 1, 2, or 4, and n' is 2 or 4 provided that multiple $X^{11}$, $X^{12}$, $L^{11}$, $R_{aa}$, $R_{bb}$, or R" groups in the molecule can be the same or different, the gold chemical sensitizer is represented by the following Structure IX:

$Au[3+](L'')_{r'}(Y')_{q'}$ IX wherein L" represents the same or different ligands, each ligand comprising at least one heteroatom that is capable of forming a bond with gold, Y' is an anion, r' is an integer of from 1 to 4, and q' is an integer of from 0 to 3, and the oxidatively decomposed sulfur-containing compound is a spectral sensitizing dye.

70. The photothermographic material of claim 50 further comprising a phthalazine or a phthalazine derivative.

71. A photothermographic material comprising a transparent support having thereon one or more layers one on side thereof comprising a binder and in reactive association:

a. a photocatalyst, b. a non-photosensitive source of reducible silver ions, c. a reducing composition for said reducible silver ions, and d. a selenium chemical sensitizer represented by the following Structures I, II, or III:

$Se(L)_m(X^1)_n$ I $M(L')_s(X^2)_r$ II $(Z)_wM'_xSe_y(CO)_z$ III wherein $X^1$ and $X^2$ independently represent halo, CN, SCN, SeCN, TeCN, $N_3$, $BF_4$, $ClO_4$, $BPh_4$, $PF_6$, $NO_3$, $SO_3CF_3$, $R_a$, $R_b$, $O(C{=}O)CF_3$, $S(C{=}S)N(R_a)(R_b)$, $S(C{=}S)OR_a$, $S(C{=}S)SR_a$, $S(P{=}S)(OR_a)(OR_b)$, $S(P{=}S)(R_a)(R_b)$, $SR_a$, $SeR_a$, $TeR_aOR_a$, or $O(C{=}O)R_a$ groups, $R_a$ and $R_b$ independently represent alkyl, alkenyl, cycloalkyl, heterocyclyl, or aryl groups, or $R_a$ and $R_b$ taken together can form a 5-, 6- or 7-membered heterocyclic ring, L is a ligand derived from a neutral Lewis base, m is 0, 1, 2, 3, or 4 and n is 2 or 4 with the proviso that when m is 0, n is 2 or 4, and when m is 0 and n is 2, then $X^1$ is not $R_a$, $R_b$, or $R_aSe$, M represents Cu(1+), Pd(2+), or Pt(2+), L' represents a neutral ligand with a Group 15 atom or a Group 16 atom, provided that at least one of L' or $X^2$ contains a selenium atom, r is 1 or 2 and s is 1, 2, 3, or 4 such that when M represents Cu(1+), r is 1 and when M represents Pd(2+) or Pt(2+), r is 2, Z represents a monovalent cation, M' represents Fe, Ru, Os, Co, Rh, or Ir, x is an integer of from 1 to 6, y is an integer of from 1 through 6, z is an integer of from 6 through 20, w is an integer inclusive of from 0 through 4 and represents the number of Z groups necessary to neutralize the electronic charge on the rest of the compound, and further provided that multiple $X^1$, $X^2$, L, L', $R_a$, $R_b$, groups in the molecule can be the same or different, and on the opposite side of said transparent support, an antihalation layer comprising one or more antihalation dyes.

72. The photothermographic material of claim 71 wherein said antihalation layer comprises a heat-bleachable antihalation composition.

73. A method for forming a visible image comprising:

A) imagewise exposing the photothermographic material of claim 71 to electromagnetic radiation to form a latent image, and B) simultaneously or sequentially, heating said exposed photothermographic material to develop said latent image into a visible image.

* * * * *